US008424302B2

(12) United States Patent
Morinaga et al.

(10) Patent No.: US 8,424,302 B2
(45) Date of Patent: Apr. 23, 2013

(54) CONTROL DEVICE OF ENGINE, CONTROL DEVICE OF ENGINE AND HYDRAULIC PUMP, AND CONTROL DEVICE OF ENGINE, HYDRAULIC PUMP, AND GENERATOR MOTOR

(75) Inventors: Jun Morinaga, Yokohama (JP); Tadashi Kawaguchi, Hiratsuka (JP); Hiroaki Inoue, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 997 days.

(21) Appl. No.: 12/084,235

(22) PCT Filed: Oct. 27, 2006

(86) PCT No.: PCT/JP2006/321562

§ 371 (c)(1),
(2), (4) Date: May 8, 2009

(87) PCT Pub. No.: WO2007/049767

PCT Pub. Date: May 3, 2007

(65) Prior Publication Data

US 2009/0320461 A1 Dec. 31, 2009

(30) Foreign Application Priority Data

Oct. 28, 2005 (JP) ..... 2005-314897
Oct. 28, 2005 (JP) ..... 2005-314898
Feb. 14, 2006 (JP) ..... 2006-036738

(51) Int. Cl.
*F02D 29/04* (2006.01)
*F15B 11/00* (2006.01)

(52) U.S. Cl.
USPC ..... 60/431; 60/422

(58) Field of Classification Search ..... 60/422, 60/423, 431
See application file for complete search history.

(56) References Cited

U.S. PATENT DOCUMENTS 6,020,651 A * 2/2000 Nakamura et al. ..... 290/40 R
6,708,787 B2 * 3/2004 Naruse et al. ..... 180/53.8
6,820,356 B2 * 11/2004 Naruse et al. ..... 60/431

FOREIGN PATENT DOCUMENTS

JP 11-002144 1/1999
JP 2003-028071 1/2003
JP 2004-150307 5/2004
JP 2004-232737 8/2004
JP 2005-086892 3/2005
JP 2005-232835 9/2005

OTHER PUBLICATIONS

International Search Report mailed Jan. 9, 2007, issued on PCT/JP2006/321562.

* cited by examiner

*Primary Examiner* — Thomas E Lazo
(74) *Attorney, Agent, or Firm* — Edwards Wildman Palmer LLP

(57) ABSTRACT

An object of the present invention is to operate the working machine etc. with satisfactory responsiveness as intended by the operator while enhancing engine efficiency, pump efficiency, and the like, where a first engine target revolution ncom1 adapted to a current pump target discharge flow rate Qsum is set, and when determined that the current pump target discharge flow rate Qsum is greater than a predetermined flow rate (10 (L/min)), a revolution nM (e.g., 1400 rpm) greater than an engine low idle revolution nL is set as a second engine target revolution ncom2 determining that operation levers 41 to 44 switched from a non-operation state to an operation state. The engine revolution is controlled so that the second engine target revolution ncom2 is obtained if the second engine target revolution ncom2 is equal to or greater than the first engine target revolution ncom1.

23 Claims, 18 Drawing Sheets

CONTROL DEVICE OF ENGINE, CONTROL DEVICE OF ENGINE AND HYDRAULIC PUMP, AND CONTROL DEVICE OF ENGINE, HYDRAULIC PUMP, AND GENERATOR MOTOR

TECHNICAL FIELD

The present invention relates to a control device of an engine, a control device of an engine and a hydraulic pump, and a control device of an engine, a hydraulic pump, and a generator motor, in particular, to a control device that is used when driving the hydraulic pump with the engine.

BACKGROUND ART

A diesel engine is mounted on construction machines such as hydraulic shovel, bulldozer, damp truck, wheel loader and the like.

Describing the outline of the configuration of a conventional construction machine 1 using FIG. 1, a hydraulic pump 3 is driven with a diesel engine 2 as a drive source, as shown in FIG. 1. A variable displacement hydraulic pump is used for the hydraulic pump 3, where capacity q (cc/rev) is changed by changing a tilt angle etc. of a swash plate 3*a*. The pressurized fluid discharged from the hydraulic pump 3 at a discharge pressure PRP and flow rate Q (cc/min) is supplied to each hydraulic actuator 31 to 36 such as boom hydraulic cylinder 31 via operation valves 21 to 26. Each operation valve 21 to 26 is operated through operation of each operation lever 41, 42. When pressurized fluid is supplied to each hydraulic actuator 31 to 36, each hydraulic actuator 31 to 36 is driven, and a working machine including a boom, an arm, a bucket etc., a lower crawler carrier, and an upper rotation body connected to each hydraulic actuator 31 to 36 are operated. While the construction machine 1 is operating, the load applied on the working machine, the lower crawler carrier, and the upper rotation body continuously changes according to the excavating soil quality, traveling path gradient and the like. The load (hereinafter referred to as hydraulic equipment load) of the hydraulic equipment (hydraulic pump 3), that is, the load on the engine 2 accordingly changes.

The control of the output P ((horsepower) kw) of the diesel engine 2 is carried out by adjusting the fuel amount to be injected into the cylinder. This adjustment is performed by controlling a governor 4 arranged next to a fuel injection pump of the engine 1. Generally an all speed control type governor is used for the governor 4, and the engine revolutions and the fuel injection amount (torque T) are adjusted according to the load so that a target engine revolution set through fuel dial is maintained. That is, the governor 4 increases and decreases the fuel injection amount so that a difference between the target revolution and the engine revolution is eliminated.

FIG. 2 shows a torque curve diagram of the engine 1, where the horizontal axis is the engine revolution n (rpm: rev/min) and the vertical axis the torque T (N·m).

In FIG. 2, the region defined by a maximum torque curve R shows the performance the engine 2 can exhibit. The governor 4 controls the engine 2 so that the torque T does not become the exhaust smoke limit exceeding the maximum torque curve R and so that the engine revolution n does not become over rotation exceeding a high idle revolution nH. The output (horsepower) P of the engine 2 becomes a maximum at a rated point V on the maximum torque curve R. J indicates an equal-horsepower curve at where the horsepower absorbed by the hydraulic pump 3 becomes equal-horsepower.

When set to the maximum target revolution with the fuel dial, the governor 4 carries out speed governing on a maximum speed regulation line Fe connecting the rated point V and the high idle point nH.

As the load of the hydraulic pump 3 becomes greater, the matching point at where the output of the engine 2 and the pump absorption horsepower balances moves towards the rated point V side on the maximum speed regulation line Fe. When the matching point moves towards the rated point V side, the engine revolution n is gradually decreased and the engine revolution n becomes rated revolution at the rated point V.

Thus, problems in that the fuel consumption rate is large (bad) and the pump efficiency is low arise when performing the work with the engine revolution n fixed at a substantially constant high revolution. The fuel consumption rate (hereinafter referred to as fuel consumption) is the consumption amount of fuel per one hour and output 1 kW, and is one index of efficiency of the engine 2. The pump efficiency is the efficiency of the hydraulic pump 3 defined by capacity efficiency and torque efficiency.

In FIG. 2, M shows the equal fuel consumption curve. The fuel consumption becomes a minimum at M1, which is the valley part of the equal fuel consumption curve M, and the fuel consumption becomes greater towards the outer side from the fuel consumption minimum point M1.

As also apparent from FIG. 2, the regulation line Fe corresponds to a region where the fuel consumption is relatively large on the equal fuel consumption curve M. Thus, according to the conventional control method, the fuel consumption is large (bad), which is not desirable in engine efficiency.

In the case of the variable displacement hydraulic pump 3, it is generally known that the capacity efficiency and the torque efficiency are high and that the pump efficiency is high the larger the pump capacity q (swash plate tilt angle) at the same discharge pressure PRP.

As also apparent from the following equation (1), if the flow rate Q of the pressurized fluid discharged from the hydraulic pump 3 is the same, the pump capacity q can be increased by lowering the revolution n of the engine 2. Thus, the pump efficiency can be enhanced by speed-reducing the engine 2.

$$Q=n\cdot q \tag{1}$$

Therefore, the engine 2 is operated in a low-speed region where the revolution n is low to enhance the pump efficiency of the hydraulic pump 3.

However, as also apparent from FIG. 2, the regulation line Fe corresponds to a high rotation region of the engine 2. Thus, the conventional control method has a problem in that the pump efficiency is low.

If the engine 2 is operated on the regulation line, the engine revolution lowers at high load and might cause engine stall.

On the contrary to a control method of substantially fixing the engine revolution regardless of the load, a control method of changing the engine revolution according to the lever operation amount and the load is disclosed in Patent Document 1.

In Patent Document 1, a target engine operating line $L_0$ passing through the fuel consumption minimum point is set, as shown in FIG. 2.

The required revolution of the hydraulic pump 3 is calculated based on the operation amount etc. of each operation levers 41, 42, 43, 44, and a first engine required revolution corresponding to the pump required revolution is calculated. The engine required horsepower is calculated based on the operation amount etc. of each operation levers 41, 42, 43, 44, and a second engine required revolution corresponding to the engine required horsepower is calculated. The second engine required revolution is calculated as an engine revolution on a target operating line $L_0$ of FIG. 2. The engine revolution and the engine torque are controlled so that greater engine target revolution of the first or the second engine required revolution is obtained.

As shown in FIG. 2, the fuel consumption, the engine efficiency, and the pump efficiency are enhanced by controlling the revolution of the engine 2 along the target engine operating line $L_0$. This is because even when outputting the same horsepower and obtaining the same requested flow rate, transition can be made from high rotation, low torque to low rotation, high torque, the pump capacity q becomes large, and operation is made at a point close to the fuel consumption minimum point M1 on the equal fuel consumption curve M when matched at the point on the same equal horsepower line J, the point pt2 being on the target engine operating line $L_0$, than when matched at point pt1 on the regulation line Fe. The noise is enhanced by operating the engine 2 in the low rotation region, and engine friction, pump unload loss, and the like are enhanced.

In the field of construction machine, a construction machine of hybrid type that assists the driving force of the engine by the generator motor is being developed, and many have been applied for patent.

In Patent Document 2, the engine 2 is controlled along the regulation line Fe0 corresponding to the set revolution set with the fuel dial with reference again to FIG. 2. The target revolution nr corresponding to a point A at where the regulation line Fe0 and the target engine operating line $L_0$ intersect is obtained, where the generator motor is electrically motor-operated to assist the driving force of the engine 2 with the torque generated by the generator motor if the deviation of the engine target revolution nr and the current engine revolution n is positive, and the generator motor is generator, operated to store power in an electrical storage device if the deviation is negative.

Patent Document 1: Japanese Patent Application Laid-Open No. 11-2144

Patent Document 2: Japanese Patent Application Laid-Open No. 2003-28071

DISCLOSURE OF INVENTION

Problems to be Solved by the Invention

The invention described in Patent Document 1 merely estimates and calculates how much revolution and horsepower the hydraulic power 3 currently needs based on the operation amount etc. of each operation levers 41, 42, and calculates the engine target revolution corresponding thereto.

However, in reality, the actual engine output corresponding to the current engine revolution sometimes does not have a margin with respect to the actual absorption horsepower of the current hydraulic pump. Thus, even when attempting to raise the engine revolution up to the engine target revolution, the engine output does not have a margin with respect to the power for the absorption horsepower of the hydraulic pump and the power for raising the engine revolution lacks, whereby the revolution cannot be raised up to the engine target revolution or can be raised only in a very small pace. As a result, drawbacks in that the working machine etc. (lower crawler carrier, upper rotation body) of the construction machine 1 does not operate as intended by the operator, the operation delays, or the like arise.

Furthermore, the necessary engine horsepower, and the engine revolution actually differ depending on the work pattern.

In the work pattern of a excavating work, the absorption horsepower of the hydraulic pump needs to be raised. On the other hand, in an earth removal work or a work of carrying earth and sand with a bucket, the absorption horsepower of the hydraulic pump may be lower. Wasted energy consumption might occur unless the engine horsepower is appropriately limited according to the work pattern.

In the invention described in Patent Document 1, the engine target revolution is defined according to the load of the hydraulic pump 3. In FIG. 2, the matching point moves from B→A towards the high load side of the target engine operating line $L_0$ as the hydraulic pump 3 becomes higher load.

However, as described above, even when attempting to raise the engine revolution up to point A of target high rotation from the state the engine 2 is matched at point B of low rotation, since the absorption torque of the hydraulic pump 3 is small at the matching point B of low rotation, the working machine etc. (lower crawler carrier, upper rotation body) sometimes operate only in a very small pace even if each operation levers 41 to 44 is largely operated at the early stage of rise in raising the engine revolution. Thus, the working machine etc. does not operate with satisfactory response to the operation levers 41 to 44, which might give an uncomfortable feeling in operation to the operator and lower the work efficiency.

In the invention described in Patent Document 2, the matching point moves C→A along the regulation line Fe0. As the hydraulic pump 3 becomes higher load, the matching point moves towards the high load side on the regulation line Fe0.

The engine revolution n gradually decreases when moving from matching point C on the low load side on the regulation line Fe0 to matching point A on the high load side. As the engine revolution n lowers, the output retained at the fly wheel of the engine 2 is instantaneously output towards the outside, and the apparent output becomes equal to or greater than the actual output of the engine 2. Thus, the movement of the matching point along the regulation line is found to have a satisfactory responsiveness from the beginning.

However, in Patent Document 2, the engine target revolution nr is uniquely defined by the setting of the fuel dial, and the engine revolution n only slightly fluctuates along the regulation line Fe0. The engine revolution does not greatly fluctuate along the target engine operating line $L_0$ according to the load of the hydraulic pump 3 as in the movement from point B to point A on the target engine operating line $L_0$. The engine 2 does not operate in the low rotation region unless set by the fuel dial, and the pump efficiency, the fuel consumption, and the noise become worse.

In view of such situations, the present invention aims to operate the working machine etc. with satisfactory responsiveness as intended by the operator while enhancing engine efficiency, pump efficiency, and the like and to prevent wasted energy consumption in such a case.

Means for Solving Problem

According to a first aspect of the present invention, a control device of an engine includes a hydraulic pump driven by the engine; hydraulic actuators supplied with pressurized fluid discharged from the hydraulic pump; an operation unit for operating each hydraulic actuator; a detection unit for detecting an operation amount of the operation unit; a target flow rate calculating unit for calculating a target flow rate of the hydraulic pump based on the operation amount of the operation unit; a first target revolution calculating unit for calculating a first target revolution of the engine according to the target flow rate; an operation state determining unit for determining a switch of the operation unit from a non-operation state to an operation state; a second target revolution setting unit for setting the target revolution of the engine to a second target revolution which is higher than a low idle revolution when determined that switch is made to the operation state by the operation state determining unit; and a revolution control unit for controlling the engine revolution to match the higher target revolution of the first target revolution and the second target revolution.

According to a second aspect of the present invention according to the first aspect, in a control device of an engine, the operation state determining unit may determine that switching is made to the non-operation state when the operation amount of the operation unit is equal to or smaller than a predetermined value, and may determine that switching is made to the operation state when the operation amount of the operation unit is greater than the predetermined threshold value.

According to a third aspect of the present invention according to the first aspect, in a control device of an engine, the operation state determining unit may determine that switching is made to the non-operation state when the target flow rate of the hydraulic pump is equal to or smaller than a predetermined value, and may determine that switching is made to the operation state when the target flow rate of the hydraulic pump is greater than the predetermined threshold value.

According to a fourth aspect of the present invention, a control device of an engine and a hydraulic pump includes a hydraulic pump driven by the engine; a plurality of hydraulic actuators supplied with pressurized fluid discharged from the hydraulic pump; an operation unit for operating each hydraulic actuator; a detection unit for detecting an operation amount of the operation unit; a first target revolution setting unit for setting a first target revolution of the engine according to the operation amount obtained by the detection unit; a determining unit for determining a work pattern of the plurality of hydraulic actuators by using the operation amounts of each operation unit and a load pressure of hydraulic pump; a horsepower limit value setting unit for setting a horsepower limit value of the hydraulic pump according to each work pattern; a second target revolution setting unit for setting a second target revolution of the engine according to the horsepower limit value of the hydraulic pump; a capacity control unit for controlling a capacity of the hydraulic pump to obtain a pump absorption torque corresponding to the smaller target revolution of the first target revolution and the second target revolution; and a revolution control unit for controlling the engine revolution to match the smaller target revolution of the first target revolution and the second target revolution.

According to a fifth aspect of the present invention, a control device of an engine and a hydraulic pump includes a hydraulic pump driven by the engine; a plurality of hydraulic actuators supplied with pressurized fluid discharged from the hydraulic pump; an operation unit for operating each hydraulic actuator; a detection unit for detecting a operation amount of the operation unit; a unit for setting an engine revolution by fuel dial; a first target revolution setting unit for setting a first target revolution of the engine according to the set value of the fuel dial; a determining unit for determining a work pattern of the plurality of hydraulic actuators by using the operation amounts of each operation unit and a load pressure of the hydraulic pump; a horsepower limit value setting unit for setting a horsepower limit value of the hydraulic pump according to each work pattern; a second target revolution setting unit for setting a second target revolution of the engine according to the horsepower limit value of the hydraulic pump; a capacity control unit for controlling a capacity of the hydraulic pump to obtain a pump absorption torque corresponding to the smaller target revolution of the first target revolution and the second target revolution; and a revolution control unit for controlling the engine revolution to match the smaller target revolution of the first target revolution and the second target revolution.

According to a sixth aspect of the present invention, a control device of an engine, a hydraulic pump, and a generator motor includes a hydraulic pump driven by the engine; hydraulic actuators supplied with pressurized fluid discharged from the hydraulic pump; a generator motor connected to an output shaft of the engine; an electrical storage device for accumulating power generated by the generator motor and supplying power to the generator motor; a calculating unit for calculating a requested power generation amount of the generator motor according to a storage state of the electrical storage device; an engine target revolution setting unit for setting a target revolution of the engine; a maximum torque curve setting unit for setting a maximum torque curve indicating a maximum absorption torque which can be absorbed by the hydraulic pump according to the target revolution of the engine; a revolution control unit for controlling the engine revolution so that the engine revolution matches a current engine target revolution; a capacity control unit for controlling a capacity of the hydraulic pump to obtain a pump absorption torque having a pump absorption torque on the maximum torque curve corresponding to the current engine target revolution as an upper limit; a determining unit for determining whether or not to operate an engine-torque-assist of the generator motor; and a generator motor control unit that operates the engine-torque-assist of the generator motor when determined to be in the engine-torque-assist of the generator motor by the determining unit, and that operates a power-generation of the generator motor according to the requested power generation amount when determined not to be in the engine-torque-assist of the generator motor.

According to a seventh aspect of the present invention, a control device of an engine, a hydraulic pump, and a generator motor includes a hydraulic pump driven by the engine; hydraulic actuators supplied with pressurized fluid discharged from the hydraulic pump; a generator motor connected to an output shaft of the engine; an electrical storage device for accumulating power generated by the generator motor and supplying power to the generator motor; a calculating unit for calculating a requested power generation amount of the generator motor according to a storage state of the electrical storage device; an engine target revolution setting unit for setting a target revolution of the engine; a first maximum torque curve setting unit for setting a first maximum torque curve indicating a maximum absorption torque which can be absorbed by the hydraulic pump according to the target revolution of the engine; a second maximum torque curve setting unit for setting a second maximum torque curve in which a maximum absorption torque becomes large in an engine low rotation region with respect to the first maximum torque curve; a revolution control unit for controlling the engine revolution so that the engine revolution matches a current engine target revolution; a determining unit for determining whether or not to operate an engine-torque-assist of the generator motor; a pump capacity controlling unit for selecting the second maximum torque curve as a maximum torque curve and controlling the capacity of the hydraulic pump so as to obtain an upper limit which is a pump absorption torque having the pump absorption torque on the second maximum torque curve corresponding to the current engine target revolution when determined to be in the engine-torque-assist of the generator motor by the determining unit, and selecting the first maximum torque curve as the maximum torque curve and controlling the capacity of the hydraulic pump so as to obtain an upper limit which is a pump absorption torque having the pump absorption torque on the first maximum torque curve corresponding to the current engine target revolution when determined not to be in the engine-torque-assist of the generator motor by the determining unit; and a generator motor control unit that operates the engine-torque-assist of the generator motor when determined to be in the engine-torque-assist of the generator motor by the determining unit, and that operates a power-generation of the generator motor according to the requested power generation amount when determined not to be in the engine-torque-assist of the generator motor.

According to an eighth aspect of the present invention according to the sixth aspect, in a control device of an engine, a hydraulic pump, and a generator motor, the determining unit may determine to operate the engine-torque-assist of the generator motor when an absolute value of a deviation between the engine target revolution and an actual revolution of the engine is equal to or greater than a predetermined threshold value, and may determine not to operate the engine-torque-assist of the generator motor when the absolute value of the deviation between the engine target revolution and the actual revolution of the engine is smaller than a predetermined threshold value.

According to a ninth aspect of the present invention according to the eighth aspect, in a control device of an engine, a hydraulic pump, and a generator motor may further include a storage amount calculating unit for calculating the storage amount currently stored in the electrical storage device, and the determining unit may determine not to operate the engine-torque-assist of the generator motor when the storage amount calculated by the storage amount calculating unit is equal to or smaller than a predetermined threshold value.

According to a tenth aspect of the present invention according to the eighth aspect, in a control device of an engine, a hydraulic pump, and a generator motor may further include a rotation motor for rotating an upper rotation body of a construction machine; a rotation operation unit for operating a turn-operation of the upper rotation body; a control unit for controlling the rotation motor according to the turn-operation of the rotation operation unit; an output calculating unit for calculating a current output of the rotation motor; and a calculating unit for calculating a requested power generation amount of the generator motor according to the storage state of the electrical storage device and the driving state of the rotation motor, and the determining unit may determine not to operate the engine-torque-assist of the generator motor when the current output of the rotation motor is equal to or greater than a predetermined threshold value.

According to a eleventh aspect of the present invention according to the sixth aspect, in a control device of an engine, a hydraulic pump, and a generator motor eleventh, the generator motor control unit may control an output torque of the generator motor so that the engine revolution becomes the same revolution as the engine target revolution by adding an axial torque of the engine on a torque curve diagram of the engine when the current engine revolution is smaller than the engine target revolution, and may control the output torque of the generator motor so that the engine revolution becomes the same revolution as the engine target revolution by absorbing the axial torque of the engine on the torque curve diagram of the engine when the current engine revolution is greater than the engine target revolution.

According to a twelfth aspect of the present invention according to the sixth aspect, a control device of an engine, a hydraulic pump, and a generator motor may further include a torque control unit for controlling the torque of the generator motor in a range of equal to or smaller than a torque upper limit value during engine torque assist operation of the generator motor; and a torque upper limit value setting unit for gradually decreasing the torque upper limit value with decrease in the storage amount of the electrical storage device from a first predetermined value to a second predetermined value smaller than the first predetermined value.

According to a thirteenth aspect of the present invention according to the sixth aspect, a control device of an engine, a hydraulic pump, and a generator motor may further include a torque control unit for controlling the torque of the generator motor in a range of equal to or smaller than a torque upper limit value during engine torque assist operation of the generator motor; and a torque upper limit value setting unit for gradually decreasing the torque upper limit value with decrease in the storage amount of the electrical storage device from a first predetermined value to a second predetermined value smaller than the first predetermined value, and gradually increasing the torque upper limit value with increase in the storage amount of the electrical storage device from a third predetermined value to a fourth predetermined value greater than the third predetermined value when increasing the torque upper limit value after once decreased.

According to a fourteenth aspect of the present invention according to the tenth aspect, a control device of an engine, a hydraulic pump, and a generator motor may further include a torque control unit for controlling the torque of the generator motor in a range of equal to or smaller than a torque upper limit value during engine torque assist operation of the generator motor; and a torque upper limit value setting unit for gradually decreasing the torque upper limit value with increase in the current output of the rotation motor from a first predetermined value to a second predetermined value greater than the first predetermined value.

According to a fifteenth aspect of the present invention according to the tenth aspect, a control device of an engine, a hydraulic pump, and a generator motor may further include a torque control unit for controlling the torque of the generator motor in a range of equal to or smaller than a torque upper limit value during engine torque assist operation of the generator motor; and a torque upper limit value setting unit for gradually decreasing the torque upper limit value with increase in the current output of the rotation motor from a first predetermined value to a second predetermined value greater than the first predetermined value, and gradually increasing the torque upper limit value with decrease in the current output of the rotation motor from a third predetermined value to a fourth predetermined value smaller than the third predetermined value when increasing the torque upper limit value after once decreased.

According to a sixteenth aspect of the present invention according to the sixth aspect, in a control device of an engine, a hydraulic pump, and a generator motor, the generator motor control unit may perform a control to gradually change the power generation torque of the generator motor from the torque at the termination of assistance to the power generation torque corresponding to the requested power generation amount of the generator motor, immediately after switching the generator motor from the engine torque assist operation to the power generating operation.

According to seventeenth aspect of the present invention, a control device of an engine, a hydraulic pump, and a generator motor includes a hydraulic pump driven by the engine; hydraulic actuators supplied with pressurized fluid discharged from the hydraulic pump; a generator motor connected to an output shaft of the engine; an electrical storage device for accumulating power generated by the generator motor and supplying power to the generator motor; a calculating unit for calculating a requested power generation amount of the generator motor according to a storage state of the electrical storage device; an engine target revolution setting unit for setting a target revolution of the engine; a first maximum torque curve setting unit for setting a first maximum torque curve indicating a maximum absorption torque which can be absorbed by the hydraulic pump according to the target revolution of the engine; a second maximum torque curve setting unit for setting a second maximum torque curve in which a maximum absorption torque becomes large in an engine low rotation region with respect to the first maximum torque curve; a revolution control unit for controlling the engine revolution so that the engine revolution matches a current engine target revolution; a determining unit for determining whether or not to operate an engine-torque-assist of the generator motor; a generator motor control unit for operating the engine-torque-assist of the generator motor when determined to be in the engine-torque-assist of the generator motor by the determining unit, and for operating the power-generation of the generator motor according to the requested power generation amount when determined not to be in the engine-torque-assist of the generator motor; a third pump maximum absorption torque calculating unit for calculating a third maximum torque in which the maximum absorption torque of the hydraulic pump gradually decreases with decrease in a torque upper limit value in time of assist operation of the generator motor from a first predetermined value to a second predetermined value smaller than the first predetermined value; and a pump capacity control unit for controlling a capacity of the hydraulic pump with the smaller of the pump absorption torque on the second maximum torque curve corresponding to the current engine target revolution and the third pump maximum absorption torque calculated by the third pump maximum absorption torque calculating unit as an upper limit of the pump absorption torque when determined to be in the engine-torque-assist of the generator motor by the determining unit, and for controlling the capacity of the hydraulic pump to obtain a pump absorption torque having the pump absorption torque on the first maximum torque curve corresponding to the current engine target revolution as an upper limit when determined not to be in the engine-torque-assist of the generator motor by the determining unit.

According to an eighteenth aspect of the present invention, a control device of an engine, a hydraulic pump, and a generator motor includes a hydraulic pump driven by the engine; hydraulic actuators supplied with pressurized fluid discharged from the hydraulic pump; a generator motor connected to an output shaft of the engine; an electrical storage device for accumulating power generated by the generator motor and supplying power to the generator motor; a calculating unit for calculating a requested power generation amount of the generator motor according to a storage state of the electrical storage device; an engine target revolution setting unit for setting a target revolution of the engine; a first maximum torque curve setting unit for setting a first maximum torque curve indicating a maximum absorption torque which can be absorbed by the hydraulic pump according to the target revolution of the engine; a second maximum torque curve setting unit for setting a second maximum torque curve in which a maximum absorption torque becomes large in an engine low rotation region with respect to the first maximum torque curve; a revolution control unit for controlling the engine revolution so that the engine revolution matches a current engine target revolution; a determining unit for determining whether or not to operate an engine-torque-assist of the generator motor; a generator motor control unit for operating the engine-torque-assist of the generator motor when determined to be in the engine-torque-assist of the generator motor by the determining unit, and for operating a power-generation of the generator motor according to the requested power generation amount when determined not to operate the engine-torque-assist of the generator motor; a third pump maximum absorption torque calculating unit for calculating a third maximum torque in which the maximum absorption torque of the hydraulic pump gradually decreases with decrease in a torque upper limit value in time of assist operation of the generator motor from a first predetermined value to a second predetermined value smaller than the first predetermined value; and a pump capacity control unit for controlling a capacity of the hydraulic pump with the smaller of the pump absorption torque on the second maximum torque curve corresponding to the current engine target revolution and the third pump maximum absorption torque calculated by the third pump maximum absorption torque calculating unit as an upper limit of the pump absorption torque when determined to be in the engine-torque-assist of the generator motor by the determining unit, controlling the capacity of the hydraulic pump to obtain a pump absorption torque having the pump absorption torque on the first maximum torque curve corresponding to the current engine target revolution as an upper limit when determined not to be in the engine-torque-assist of the generator motor by the determining unit, and gradually changing from a pump maximum absorption torque before switching to a pump maximum absorption torque after switching when selection of the maximum absorption torque of the hydraulic pump is switched.

According to a nineteenth aspect of the present invention according to the eighteenth aspect, in a control device of an engine, a hydraulic pump, and a generator motor, a time constant of changing from the pump maximum absorption torque before switching to the pump maximum absorption torque after switching may be set to a large value in a case where the pump maximum absorption torque before switching is greater than the pump maximum absorption torque after switching than in a case where the pump maximum absorption torque before switching is smaller than the pump maximum absorption torque after switching.

The effects according to the configurations of the first to the third aspects will be described with reference to FIG. 10.

As shown in FIG. 10, when the engine 2 and the hydraulic pump 3 are controlled according to the target torque curve L1 in which the pump absorption torque Tpcom becomes smaller with decrease in the engine revolution n, enhancement in fuel consumption, engine efficiency, and pump efficiency are achieved, noise is reduced, and engine stall is prevented, but the responsiveness of the engine 2 is not satisfactory. That is, even if the operation lever 41 etc. is moved from the neutral position to raise the engine 2 from low rotation in an attempt to start the excavating work, the load of the hydraulic pump 3 rapidly rises at the initial stage (transient state) of the start of lever movement, and thus the engine output does not have a margin respect to the power of the pump absorption horsepower, and the power to accelerate the engine 2 lacks. Thus, the engine 2 can only be raised up to the target revolution or can only be raised at an extremely slow pace.

In the present aspect, however, the current target discharge flow rate Qsum of the hydraulic pump 3 is calculated from the operation amount of the operation units 41 to 44 for operating each hydraulic actuator 31 to 36, and a first engine target revolution ncom1 adapted to the current pump target discharge flow rate Qsum is set. Switch from the non-operation state to the operation state of the operation units 41 to 44 is determined. In the second aspect, switch from the non-operation state to the operation state of the operation units 41 to 44 is determined when the operation amount of the operation units 41 to 44 is greater than a predetermined threshold value. In the third aspect, switch from the non-operation state to the operation state of the operation units 41 to 44 is determined when the current pump target discharge flow rate Qsum is greater than a predetermined flow rate (e.g., 10 (L/min)). When determined that the operation units 41 to 44 is switched from the non-operation state to the operation state, a revolution nM (e.g., 1400 rpm) greater than an engine low idle revolution nL is set as a second engine target revolution ncom2.

If the second engine target revolution com2 is equal to or greater than the first engine target revolution ncom1, the engine revolution is controlled to obtain the second engine target revolution ncom2.

Thus, when moving the operation lever 41 etc. from the neutral position in an attempt to start the excavating work, the engine revolution rises in advance and the engine torque rises before the load of the hydraulic pump 3 rapidly rises, and thus there is a margin in the power for accelerating the engine 2. The engine 2 then can be rapidly raised from the low rotation region to the target revolution, and the responsiveness of the engine 2 is enhanced.

In the fourth and the fifth aspect, the current pump target discharge flow rate Qsum and the like is obtained according to the operation amount of the operation units 41 to 44 for operating each hydraulic actuator 31 to 36, and the first engine target revolution ncom1 adapted to the pump target discharge flow rate Qsum is set.

The output limiting value Pplimit of the hydraulic pump 3 is set according to the work pattern of the plurality of hydraulic actuators 21 to 26, and a third engine target revolution ncom3 corresponding thereto is set.

The manner of setting the first target revolution in the present aspect is arbitrary. In the second aspect, the revolution of the engine 2 is set by the fuel dial, and the first target revolution ncom1 of the engine 2 is set according to the set value of the fuel dial.

If the third engine target revolution ncom3 is equal to or less than the first engine target revolution ncom1, the engine revolution is controlled to obtain the third engine target revolution ncom3, and the hydraulic pump 3 is controlled to obtain the pump absorption torque corresponding to the third engine target revolution ncom3. Thus, the pump absorption torque can be defined to a suitable value, and wasted energy consumption more than necessary can be suppressed.

FIG. 12 shows change over time in boom lever signal Lbo or operation amount of each operation lever 41, 42, arm lever signal Lar, bucket lever signal Lbk, and rotation lever signal Lsw, change over time in pump absorption torque Tp, and change over time in engine revolution n when the work is carried out in the order of work pattern (7), work pattern (5), work pattern (3), work pattern (11), work pattern (12), and work pattern (2) by way of example with the horizontal axis as time t.

According to the present aspect, when the work is carried out in a series of work patterns shown in FIG. 12, the pump absorption torque can be defined at a suitable value, and wasted energy consumption of more than necessary can be suppressed.

According to the sixth aspect, as shown in FIG. 16, a requested power generation amount Tgencom of the generator motor 11 is calculated according to the storage state of the electrical storage device 12 in a requested power generation amount calculating unit 120.

In an assistance necessity determining unit 90, determination is made on whether to engine-torque-assist-operate (determination result T) or not to engine-torque-assist-operate (determination result F) the generator motor 11.

If determined to engine-torque-assist-operate the generator motor 11 (determination result T) in the assistance necessity determining unit 90, a generator motor command value switching unit 187 is switched to the T side, that is, a modulation processing unit 97 side, thereby engine-torque-assist-operating the generator motor 11. If determined not to engine-torque-assist-operate the generator motor 11 (determination result F) in the assistance necessity determining unit 90, the generator motor command value switching unit 187 is switched to the F side, the revolution control of the generator motor 11 is turned OFF so as not to be engine-torque-assist-operated, and the generator motor command value switching unit 287 is switched to the F side, that is, the requested power generation amount calculating unit 120 side, so that the generator motor 11 is power-generation-operated to obtain the power generation amount corresponding to the requested power generation amount Tgencom calculated in the requested power generation amount calculating unit 120.

According to the sixth aspect, the generator motor 11 is engine-torque-assist-operated or power-generation-operated without being engine-torque-assist-operated according to the necessity of engine torque assist operation, and the storage amount of the electrical storage device 12 is stably maintained always at a target state, and the operability of the working machine and the upper rotation body can always be maintained at high level.

According to the seventh aspect, as shown in FIG. 16, the requested power generation amount Tgencom of the generator motor 11 is calculated according to the storage state of the electrical storage device 12 in the requested power generation amount calculating unit 120.

In the first pump target absorption torque calculating unit 66, the first maximum torque curve 66*a* showing the maximum absorption torque that can be absorbed by the hydraulic pump 3 is set according to the engine target revolution.

In the second pump target absorption calculating unit 85, the second maximum torque curve 85*a* in which the maximum absorption torque becomes greater in the engine low rotation region is set with respect to the first maximum torque curve 66*a*.

In the assistance necessity determining unit 90, determination is made on whether to engine-torque-assist-operate (determination result T) or not to engine-torque-assist-operate (determination result F) the generator motor 11.

If determined to engine-torque-assist-operate (determination result T) the generator motor 11 by the assistance necessity determining unit 90, the pump absorption torque command value switching unit 88 is switched to T side, that is, the second pump target absorption torque calculating unit 85 side, the second maximum torque curve 85*a* is selected as the maximum torque curve, and the capacity of the hydraulic pump 3 is controlled to obtain the pump absorption torque having the pump absorption torque on the second maximum torque curve 85*a* corresponding to the current engine target revolution as the upper limit. If determined not to engine-torque-assist-operate (determination result F) the generator motor 11 by the assistance necessity determining unit 95, the pump absorption torque command value switching unit 88 is switched to F side, that is, the first pump target absorption torque calculating unit 66 side, the first maximum torque curve 66*a* is selected as the maximum torque curve, and the capacity of the hydraulic pump 3 is controlled to obtain the pump absorption torque having the pump absorption torque on the first maximum torque curve 66*a* corresponding to the current engine target revolution as the upper limit.

If determined to engine-torque-assist-operate (determination result T) the generator motor 11 by the assistance necessity determining unit 90, the generator motor command value switching unit 187 is switched to the T side, that is, the modulation processing unit 97 side, and the generator motor 11 is engine-torque-assist-operated. If determined not to engine-torque-assist-operate (determination result F) the generator motor 11 by the assistance necessity determining unit 90, the generator motor command value switching unit 187 is switched to the F side and the revolution control of the generator motor 11 is turned OFF so as not to engine-torque-assist-operate, and the generator motor command value switching unit 287 is switched to the F side, that is, the requested power generation amount calculating unit 120 side, and the generation motor 11 is power-generation-operated to obtain the power generation amount corresponding to the requested power generation amount Tgencom calculated in the requested power generation amount calculating unit 120. Thus, in the second aspect, similar to the first aspect, the generator motor 11 is engine-torque-assist-operated or power-generation-operated according to the requested power generation amount without being engine-torque-assist-operated according to the necessity of the engine torque assist operation, and thus, the storage amount of the electrical storage device 12 is always stably maintained at the target state, and the operability of the working machine and the upper rotation body is always maintained at high level.

Furthermore, in the seventh aspect, the capacity of the hydraulic pump 3 is controlled to obtain the pump absorption torque having the pump absorption torque on the second maximum torque curve 85*a* in which the maximum absorption torque becomes large in the engine low rotation region as the upper limit with respect to the first maximum torque curve 66*a* while engine-torque-assist-operating the generator motor 11, and thus the absorption torque of the hydraulic pump 3 at the initial stage of rise in engine rotation becomes greater. The start of movement of the working machine becomes faster with respect to the movement of the operation lever, thereby suppressing lowering in work efficiency and alleviating the uncomfortable feeling in operation on the operator. If attempting to perform the control according to the second maximum torque curve L2 without engine-torque-assist-operating the generator motor 11, overload might be applied on the engine 2. Thus, if the capacity of the hydraulic pump 3 is controlled according to the second maximum torque curve 85*a* without the engine torque assist operation, the hydraulic pump 3 absorbs the torque equal to or greater than the output of the engine alone, whereby the engine revolution cannot be increased and furthermore, the engine revolution lowers by high load and in the worst case, engine stall might occur. Thus, in the second control example, the control according to the second maximum torque curve 85*a* is guaranteed on the premise of engine-torque-assist-operating the generator motor 11.

In the eighth aspect, as shown in FIG. 17, determination on whether or not to perform the engine torque assist operation is made by setting a threshold value with respect to the deviation Δgenspd, and thus the control is stabilized. That is, when the threshold value is not provided with respect to deviation and the engine torque assist operation is immediately performed when deviation is found, the engine torque assist operation is continuously performed at the engine revolution close to the engine target revolution, which leads to energy loss. This is because the source of the energy for engine torque assist operation is originally the energy of the engine 2, and the energy loss always increases by the efficiency of the generator motor 11 when performing the engine torque assist operation. Generally, the efficiency lowers when the generator motor 11 is driven at small torque and power-generated.

According to the ninth aspect, as shown in FIG. 17, determination is made not to engine-torque-assist-operate the generator motor 11 and the assist flag is set to F when the voltage value BATTvolt, that is, the storage amount of the electrical storage device 12 is equal to or smaller than a predetermined threshold value BC1. Thus, over discharge of the electrical storage device 12 is avoided and lowering in lifetime of the electrical storage device 12 can be avoided by not performing the engine torque assist operation when the storage amount of the electrical storage device 12 is low. In particular, in the case of the electrical rotation system, the stored energy for rotating the upper rotation body is necessary, where the rotation performance is adversely affected if the storage amount is excessively reduced. The degradation of the rotation performance due to reduction in storage amount is avoided by not performing the engine torque assistance operation when the storage amount of the electrical storage device 12 is low.

As shown in FIG. 17, according to the tenth aspect, when the current output SWGpow of the rotation motor 103 is equal to or greater than the predetermined threshold value SC1, determination is made not to engine-torque-assist-operate the generator motor 11 and the engine torque assist operation is prohibited, the requested power generation amount Tgencom of the generator motor 11 is calculated in view of not only the storage state (voltage value BATTvolt) of the electrical storage device 12 but also the driving state (rotation load current SWGcurr) of the rotation motor 6, power generation corresponding to such requested power generation amount Tgencom is performed in the generator motor 11, and the generated power is supplied to the rotation motor 103. The upper rotation body thus can be turn-operated without lowering the rotation performance.

According to the eleventh aspect, when the revolution deviation Δgenspd has a positive sign and becomes equal to or greater than a certain extent, the generator motor speed command value (generator motor target revolution) Ngencom is output from the modulation processing unit 97 to the generator motor controller 100, and the generator motor controller 100 revolution-controls the generator motor 11 so that the generator motor target revolution Ngencom is obtained in response thereto and motor-operates the generator motor 11. That is, when the current engine revolution is smaller than the engine target revolution, the generator motor 11 is motor-operated, the axial torque of the engine 2 is added on the torque curve diagram of the engine 2 to raise the engine revolution, and the output torque of the generator motor 11 is controlled so that the revolution same as the engine target revolution is obtained.

When the revolution deviation Δgenspd has a negative sign and becomes equal to or greater than a certain extent, the generator motor speed command value (generator motor target revolution) Ngencom is output from the modulation processing unit 97 to the generator motor controller 100, and the generator motor controller 100 revolution-controls the generator motor 11 so that the generator motor target revolution Ngencom is obtained in response thereto, and power-generation-operates the generator motor 11. That is, when the current engine revolution is greater than the engine target revolution, the generator motor 11 is power-generation-operated, the axial torque of the engine 2 is absorbed on the torque curve diagram of the engine, the engine revolution is lowered and the output torque of the generator motor 11 is controlled so that the revolution same as the engine target revolution is obtained.

According to the twelfth aspect, as shown in FIG. 18, the upper limit value (torque limit) GENtrqlimit of the torque to be output by the generator motor 11 is gradually made to a small value according to decrease in the storage amount (voltage value BATTvolt) of the electrical storage device 12 before switching from the engine torque assist operation state to the power generating operation state corresponding to the requested power generation amount, so that the change in power generation torque of the generator motor 11 in switching from the engine torque assist operation state to the power generating operation state corresponding to the requested power generation amount becomes smooth, and lowering in engine revolution in time of switching is avoided.

According to the thirteenth aspect, as shown in FIG. 18, the torque upper limit value (generator motor torque limit) GENtrqlimit of the generator motor 11 is obtained and output as a value that gradually decreases with decrease in the voltage value BATTvolt of the electrical storage device 12 from the first predetermined value BD1 to the second predetermined value BD2 smaller than the first predetermined value BD1, and the torque upper limit value (generator motor torque limit) GENtrqlimit of the generator motor 11 is obtained and output as a value that gradually increases with increase in the voltage value BATTvolt of the electrical storage device 12 from the third predetermined value BD3 to the fourth predetermined value BD4 greater than the third predetermined value BD3 when increasing the once decreased torque upper limit value GENtrqlimit. The control is stably performed by providing hysteresis to the manner of changing the generator motor torque limit GENtrqlimit.

According to the fourteenth aspect, as shown in FIG. 18, the upper limit value (torque limit) GENtrqlimit of the torque to be output by the generator motor 11 is gradually made to a small value according to increase in the current output SWGpow of the rotation motor 103 before switching from the engine torque assist operation state to the power generating operation state corresponding to the requested power generation amount, so that the change in power generation torque of the generator motor 11 in switching from the engine torque assist operation state to the power generating operation state corresponding to the requested power generation amount becomes smooth. The lowering in engine revolution in time of switching is thereby avoided.

According to the fifteenth aspect, as shown in FIG. 18, the torque upper limit value (generator motor torque limit) GENtrqlimit of the generator motor 11 is obtained and output as a value that gradually decreases with increase in the current output SWGpow of the rotation motor 103 from the first predetermined value SD1 to the second predetermined value SD2 greater than the first predetermined value SD1, and the torque upper limit value (generator motor torque limit) GENtrqlimit of the generator motor 11 is obtained and output as a value that gradually increases with decrease in the current output SWGpow of the rotation motor 103 from the third predetermined value SD3 to the fourth predetermined value SD4 smaller than the third predetermined value SD3 when increasing the once decreased torque upper limit value GENtrqlimit. The control is stably performed by providing hysteresis to the manner of changing the generator motor torque limit GENtrqlimit.

According to the sixteenth aspect, as shown in FIG. 19, immediately after switching from the engine torque assist operation state to the power generating operation state corresponding to the requested power generation amount, a control to gradually change the power generation torque of the generator motor 11 from the torque at the termination of assistance to the power generation torque corresponding to the requested power generation amount of the generator motor 11 is performed, and thus change in power generation torque of the generator motor 11 in switching from the engine torque assist operation to the power generating operation state corresponding to the requested power generation amount becomes smooth. The lowering in engine revolution in time of switching is thereby avoided.

According to the seventeenth aspect, as shown in FIG. 16, the third maximum torque curve L3 in which the maximum absorption torque (third pump maximum absorption torque) Tpcommax) of the hydraulic pump 3 gradually decreases with decease in the torque upper limit value Tgencom2 of the generator motor 11 is set in the third pump maximum absorption torque calculating unit 106. According to the twelfth aspect, the capacity of the hydraulic pump 3 is controlled so that the maximum absorption torque of the hydraulic pump 3 gradually decreases according to decrease in the torque upper limit value of the generator motor 11, and thus the absorption torque of the hydraulic pump 3 lowers with lowering in the assist force of the engine 2 when switching from the engine torque assist operation state to the power generating operation state corresponding to the requested power generation amount, the change in axial torque of the engine 2 becomes smooth, and the degradation in the engine revolution acceleration involved in lowering of the assist force of the engine 2 is avoided.

According to the eighteenth aspect, as shown in FIG. 16, switch is not made directly from the pump maximum absorption torque (third pump maximum absorption torque Tpcommax) on the maximum torque curve (e.g., third target torque curve L3) before switching to the pump maximum absorption torque (first pump maximum absorption torque Tpcom1) on the maximum torque curve (first maximum torque curve L1) after switching, and is gradually and smoothly changed over time t from the pump maximum absorption torque (third pump maximum absorption torque Tpcommax) on the maximum torque curve (e.g., third target torque curve L3) before switching to the pump maximum absorption torque (first pump maximum absorption torque Tpcom1) on the maximum torque curve (first maximum torque curve L1) after switching. Thus, sudden change in load on the output shaft of the engine 2 due to sudden change in pump absorption torque in time of switching between the engine torque assist operation state and the power generating operation state corresponding to the requested power generation amount is avoided, and lowering in engine revolution can be avoided.

In the nineteenth aspect, with respect to the eighteenth aspect, the time constant $\tau$ at the time of changing from the pump maximum absorption torque before switching to the pump maximum absorption torque after switching is desirably set to a large value in a case where the pump maximum absorption torque before switching is greater than the pump maximum absorption torque after switching than a case where the pump maximum absorption torque before switching is smaller than that in the pump maximum absorption torque after switching. This is because if the time constant τ is set to a large value uniformly, the movement of the working machine becomes slow when the pump maximum absorption torque is switched from small to large since the time constant in change in the pump maximum absorption torque is large.

EXPLANATION OF LETTERS OR NUMERALS

Figure 1:
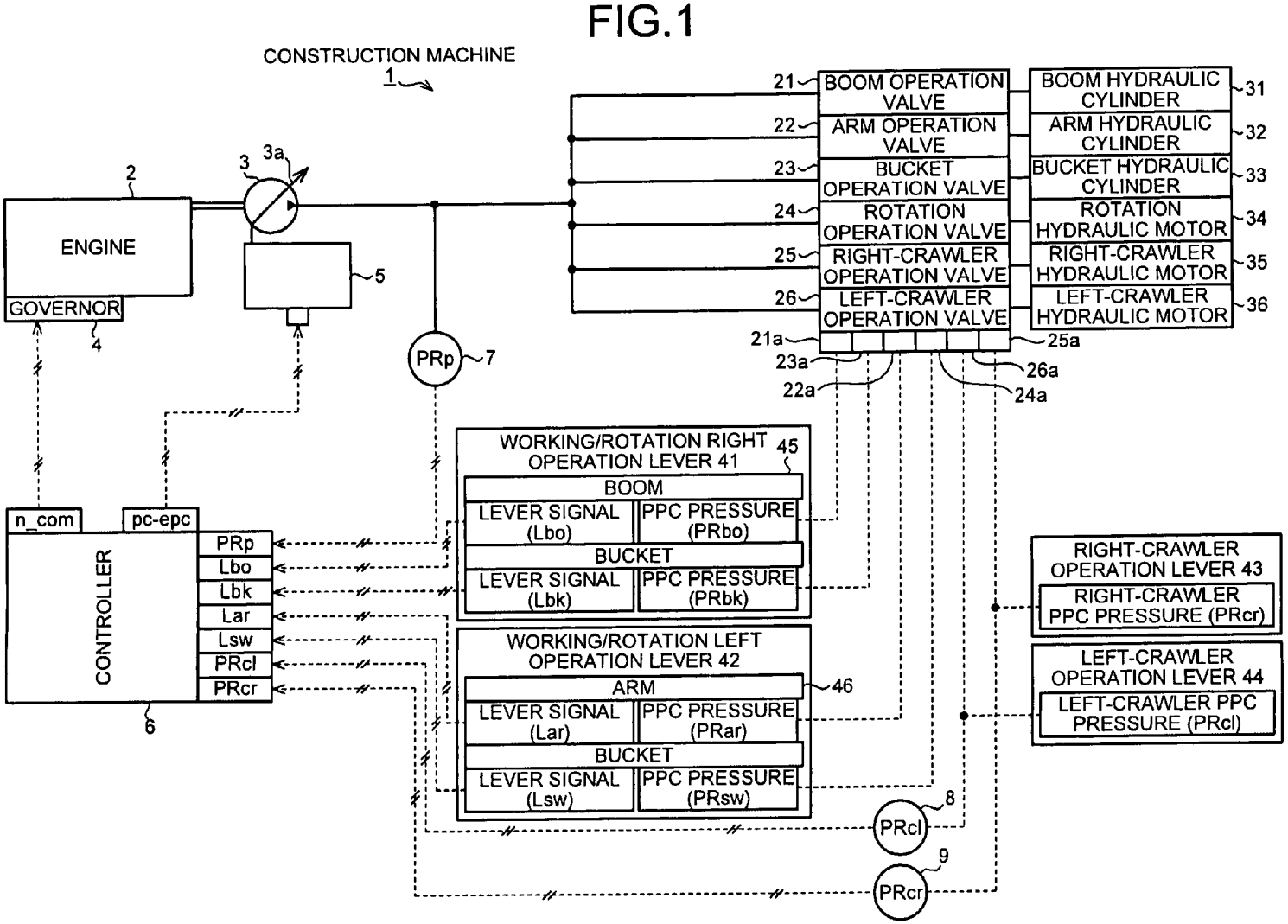
FIG. 1 is a configuration view for performing a first example.

2 engine
3 hydraulic pump
5 pump control valve
6 controller
11 generator motor
31, 32, 33, 34, 35, 36 hydraulic actuator
41, 42, 43, 44 operation lever
103 rotation motor

BEST MODE FOR CARRYING OUT THE INVENTION

The embodiments of the present invention will be described below with reference to the drawings.

In the present embodiment, a case of controlling a diesel engine and a hydraulic pump mounted on a construction machine such as hydraulic shovel is considered.

Figure 3:
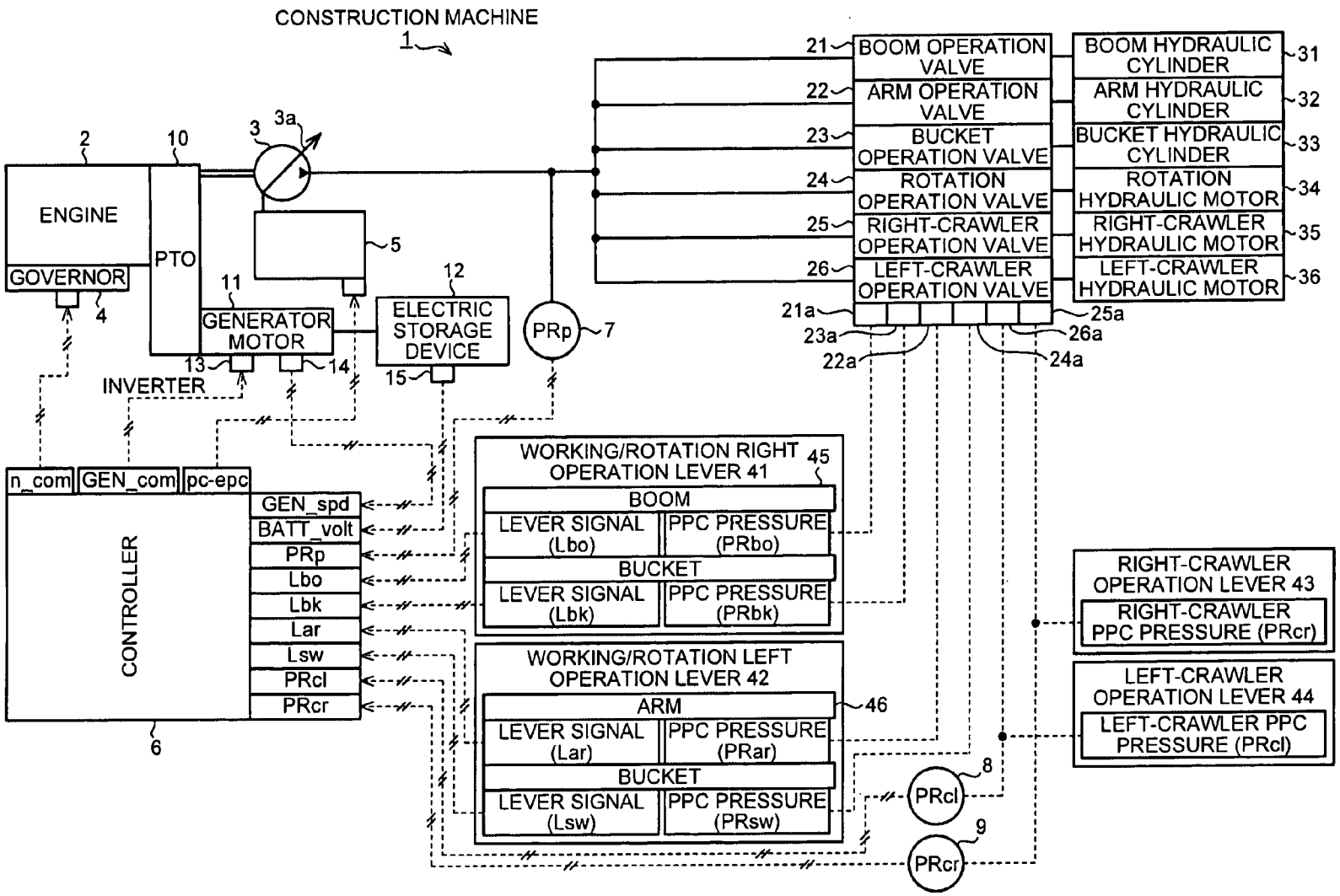
FIG. 3 is a configuration view for performing a second example.

FIG. 3 shows an overall configuration of a construction machine 1 of the embodiment. The construction machine 1 is a hydraulic shovel.

The construction machine 1 includes an upper rotation body and a lower crawler carrier, where the lower crawler carrier includes left and right crawler tracks. A working machine including a boom, an arm, and a bucket is attached to the vehicle body. The boom is operated by driving a boom hydraulic cylinder 31 (hereinafter, sometimes referred to as "a boom hydraulic actuator 31"), the arm is operated by driving an arm hydraulic cylinder 32 (hereinafter, sometimes referred to as "a arm hydraulic actuator 32"), and a bucket is operated by driving a bucket hydraulic cylinder 33 (hereinafter, sometimes referred to as "a bucket hydraulic actuator 33"). The left crawler track and the right crawler track rotate by driving a left-crawler hydraulic motor 36 and a right-crawler hydraulic motor 35, respectively.

A swing machine is driven by driving a rotation hydraulic motor 34, and the upper rotation body turns through a swing pinion, a swing circle, and the like.

The engine 2 is a diesel engine, the output of which (horsepower: kw) is controlled by adjusting the fuel amount to be injected to the cylinder. This adjustment is carried out by controlling a governor 4 arranged next to a fuel injection pump of the engine 2.

The controller 6 outputs a revolution command value to the governor 4 as hereinafter described to have the engine revolution at a target revolution ncom, and the governor 4 increases or decreases the fuel injection amount so that the target revolution ncom is obtained on the target torque curve L1.

An output shaft of the engine 2 is coupled to a drive shaft of a generator motor 11 by way of a PTO shaft 10. The generator motor 11 performs a power generating operation and an electrical motor operation. That is, the generator motor 11 operates as a motor and also operates as a power generator. The generator motor 11 also has a function as a starter for starting the engine 2. When the starter switch is turned ON, the generator motor 11 performs the electrical motor operation, rotates the output shaft of the engine 2 at low rotation (e.g., 400 to 500 rpm), and starts the engine 2.

The generator motor 11 is torque-controlled by an inverter 13. The inverter 13 controls the torque of the generator motor 11 according to a generator motor command value GENcom output from a controller 6, as hereinafter described.

The inverter 13 is electrically connected to an electrical storage device 12 by way of DC power supply lines. The controller 6 is powered by the electrical storage device 12 as a power supply.

The electrical storage device 12 is configured by a capacitor, an battery, and the like, and accumulates (charges) the power generated when the generator motor 11 performs the power generating operation. The electrical storage device 12 supplies the power accumulated in the electrical storage device 12 to the inverter 13. In the present specification, capacitor for accumulating power as static electricity, and accumulators including lead battery, nickel hydride battery, lithium battery, and the like are collectively referred to as "electrical storage device".

A drive shaft of the hydraulic pump 3 is coupled to the output shaft of the engine 2 by way of the PTO shaft 10, and the hydraulic pump 3 is driven when the output shaft of the engine rotates. The hydraulic pump 3 is a variable displacement hydraulic pump, where the capacity q (cc/rev) changes when a tilt angle of a swash plate 3*a* changes.

The pressurized fluid discharged from the hydraulic pump 3 at discharge pressure PRp, and flow rate Q (cc/min) is supplied to a boom operation valve 21, an arm operation valve 22, a bucket operation valve 23, a rotation operation valve 24, a right-crawler operation valve 25, and a left-crawler operation valve 26. The pump discharge pressure PRp is detected with a hydraulic sensor 7, and the hydraulic detection signal is input to the controller 6.

The pressurized fluid output from the boom operation valve 21, the arm operation valve 22, the bucket operation valve 23, the rotation operation valve 24, the right-crawler operation valve 25, and the left-crawler operation valve 26 are respectively supplied to the boom hydraulic cylinder 31, the arm hydraulic cylinder 32, the bucket hydraulic cylinder 33, the rotation hydraulic motor 34, the right-crawler hydraulic motor 35, and the left-crawler hydraulic motor 36. The boom hydraulic cylinder 31, the arm hydraulic cylinder 32, the bucket hydraulic cylinder 33, the rotation hydraulic motor 34, the right-crawler hydraulic motor 35, and the left-crawler hydraulic motor 36 are then driven to operate the boom, the arm, the bucket, the upper rotation body, and the left crawler track and the right crawler track of the lower crawler carrier.

A working/rotation right operation lever 41 and a working/rotation left operation lever 42 as well as a right-crawler operation lever 43 and a left-crawler operation lever 44 are arranged on the right side and the left side at the front side of a driver's seat of the construction machine 1.

The working/rotation right operation lever 41 is an operation lever for operating the boom and the bucket, and operates the boom and the bucket according to the operation direction and also operates the boom and the bucket at a speed corresponding to the operation amount.

A sensor 45 for detecting the operation direction and the operation amount is arranged in the operation lever 41. The sensor 45 inputs a lever signal indicating the operation direction and the operation amount of the operation lever 41 to the controller 6. When the operation lever 41 is operated in a direction of operating the boom, a boom lever signal Lb0 indicating a boom raising operation amount and a boom lowering operation amount is input to the controller 6 according to the tilt direction and the tilt amount with respect to a neutral position of the operation lever 41. When the operation lever 41 is operated in a direction of operating the bucket, a bucket lever signal Lbk indicating a bucket excavating operation amount and a bucket dumping operation amount is input to the controller 6 according to the tilt direction and the tilt amount with respect to the neutral position of the operation lever 41.

When the operation lever 41 is operated in a direction of operating the boom, a pilot pressure (PPC pressure) PRbo corresponding to the tilt amount of the operation lever 41 is added to a pilot port 21*a* corresponding to the lever tilt direction (boom raising direction, boom lowering direction) of each pilot port of the boom operation valve 21.

Similarly, when the operation lever 41 is operated in a direction of operating the bucket, a pilot pressure (PPC pressure) PRbk corresponding to the tilt amount of the operation lever 41 is added to a pilot port 23*a* corresponding to the lever tilt direction (bucket excavating direction, bucket dumping direction) of each pilot port of the bucket operation valve 23.

The working/rotation left operation lever 42 is an operation lever for operating the arm and the upper rotation body, and operates the arm and the upper rotation body according to the operation direction and also operates the arm and the upper rotation body at a speed corresponding to the operation amount.

A sensor 45 for detecting the operation direction and the operation amount is arranged in the operation lever 42. The sensor 46 inputs a lever signal indicating the operation direction and the operation amount of the operation lever 42 to the controller 6. When the operation lever 42 is operated in a direction of operating the arm, an arm lever signal Lar indicating an arm excavating operation amount and an arm dumping operation amount is input to the controller 6 according to the tilt direction and the tilt amount with respect to a neutral position of the operation lever 42. When the operation lever 42 is operated in a direction of operating the upper rotation body, a rotation lever signal Lsw indicating a right rotation operation amount and a left rotation operation amount is input to the controller 6 according to the tilt direction and the tilt amount with respect to the neutral position of the operation lever 42.

When the operation lever 42 is operated in a direction of operating the arm, a pilot pressure (PPC pressure) PRar corresponding to the tilt amount of the operation lever 42 is added to a pilot port 22*a* corresponding to the lever tilt direction (arm excavating direction, arm dumping direction) of each pilot port of the arm operation valve 22.

Similarly, when the operation lever 42 is operated in a direction of operating the upper rotation body, a pilot pressure (PPC pressure) PRsw corresponding to the tilt amount of the operation lever 42 is added to a pilot port 24*a* corresponding to the lever tilt direction (right rotation direction, left rotation direction) of each pilot port of the rotation operation valve 24.

The right-crawler operation lever 43 and the left-crawler operation lever 44 are operation levers for operating the right crawler track and the left crawler track, respectively, and operate the crawler track according to the operation direction, and also operate the crawler track at a speed corresponding to the operation amount.

A pilot pressure (PPC pressure) PRcr corresponding to the tilt amount of the operation lever 43 is added to a pilot port 25*a* of the right-crawler operation valve 25.

The pilot pressure PRcr is detected with a hydraulic sensor 9, and the right-crawler pilot pressure PRcr indicating the right-crawler amount is input to the controller 6.

Similarly, a pilot pressure (PPC pressure) PRcl corresponding to the tilt amount of the operation lever 44 is added to a pilot port 26*a* of the left-crawler operation valve 26.

The pilot pressure PRc is detected with a hydraulic sensor 8, and the left-crawler pilot pressure PRcl indicating the left-crawler amount is input to the controller 6.

Each operation valve 21 to 26 is a flow rate direction control valve that moves the spool in a direction corresponding to the operation direction of the corresponding operation lever 41 to 44, and moves the spool so that the fluid path opens only by an opening area corresponding to the operation amount of the operation lever 41 to 44.

A pump control valve 5 operates by a control current pc-epc output from the controller 6, and the pump control valve 5 is changed through a servo piston.

The pump control valve 5 controls the tilt angle of the swash plate 3*a* of the hydraulic pump 3 so that the product of the discharge pressure PRrp (kg/cm2) of the hydraulic pump 3 and the capacity q (cc/rev) of the hydraulic pump 3 does not exceed the pump absorption torque Tpcom corresponding to the control current pc-epc. This control is called PC control.

A rotation sensor 14 for detecting the current actual revolution GENspd (rpm) of the generator motor 11, which is the actual revolution of the engine 2, is arranged next to the generator motor 11. A signal indicating the actual revolution GENspd detected with the rotation sensor 14 is input to the controller 6.

A voltage sensor 15 for detecting a voltage BATTvolt of the electrical storage device 12 is arranged in the electrical storage device 12. A signal indicating the voltage BATTvolt detected with the voltage sensor 15 is input to the controller 6.

The controller 6 outputs a revolution command value to the governor 4, increases/decreases the fuel injection amount so as to obtain a target revolution corresponding to the load of the current hydraulic pump 3, and adjusts the revolution n and the torque T of the engine 2.

The controller 6 outputs a generator motor command value GENcom to the inverter 13 to cause the generator motor 11 to perform the power generating operation or the electrical motor operation. When a command value GENcom for operating the generator motor 11 as a power generator is output from the controller 6 to the inverter 13, a part of the output torque generated in the engine 2 is transmitted to the drive shaft of the generator motor 11 through the engine output shaft, thereby absorbing the torque of the engine 2 and performing power generation. The AC power generated in the generator motor 11 is converted to DC power in the inverter 13, and the power is accumulated (charged) in the electrical storage device 12 through the DC power supply line.

When the command value GENcom for operating the generator motor 11 as a motor is output from the controller 6 to the inverter 13, the inverter 13 performs a control such that the generator motor 11 operates as the motor. That is, the power is output (discharged) from the electrical storage device 12, the DC power accumulated in the electrical storage device 12 is converted to AC power in the inverter 13 and supplied to the generator motor 11, thereby rotation-operating the drive shaft of the generator motor 11. The torque is thereby generated at the generator motor 11, which torque is transmitted to the engine output shaft through the drive shaft of the generator motor 11, and added to the output torque of the engine 2 (assist output of engine 2). The added output torque is absorbed by the hydraulic pump 3.

The power generation amount (absorption torque amount), and electrical control amount (assist amount, generated torque amount) of the generator motor 11 change according to the content of the generator motor command value GENcom.

FIG. 1 shows another configuration example of the construction machine 1.

As apparent from comparing FIG. 1 and FIG. 3, in the configuration example shown in FIG. 1, the PTO shaft 10, the generator motor 11, the electrical storage device 12, the inverter 13, the rotation sensor 14, and the voltage sensor 15 in FIG. 3 are omitted, and electrical motor operation and power generating operation by the generator motor 11 are not carried out.

The control content executed in the controller 6 will be described below.

First Example

First, the first example will be described.

Figure 4:
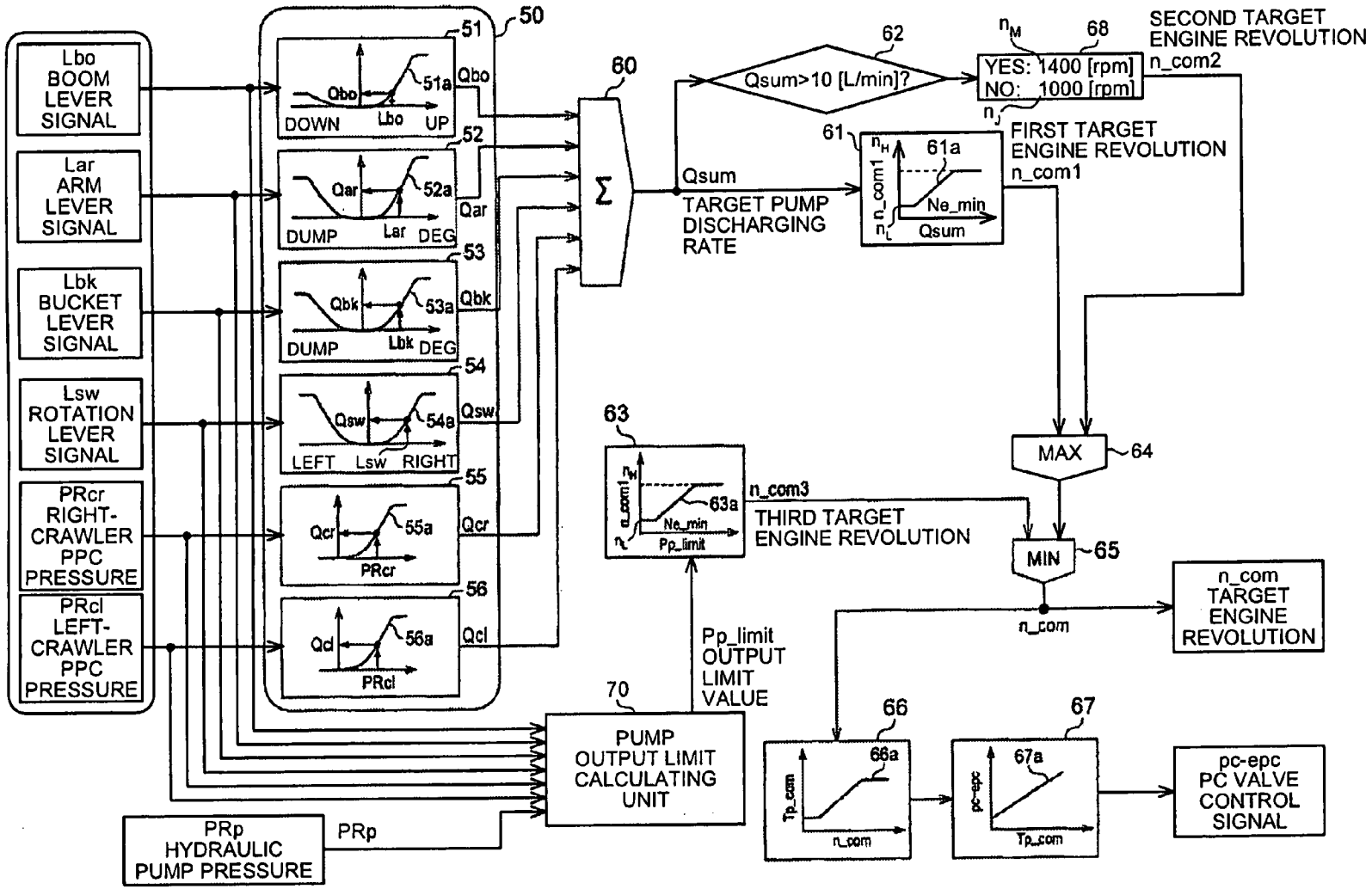
FIG. 4 is a control block diagram of the first example.
Figure 6:
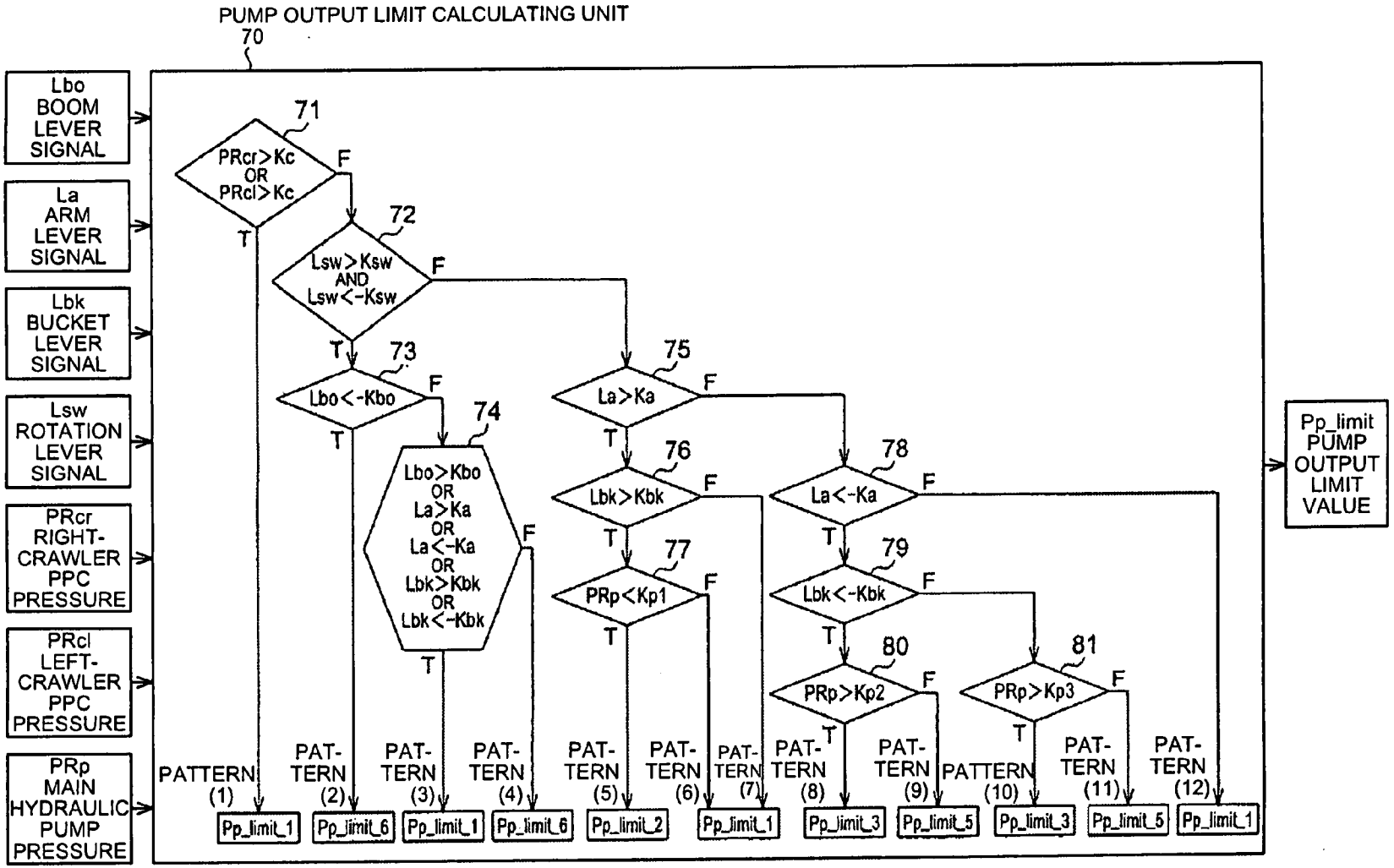
FIG. 6 is a control block diagram common to the first example and the second example.

The first example is based on the configuration example shown in FIG. 1. FIG. 4 and FIG. 6 are control block diagrams showing a processing content performed in the controller 6.

As shown in FIG. 4, the target flow rate Qbo of the corresponding boom hydraulic cylinder 31, the target flow rate Qar of the arm hydraulic cylinder 32, the target flow rate Qbk of the bucket hydraulic cylinder 33, the target flow rate Qsw of the rotation hydraulic motor 34, the target flow rate Qcr of the right-crawler motor 35, and the target flow rate Qcl for every left-crawler motor 36 are respectively calculated in the hydraulic actuator target flow rate calculating unit 50 based on the boom lever signal Lbo, the arm lever signal Lar, the bucket lever signal Lbk, the rotation lever signal Lsw, the right-crawler pilot pressure PRcr, and the left-crawler pilot pressure PRcl.

The functional relations 51*a*, 52*a*, 53*a*, 54*a*, 55*a*, and 56*a* of the operation amount and the target flow rate are stored in a data table format in a storage device for each hydraulic actuator.

In the boom target flow rate calculating unit 51, the boom target flow rate Qbo corresponding to the operation amount in the current boom raising direction or the operation amount Lbo in the boom lowering direction is calculated according to the functional relation 51*a*.

In the arm target flow rate calculating unit 52, the arm target flow rate Qar corresponding to the operation amount in the current arm excavating direction or the operation amount Lar in the arm dumping direction is calculated according to the functional relation 52*a*.

In the bucket target flow rate calculating unit 53, the bucket target flow rate Qbk corresponding to the operation amount in the current bucket excavating direction or the operation amount Lbk in the bucket dumping direction is calculated according to the functional relation 53*a*.

In the rotation target flow rate calculating unit 54, the rotation target flow rate Qsw corresponding to the operation amount in the current right rotation direction and the operation amount Lsw in the left rotation direction is calculated according to the functional relation 54*a*.

In the right-crawler target flow rate calculating unit 55, the right-crawler target flow rate Qcr corresponding to the current right-crawler pilot pressure PRcr is calculated according to the functional relation 55*a*.

In the left-crawler target flow rate calculating unit 56, the left-crawler target flow rate Qcl corresponding to the current left-crawler pilot pressure PRcl is calculated according to the functional relation 56*a*.

In calculation process, the boom raising operation amount, the arm excavating operation amount, the bucket excavating operation amount, and the right rotation operation amount are handled as operation amount with positive sign, and the boom lowering operation amount, the arm dumping operation amount, the bucket dumping operation amount, and the left rotation operation amount are handled as operation amount with negative sign.

In a pump target discharge flow rate calculating unit 60, a process of obtaining the total sum of each hydraulic actuator target flow rate Qbo, Qar, Qbk, Qsw, Qcr, and Qcl calculated in the hydraulic actuator target flow rate calculating unit 50 as a pump target discharge flow rate Qsum in the following manner is executed.

$$Q\text{sum}=Qbo+Qar+Qbk+Qsw+Qcr+Qcl \quad (2)$$

Here, the total sum of the target flow rate of each hydraulic actuator is the pump target discharge flow rate, but the maximum target flow rate of each hydraulic actuator target flow rate Qbo, Qar, Qbk, Qsw, Qcr, and Qcl may be the target discharge flow rate of the hydraulic pump 3.

In the first engine target revolution calculating unit 61, a first engine target revolution ncom1 corresponding to the pump target discharge flow rate Qsum is calculated.

A functional relation 61*a* in which first engine target revolution ncom1 increases according to increase in the pump target discharge flow rate Qsum is stored in the storage device in the data table format. The first engine target revolution 61*a* is provided as a minimum engine revolution at which the pump target discharge flow rate Qsum can be discharged when the hydraulic pump 3 is operated at a maximum capacity qmax with a conversion constant of α, as described below.

$$ncom1 = Qsum/qmax \cdot \alpha \quad (3)$$

In the first engine revolution calculating unit 61, the first engine target revolution ncom1 corresponding to the current pump target discharge flow rate Qsum is calculated according to the functional relation 61*a*, that is, equation (3).

The determining unit 62 determines whether or not the current pump target discharge flow rate Qsum is greater than a predetermined flow rate (e.g., 10 (L/min)). The predetermined flow rate serving as a threshold value is set to the flow rate for determining whether each operation lever 41 to 44 is operated from the neutral position.

In a second engine target revolution setting unit 68, the second engine target revolution ncom2 is set to the revolution nJ (e.g., 1000 rpm) around the low idle revolution nL of the engine 2 if the current pump target discharge flow rate Qsum is equal to or smaller than a predetermined flow rate (e.g., 10 (L/min)) as a result of determination of the determining unit 62, that is, if the determination result is NO. If the current pump target discharge flow rate Qsum is greater than the predetermined flow rate (e.g., 10 (L/min)), that is, if the determination result is YES, the second engine target revolution ncom2 is set to the revolution nM (e.g., 1400 rpm) greater than the low idle revolution nL of the engine 2.

In a maximum value selecting unit 64, the higher engine target revolution ncom12 of the first engine target revolution ncom1 or the second engine target revolution ncom2 is selected.

The pump output limit calculating unit 70 shown in FIG. 4 is specifically shown in FIG. 6. In the following description, the determination result TRUE is abbreviated as T and the determination result FALSE is abbreviated as F.

The work pattern of a plurality of hydraulic actuators 21 to 26 is determined as the operation pattern (1) of "traveling operation", and the output limit value Pplimit of the hydraulic pump 3 is set to Pplimit 1 so as to adapt to the work pattern "traveling operation".

In the pump output limit calculating unit 70, the output (horsepower) limit value Pplimit of the hydraulic pump 3 is calculated according to the work pattern of the plurality of hydraulic actuators 21 to 26.

Figure 11:
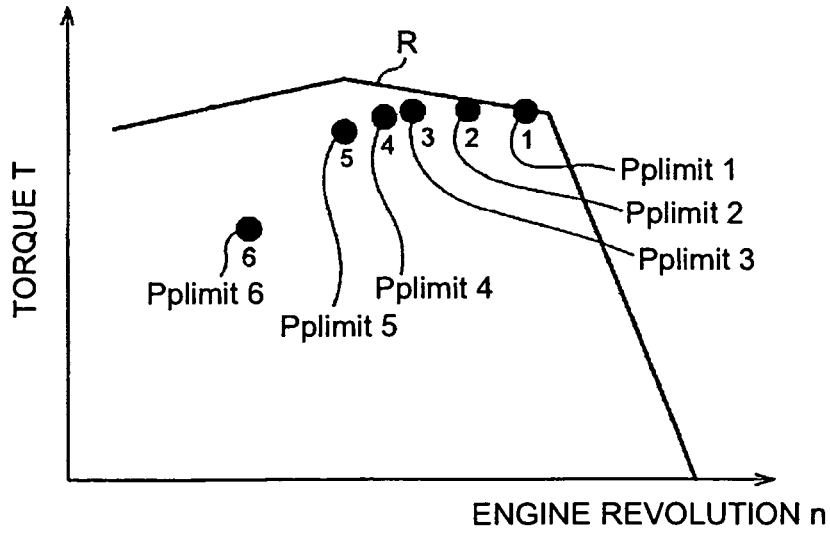
FIG. 11 is a view describing a pump output limit value corresponding to each work pattern.

Pplimit1, Pplimi3, Pplimit4, Pplimit5, and Pplimit6 are calculated in advance as output limit values of the hydraulic pump 3. The magnitude of the output limit value of the hydraulic pump 3 is set so as to become sequentially small in the order of Pplimit1, Pplimit2, Pplimit3, Pplimit4, Pplimit5, and Pplimit6 as shown on the torque curve diagram of FIG. 11.

In other words, when the right-crawler pilot pressure Prcr is greater than the predetermined pressure Kc or the left-crawler pilot pressure Prcl is greater than the predetermined pressure Kc (determination T of step 71), the work pattern of the plurality of hydraulic actuators 21 to 26 is determined as a work pattern (1) of "traveling operation", and the output limit value Pplimit of the hydraulic pump 3 is set to Pplimit1 so as to adapt to the work pattern of "traveling operation".

Similarly, the following determination is made in each step 72 to 79.

In step 72, determination is made whether the right rotation operation amount Lsw is greater than a predetermined operation amount Ksw and the left rotation operation amount Lsw is smaller than a predetermined operation amount −Ksw.

In step 73, determination is made on whether or not the boom lowering operation amount Lbo is smaller than a predetermined operation amount −Kbo.

In step 74, determination is made on whether or not the boom raising operation amount Lbo is greater than the predetermined operation amount Kbo; whether or not the arm excavating operation amount La is greater than a predetermined operation amount Ka; whether or not the arm dumping operation amount La is smaller than the predetermined operation amount −Ka; whether or not the bucket excavating operation amount Lbk is greater than a predetermined operation amount Kbk; or whether or not the bucket dumping operation amount Lbk is smaller than the predetermined operation amount −Kbk.

In step 75, determination is made on whether or not the arm excavating operation amount La is greater than the predetermined operation amount Ka.

In step 76, determination is made on whether or not the bucket excavating operation amount Lbk is greater than the predetermined operation amount Kbk.

In step 77, determination is made on whether or not the discharge pressure PRp of the hydraulic pump 3 is smaller than the predetermined pressure Kp1.

In step 78, determination is made on whether or not the arm dumping operation amount La is smaller than the predetermined operation amount −Ka.

In step 79, determination is made on whether or not the bucket dumping operation amount Lbk is smaller than the predetermined operation amount −Kbk.

In step 80, determination is made on whether or not the discharge pressure PRp of the hydraulic pump 3 is greater than the predetermined pressure Kp2.

In step 81, determination is made on whether or not the discharge pressure PRp of the hydraulic pump 3 is greater than the predetermined pressure Kp3.

If the determination of step 71 is F, the determination of step 72 is T, and the determination of step 73 is T, the work pattern of the plurality of hydraulic actuators 21 to 26 is determined to be a work pattern (2) of "rotation operation and boom lowering operation", and the output limit value Pplimit of the hydraulic pump 3 is set to Pplimit6 so as to adapt to the relevant work pattern.

If the determination of step 71 is F, the determination of step 72 is T, the determination of step 73 is F, and the determination of step 74 is T, the work pattern of the plurality of hydraulic actuators 21 to 26 is determined to be a work pattern (3) of "working machine operation other than rotation operation and boom lowering operation", and the output limit value Pplimit of the hydraulic pump 3 is set to Pplimit1 so as to adapt to the relevant work pattern.

If the determination of step 71 is F, the determination of step 72 is T, the determination of step 73 is F, and the determination of step 74 is F, the work pattern of the plurality of hydraulic actuators 21 to 26 is determined to be a work pattern (4) of "single operation of rotation operation", and the output limit value Pplimit of the hydraulic pump 3 is set to Pplimit6 so as to adapt to the relevant work pattern.

If the determination of step 71 is F, the determination of step 72 is F, the determination of step 75 is T, the determination of step 76 is T, and the determination of step 77 is T, the work pattern of the plurality of hydraulic actuators 21 to 26 is determined to be a work pattern (5) of "when load is small in arm excavating operation and bucket excavating operation (e.g., work of carrying earth and sand)", and the output limit value Pplimit of the hydraulic pump 3 is set to Pplimit2 so as to adapt to the relevant work pattern.

If the determination of step 71 is F, the determination of step 72 is F, the determination of step 75 is T, the determination of step 76 is T, and the determination of step 77 is F, the work pattern of the plurality of hydraulic actuators 21 to 26 is determined to be a work pattern (6) of "when load is large in arm excavating operation and bucket excavating operation (e.g., excavating work by simultaneous operation of the arm and the bucket)", and the output limit value Pplimit of the hydraulic pump 3 is set to Pplimit1 so as to adapt to the relevant work pattern.

If the determination of step 71 is F, the determination of step 72 is F, the determination of step 75 is T, and the determination of step 76 is F, the work pattern of the plurality of hydraulic actuators 21 to 26 is determined to be a work pattern (7) of "arm excavating operation", and the output limit value Pplimit of the hydraulic pump 3 is set to Pplimit1 so as to adapt to the relevant work pattern.

If the determination of step 71 is F, the determination of step 72 is F, the determination of step 75 is F, the determination of step 78 is T, the determination of step 79 is T, and the determination of step 80 is T, the work pattern of the plurality of hydraulic actuators 21 to 26 is determined to be a work pattern (8) of "when load is large in arm earth removal operation and bucket earth removal operation (e.g., earth and sand pushing work of simultaneous earth removal operation of the arm and the bucket)", and the output limit value Pplimit of the hydraulic pump 3 is set to Pplimit3 so as to adapt to the relevant work pattern.

If the determination of step 71 is F, the determination of step 72 is F, the determination of step 75 is F, the determination of step 78 is T, the determination of step 79 is T, and the determination of step 80 is F, the work pattern of the plurality of hydraulic actuators 21 to 26 is determined to be a work pattern (9) of "when load is small in arm earth removal operation and bucket earth removal operation (e.g., work of rotation around the arm and the bucket at the same time in air)", and the output limit value Pplimit of the hydraulic pump 3 is set to Pplimit5 so as to adapt to the relevant work pattern.

If the determination of step 71 is F, the determination of step 72 is F, the determination of step 75 is F, the determination of step 78 is T, the determination of step 79 is F, and the determination of step 81 is T, the work pattern of the plurality of hydraulic actuators 21 to 26 is determined to be a work pattern (10) of "when load is large in arm alone earth removal operation (e.g., earth and sand pushing work by the earth removal operation of the arm)", and the output limit value Pplimit of the hydraulic pump 3 is set to Pplimit3 so as to adapt to the relevant work pattern.

If the determination of step 71 is F, the determination of step 72 is F, the determination of step 75 is F, the determination of step 78 is T, the determination of step 79 is F, and the determination of step 81 is F, the work pattern of the plurality of hydraulic actuators 21 to 26 is determined to be a work pattern (11) of "when load is small in arm alone earth removal operation (e.g., work of rotation around the arm in air)", and the output limit value Pplimit of the hydraulic pump 3 is set to Pplimit5 so as to adapt to the relevant work pattern.

If the determination of step 71 is F, the determination of step 72 is F, the determination of step 75 is F, and the determination of step 78 is F, the work pattern of the plurality of hydraulic actuators 21 to 26 is determined to be a work pattern (12) of "other work", and the output limit value Pplimit of the hydraulic pump 3 is set to Pplimit1 so as to adapt to the relevant work pattern.

In the third engine target revolution calculating unit 63, the third engine target revolution ncom3 corresponding to the output (horsepower) limit value Pplimit of the hydraulic pump 3 calculated in the pump output limit calculating unit 70 is calculated.

A functional relation 63*a* in which the third engine target revolution ncom3 increases according to increase in the output limit value Pplimit of the hydraulic pump 3 is stored in the storage device in a data table format.

In the third engine revolution calculating unit 63, the third engine target revolution ncom3 corresponding to the current work pattern of the plurality of hydraulic actuators 21 to 26, or the output limit value Pplimit of the hydraulic pump 3 is calculated according to the functional relation 63*a*.

In the minimum value selecting unit 65, the lower engine target revolution ncom of the engine target revolution ncom12 selected in the maximum value selecting unit 64 and the third engine target revolution ncom3 is selected.

Figure 10:
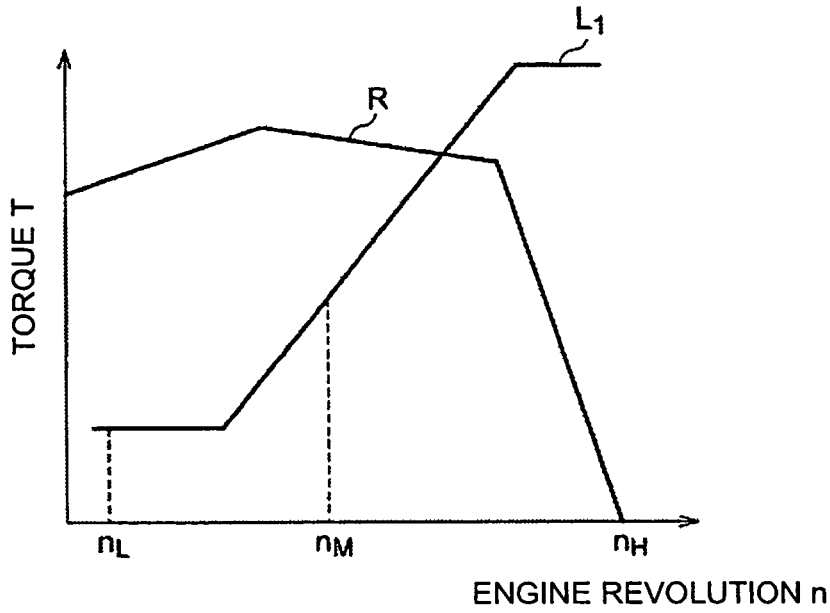
FIG. 10 is a torque curve diagram sued to describe the first example.

The controller 6 outputs a revolution command value for having the engine revolution n to the target revolution ncom to the governor 4, whereby the governor 4 increases/decreases the fuel injection amount to obtain the engine target revolution ncom on the target torque curve L1 shown in FIG. 10.

In the pump absorption torque calculating unit 66, the target absorption torque Tpcom of the hydraulic pump 3 corresponding to the engine target revolution ncom is calculated.

A functional relation 66*a* in which the target absorption torque Tpcom of the hydraulic pump 3 increases according to increase in the engine target revolution ncom is stored in the storage device in a data table format. The function 66*a* is a curve corresponding to the target torque curve L1 of the torque curve diagram shown in FIG. 10.

Figure 2:
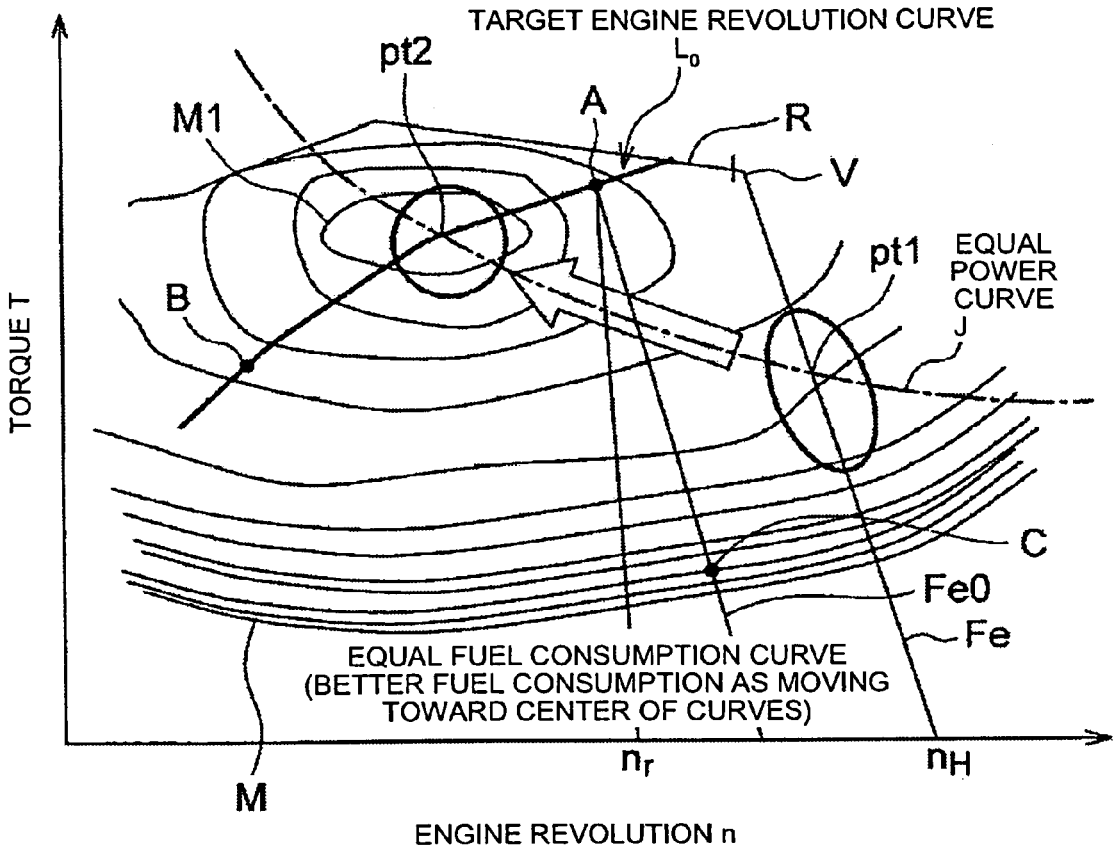
FIG. 2 is a torque curve diagram used to describe the related art.

FIG. 10 shows a torque curve diagram of the engine 2, similar to FIG. 2, where the horizontal axis indicates the engine revolution n (rpm: rev/min) and the vertical axis shows the torque T (N·m). The function 66*a* corresponds to the target torque curve L1 of the torque curve diagram shown in FIG. 10.

In the pump absorption torque calculating unit 66, the target absorption torque Tpcom of the hydraulic pump 3 corresponding to the current engine target revolution ncom is calculated according to the function 66*a*.

In the control current calculating unit 67, the control current pc-epc corresponding to the pump target absorption torque Tpcom is calculated.

A functional relation 67*a* in which the control current pc-epc increases according to increase in the pump target absorption torque Tpcom is stored in the storage device in a data table format.

In the pump absorption torque calculating unit 66, the control current pc-epc corresponding to the current pump target absorption torque Tpcom is calculated according to the functional relation 67*a*.

The control current pc-epc is output from the controller 6 to the pump control valve 5, thereby changing the pump control valve 5 through the servo piston. The pump control valve 5 PC-controls the tilt angle of the wash plate 3*a* of the hydraulic pump 3 so that the product of the discharge pressure PRp ($kg/cm^2$) of the hydraulic pump 3 and the capacity q (cc/rev) of the hydraulic pump 3 does not exceed the pump absorption torque Tpcom corresponding to the control current pc-epc.

Effects of the first example will be described with reference to FIG. 10.

As shown in FIG. 10, when the engine 2 and the hydraulic pump 3 are controlled according to the target torque curve L1 in which the pump absorption torque Tpcom becomes smaller with decrease in the engine revolution n, the fuel consumption, the engine efficiency, and the pump efficiency are enhanced, the noise is reduced, the engine stall is prevented, but the responsiveness of the engine 2 is not satisfactory. That is, even if the operation lever 41 etc. is moved from the neutral position in an attempt to start the excavating work and the engine 2 is raised from low rotation, the engine output does not have a margin with respect to the power for the pump absorption horsepower at the initial stage (transient state) at the start of moving the lever since the load of the hydraulic pump 3 rapidly rises, and the power to accelerate the engine 2 lacks. Thus, the engine 2 cannot be raised up to the target revolution or can be raised only in an extremely slow pace.

In this regards, in the first example, the first engine target revolution ncom1 that adapts to the current pump target discharge flow rate Qsum is set, and the revolution nM (e.g., 1400 rpm) greater than the engine low idle revolution nL is set as the second engine target revolution ncom2 if the current pump target discharge flow rate Qsum is determined to be greater than the predetermined flow rate (e.g., 10 (L/min)). If the second engine target revolution ncom2 is equal to or greater than the first engine target revolution ncom1, the engine revolution is controlled to obtain the second engine target revolution ncom2. The hydraulic pump 3 is controlled to obtain the pump absorption torque corresponding to the second engine target revolution ncom2.

Thus, when the operation lever 41 etc. is moved from the neutral position in an attempt to start the excavating work, the engine revolution is raised in advance and the engine torque is raised before the load of the hydraulic pump 3 is rapidly raised, whereby excessive power is created in the power for accelerating the engine 2. The engine 2 then can be rapidly raised from the low rotation region to the target revolution, and the responsiveness of the engine 2 is enhanced.

In the first example, the first engine target revolution ncom1 adapted to the current pump target discharge flow rate Qsum is set, the output limit value Pplimit of the hydraulic pump 3 is set according to the work pattern of the plurality of hydraulic actuators 21 to 26, and the third engine target revolution ncom3 corresponding thereto is set. If the third engine target revolution ncom3 is lower than or equal to the first engine target revolution ncom1, the engine revolution is controlled to obtain the third engine target revolution ncom3, and the hydraulic pump 3 is controlled to obtain the pump absorption torque corresponding to the third engine target revolution ncom3. The pump absorption torque thus can be defined at an appropriate value, and wasted energy consumption of more than necessary can be suppressed.

Figure 12:
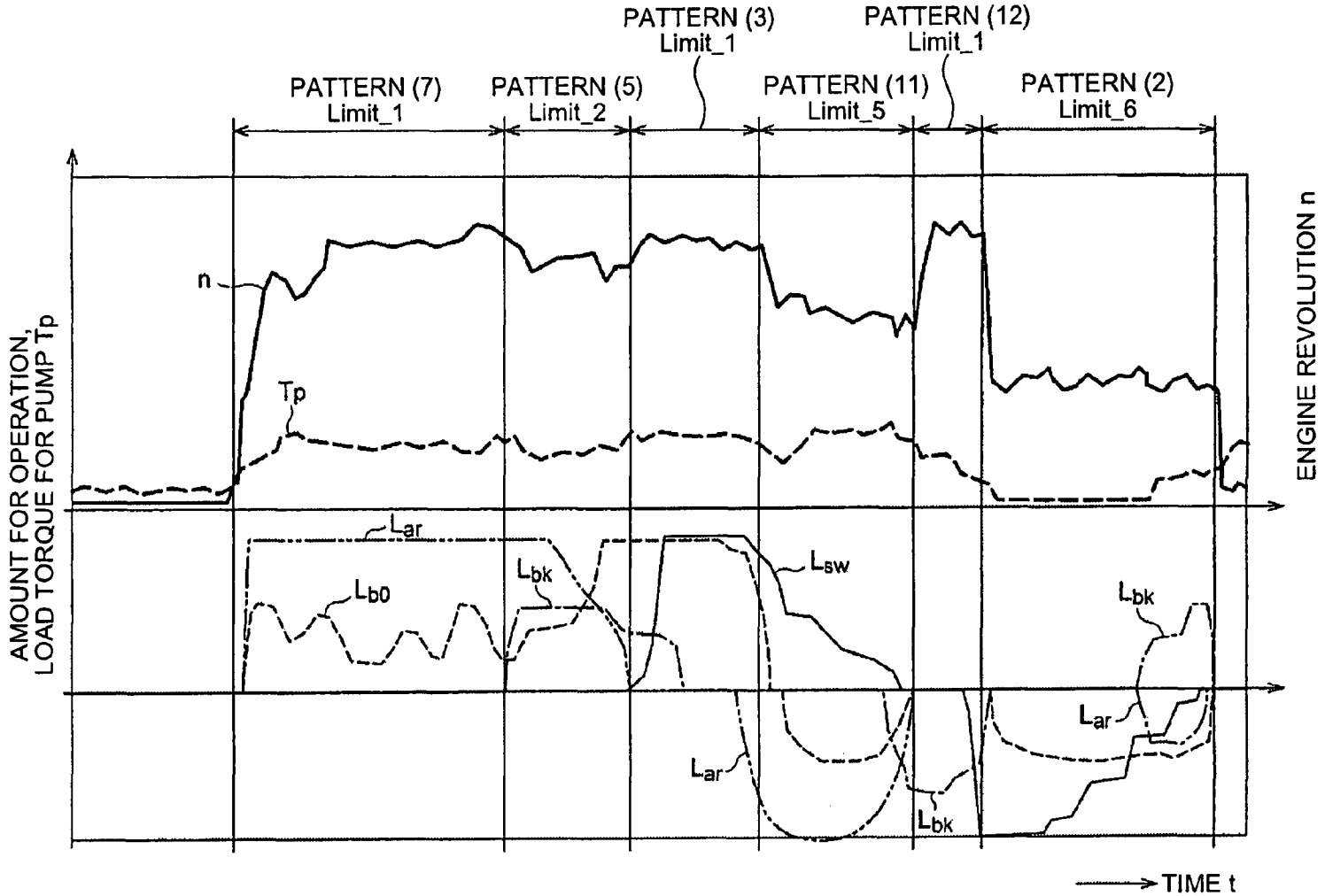
FIG. 12 is a view describing change over time of each parameter in time of work of the construction machine.

FIG. 12 shows change over time in boom lever signal Lbo, arm lever signal Lar, bucket lever signal Lbk, and rotation lever signal Lsw, which represent the operation amount of each operation lever 41, 42 change over time in pump absorption torque Tp, and change over time in engine revolution n when the work is carried out in the order of the work pattern (7), the work pattern (5), the work pattern (3), the work pattern (11), the work pattern (12), and the work pattern (2) by way of example with the horizontal axis as time t.

According to the first example, when the work is carried out in a series of work patterns shown in FIG. 12, the pump absorption torque can be defined at a suitable value, and wasted energy consumption of more than necessary can be suppressed.

As described above, in the present example, the current target discharge flow rate Qsum of the hydraulic pump 3 is calculated by the operation amount of the operation levers 41 to 44 for operating each hydraulic actuator 31 to 36, the first engine target revolution ncom1 adapted to the current pump target discharge flow rate Qsum is set, and determination is made that the operation levers 41 to 44 have switched from the non-operation state to the operation state when the current pump target discharge flow rate Qsum is greater than the predetermined flow rate (e.g., 10 (L/min)), where when such determination is made, the revolution nM (e.g., 1400 rpm) greater than the engine low idle revolution nL is set as the second engine target revolution ncom2.

However, the determination that the operation levers 41 to 44 have switched from the non-operation state to the operation state is not limited thereto, and determination may be made that the operation levers 41 to 44 have switched from the non-operation state to the operation state when the operation amount of the operation levers 41 to 44 is greater than a predetermined threshold value.

In the present example, the current pump target discharge flow rate Qsum is obtained according to the operation amount of the operation levers 41 to 44 for operating each hydraulic actuator 31 to 36, and the first engine target revolution ncom1 adapted to the pump target discharge flow rate Qsum is set.

However, the manner of setting the first target revolution in the present example is arbitrary. For instance, the revolution of the engine 2 may be set with fuel dial, and the first target revolution ncom1 of the engine 2 may be set according to the set value of the fuel dial, similar to that described in the Background Art.

Second Example

The second example will now be described.

The configuration of the construction machine 1 of the second example is based on the configuration example shown in FIG. 3, where the PTO shaft 10, the generator motor 11, the electrical storage device 12, the inverter 13, the rotation sensor 14, and the voltage sensor 15 are added to the configuration example of FIG. 1, and the generator motor 11 performs the electrical motor operation and the power generating operation.

FIG. 5, FIG. 6, FIG. 7 and FIG. 8 are control block views showing a processing content performed in the controller 6.

Figure 5:
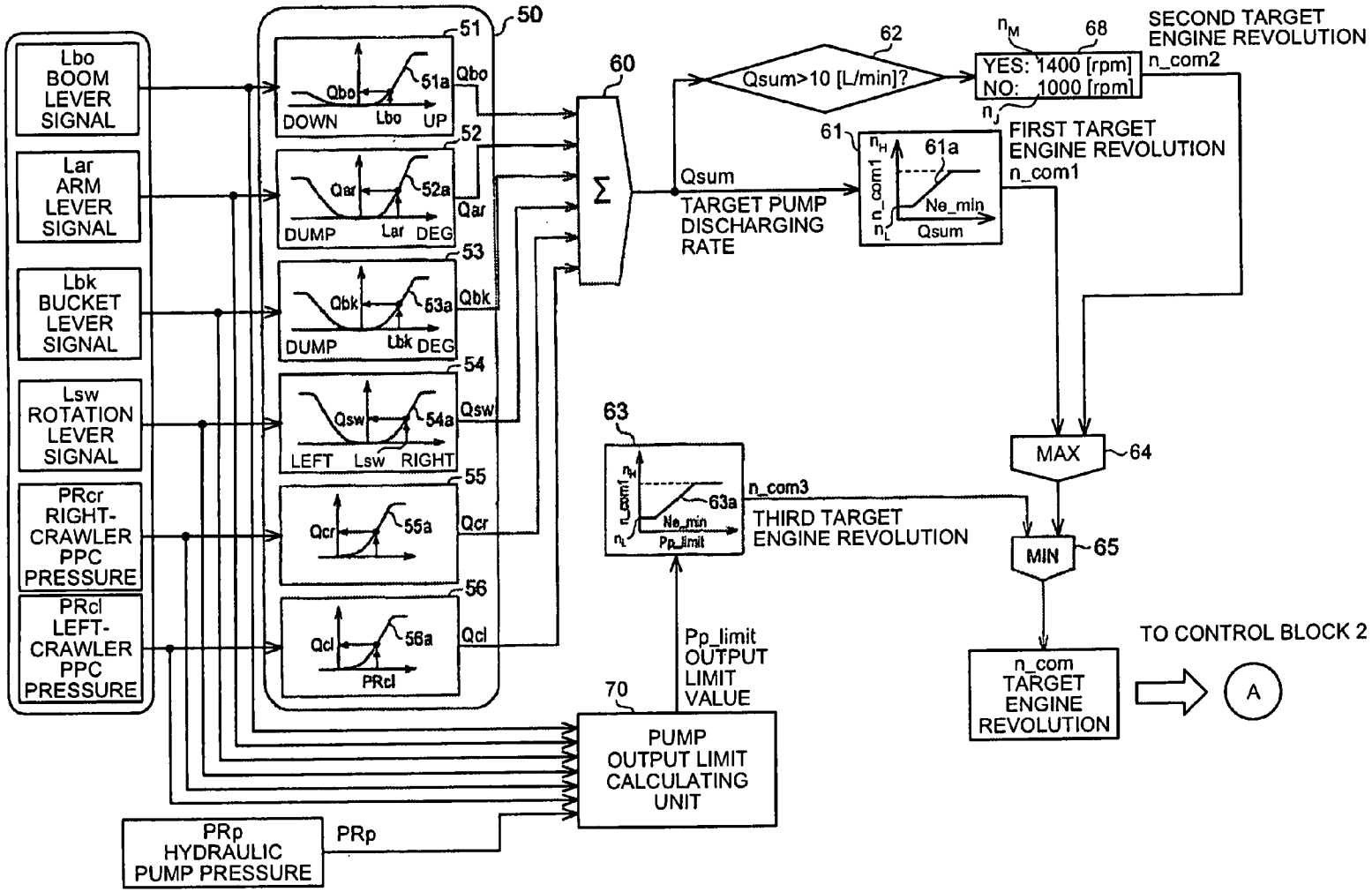
FIG. 5 is a control block diagram of the second example.

FIG. 5 is a view corresponding to FIG. 4 of the first example, and description on the portions overlapping with FIG. 4 will be omitted.

As shown in FIG. 5 and FIG. 6, in the second example, when the engine target revolution ncom is selected in the minimum value selecting unit 65 similar to the first example, the process described below is executed with reference to the control block diagram shown in FIG. 7.

The engine revolution and the engine target revolution are respectively converted to a generator motor revolution and a generator motor target revolution, and then the calculation process is performed, but in the following description, the generator motor revolution and the generator target revolution may be respectively replaced with the engine revolution and the engine target revolution and thereafter the similar calculation process may be performed.

In a target generator motor revolution calculating unit 96, a target revolution Ngencom of the generator motor 11 corresponding to the current engine target revolution ncom is calculated with the following equation.

$$Ngencom = ncom \times K2 \quad (4)$$

where K2 is a reduction ratio of the PTO shaft 10.

In the assistance necessity determining unit 90, whether or not to assist (necessity of assistance) the engine 2 with the generator motor 11 is determined based on the target revolution Ngencom of the generator motor 11, the current actual revolution GENspd of the generator motor 11 detected in the rotation sensor 14, and the current voltage BATTvolt of the electrical storage device 12 detected in the voltage sensor 15.

Figure 8:
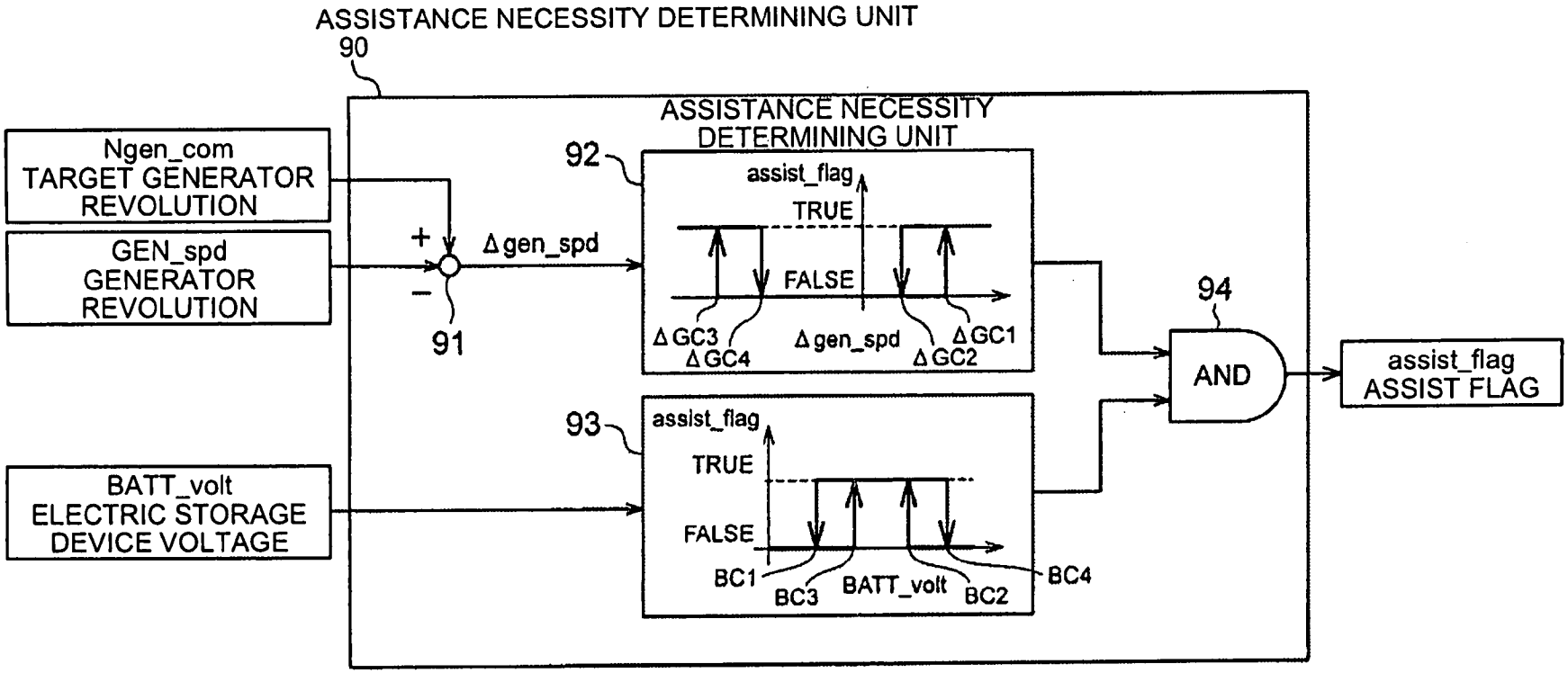
FIG. 8 is a control block diagram of the second example.

The assistance necessity determining unit 90 is specifically shown in FIG. 8.

First, in a deviation calculating unit 91, a deviation Δgenspd of the target generator motor revolution Ngencom and the actual generator motor revolution GENspd is calculated.

In a first determining part 92, when the deviation Δgenspd of the target generator motor revolution Ngencom and the actual generator motor revolution GENspd is equal to or greater than a first threshold value ΔGC1, determination is made to electrical-motor-operate the generator motor 11 and the assist flag is set to T; whereas when the deviation Δgenspd of the target generator motor revolution Ngencom and the actual generator motor revolution GENspd is equal to or smaller than a second threshold value ΔGC2 smaller than the first threshold value ΔGC1, determination is made to not electrical-motor-operate the generator motor 11 (power generating operation to store power as necessary, and store power in the electrical storage device 12) and the assist flag is set to F.

When the deviation Δgenspd of the target generator motor revolution Ngencom and the actual generator motor revolution GENspd is equal to or smaller than a third threshold value ΔGC3, determination is made to power-generation-operate the generator motor 11 and the assist flag is set to T; whereas when the deviation Δgenspd of the target generator motor revolution Ngencom and the actual generator motor revolution GENspd is equal to or greater than a fourth threshold value ΔGC4 greater than the third threshold value ΔGC3, determination is made to not power-generation-operate the generator motor 11 (power generating operation store power as necessary to store power in the electrical storage device 12) and the assist flag is set to F.

When the sign of the revolution deviation Δgenspd is positive and becomes equal to or greater than a certain extent, the generator motor 11 is electrical-motor-operated to assist the engine 2, so that the engine revolution is rapidly raised towards the engine target revolution when the current engine revolution and the target revolution are apart.

If the sign of the revolution deviation Δgenspd is negative and becomes equal to or greater than a certain extent, the generator motor 11 is power-generation-operated to reverse-assist the engine 2, so that when speed reducing the engine revolution, the power generating operation is performed to rapidly lower the engine revolution and regenerate the energy of the engine 2.

Hysteresis is given between the first threshold value ΔGC1 and the second threshold value ΔGC2, and hysteresis is given between the third threshold value ΔGC3 and the fourth threshold value ΔGC4, thereby preventing hunting in terms of control.

In a second determining part 93, the assist flag is set to T when the voltage VATTvolt of the electrical storage device 12 is within a predetermined range BC1 to BC4 (BC2 to BC3), and the assist flag is set to F if outside the predetermined range.

A first threshold value BC1, a second threshold value BC2, a third threshold value BC3, and a fourth threshold value BC4 are set to the voltage value BATTvolt. The first threshold value BC1, the second threshold value BC2, the third threshold value BC3, and the fourth threshold value BC4 become large in this order.

The assist flag is set to T when the voltage value BATTvolt of the electrical storage device 12 is equal to or smaller than the third threshold value BC3, and the assist flag is set to F when the voltage value BATTvolt of the electrical storage device 12 is equal to or greater than the fourth threshold value BC4. The assist flag is set to T when the voltage value BATTvolt of the electrical storage device 12 is equal to or greater than the second threshold value BC2, and the assist flag is set to F when the voltage value BATTvolt of the electrical storage device 12 is equal to or smaller than the first threshold value BC1.

The assist is carried out only when the voltage BATTvolt of the electrical storage device 12 is within the predetermined range BC1 to BC4 (BC2 to BC3) so that assist is not carried out in low voltage and in high voltage outside the predetermined range, and adverse effect of overcharge and full discharge on the electrical storage device 12 is avoided.

Hysteresis is given between the first threshold value BC1 and the second threshold value BC2, and hysteresis is given between the third threshold value BC3 and the fourth threshold value BC4, thereby preventing hunting in terms of control.

In the AND circuit 94, if both the assist flag obtained in the first determining part 92 and the assist flag obtained in the second determining part 93 are both T, the content of the assist flag is ultimately set to T, or otherwise the content of the assist flag is ultimately set to F.

In an assist flag determining unit 95, determination is made on whether or not the content of the assist flag output from the assistance necessity determining unit 90 is T.

In a generator motor command value switching unit 87, the content of the generator motor command value GENcom to be applied to the inverter 13 is switched to the target revolution or the target torque according to whether the determination result of the assist flag determining unit 95 is T or not (F).

The generator motor 11 is controlled by the revolution control or the torque control through the inverter 13.

The revolution control is a control of adjusting the revolution of the generator motor 11 to obtain the target revolution by applying the target revolution as the generator motor command value GENcom. The torque control is a control of adjusting the torque of the generator motor 11 to obtain the target torque by applying the target torque as the generator motor command value GENcom.

In the modulation processing unit 97, the target revolution of the generator motor 11 is calculated and output. In the generator motor torque calculating unit 68, the target torque of the generator motor 11 is calculated and output.

That is, the modulation processing unit 97 outputs the revolution Ngencom performed with the modulation process according to characteristic 97*a* with respect to the target generator motor revolution Ngencom obtained in the target generator motor revolution calculating unit 96. The target generator motor revolution Ngencom input by the target generator motor revolution calculating unit 96 is not output as it is, but the revolution is gradually increased with time t until reaching the target generator motor revolution Ngencom input by the target generator motor revolution calculating unit 96.

The effect when the modulation process is performed on the contrary to when the modulation process is not performed will be described with reference n to FIG. 13 and FIG. 14.

Similar to FIG. 2 and FIG. 10, FIG. 13A, FIG. 13B, FIG. 14A, and FIG. 14B show a torque curve diagram having the horizontal axis as the engine revolution and the vertical axis as the torque T.

Figure 13A:
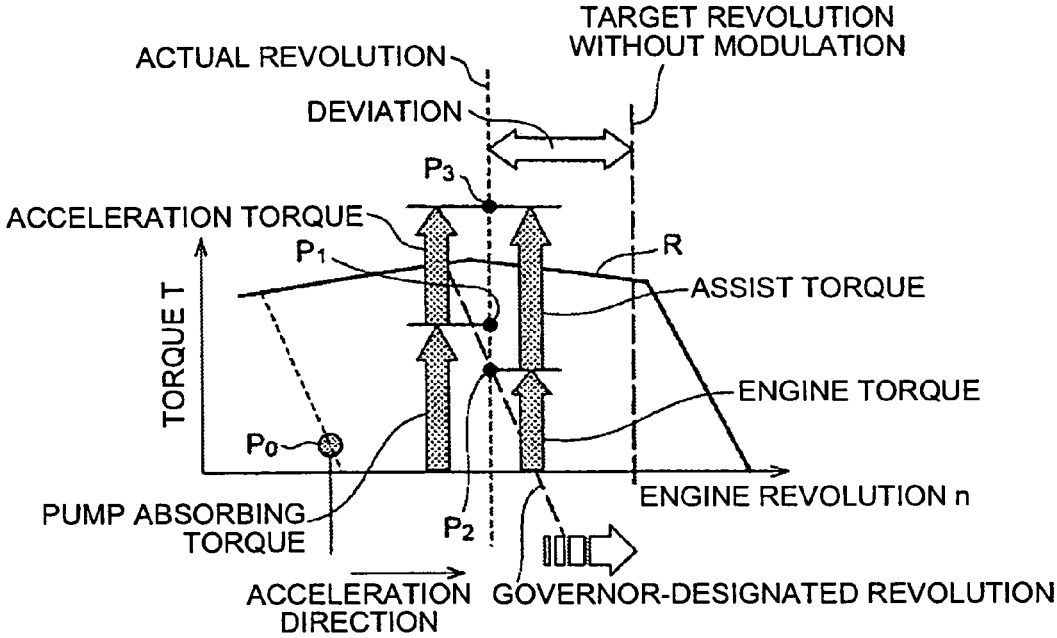
FIG. 13A is a view describing an operation of when modulation process is not performed in engine acceleration.
Figure 13B:
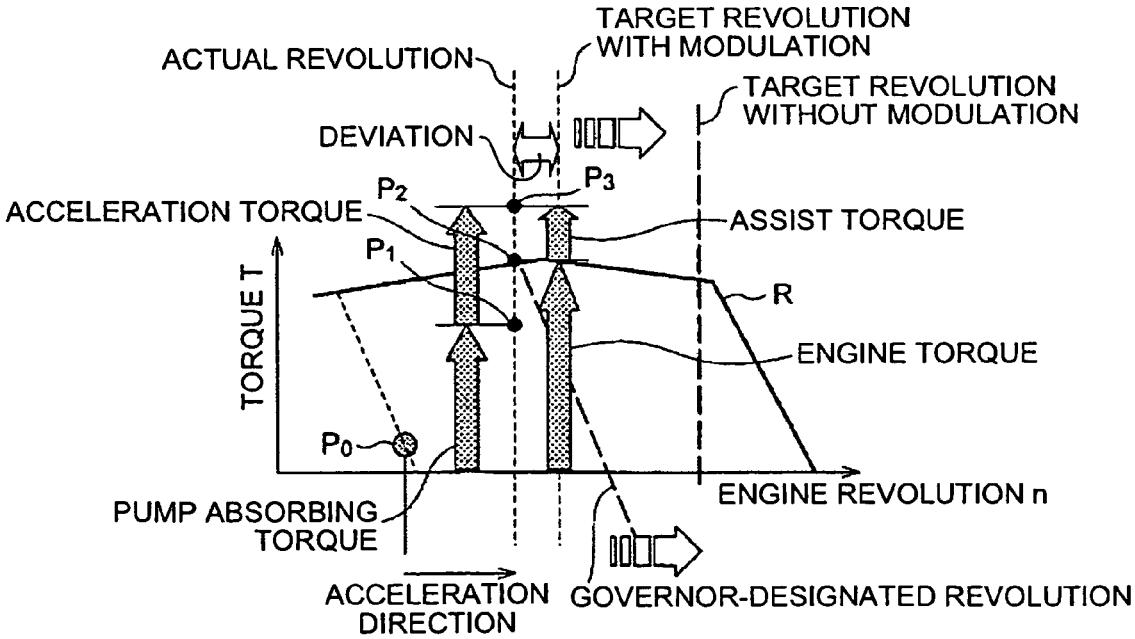
FIG. 13B is a view describing an operation of when modulation process is performed in engine acceleration.

FIG. 13A is a view describing the movement of the governor 4 when the modulation process is not performed in time of engine acceleration, and FIG. 13B is a view describing the movement of the governor 4 when the modulation process is performed in time of engine acceleration.

Figure 14A:
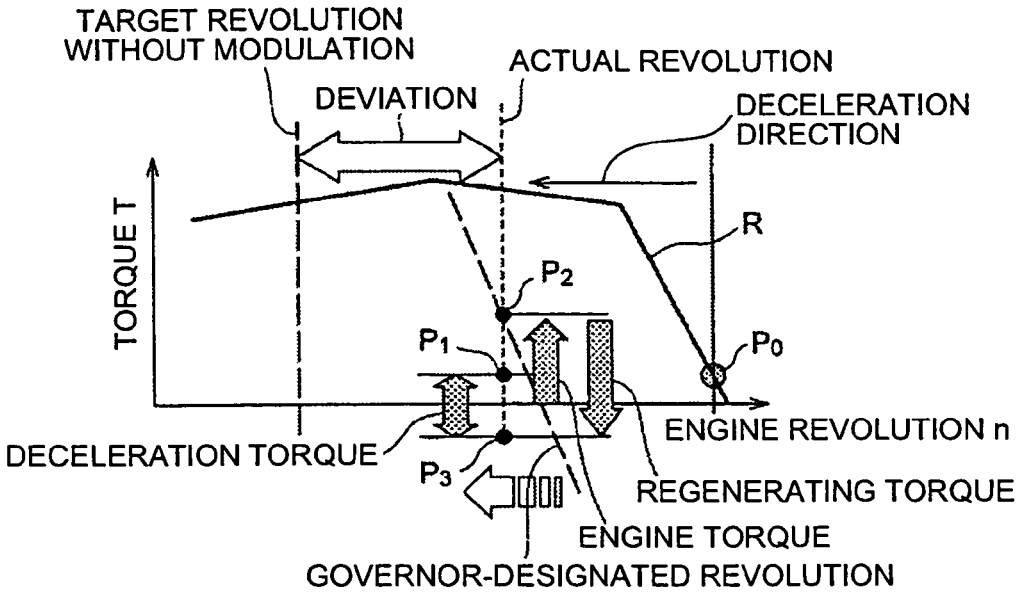
FIG. 14A is a view describing an operation of when modulation process is not performed in engine deceleration.
Figure 14B:
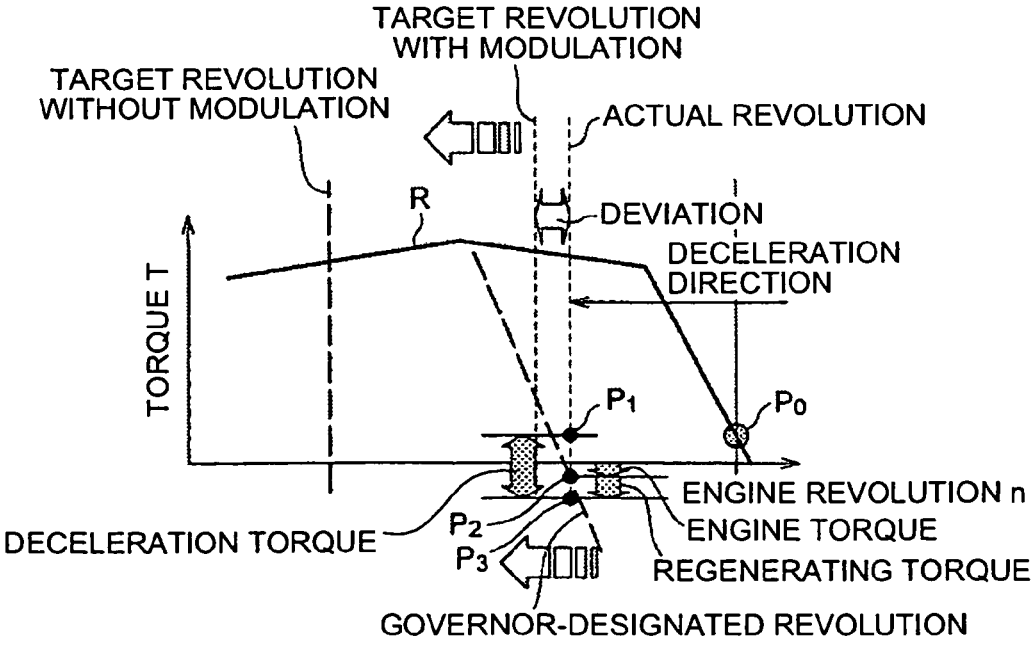
FIG. 14B is a view describing an operation of when modulation process is performed in engine deceleration.

FIG. 14A is a view describing the movement of the governor 4 when the modulation process is not performed in time of engine deceleration, and FIG. 14B is a view describing the movement of the governor 4 when the modulation process is performed in time of engine deceleration. If a mechanical governor is used for the governor 4, the revolution specified by the governor 4 might delay from the actual engine revolution.

As shown in FIG. 13A and FIG. 13B, a case of accelerating the engine 2 from the matching point P0 of low rotation to the high rotation side when the load of the hydraulic pump 3 is large is assumed.

In FIG. 13A and FIG. 13B, P2 corresponds to engine torque, and the total torque P3 combining the engine 2 and the generator motor 11 is that in which the assist torque is added to the engine torque. P1 corresponds to the pump absorption torque, and a combined torque of the acceleration torque and the pump absorption torque corresponds to the total torque P3.

As shown in FIG. 13A, when the modulation process is not performed, an assist torque corresponding to the deviation of the engine target revolution and the engine actual revolution is generated. If the deviation is large, the assist torque by the generator motor 11 becomes greater in correspondence to the large deviation. Thus, the engine 2 accelerates faster than the movement of the governor 4, and the actual revolution becomes larger than the revolution specified by the governor 4. When the engine 2 is rapidly accelerated, the fuel injection amount decreases due to adjustment of the governor 4, and the engine torque decreases. Thus, the engine 2 will be in friction although the engine 2 is assisted by the generator motor 11, and the acceleration of the engine 2 will not rise. The engine torque is decreased while decreasing the fuel injection amount, and the engine 2 loss occurs and the engine 2 accelerates, thereby causing energy loss and the engine 2 cannot be sufficiently accelerated.

When the modulation process is performed as shown in FIG. 13B, the modulation process is performed on the engine target revolution, the deviation between the engine target revolution and the engine actual revolution becomes small, and a small assist torque accordingly generates at the generator motor 11. The movement of the governor 4 then follows the acceleration of the engine 2, and the revolution specified by the governor 4 matches the actual revolution.

The energy loss is thereby reduced and the engine 2 is sufficiently accelerated.

A case of decelerating the engine 2 will be described.

As shown in FIG. 14A and FIG. 14B, a case of decelerating the engine 2 from the matching point P0 of high rotation to the low rotation side when the load of the hydraulic pump 3 is large is assumed.

In FIG. 14A and FIG. 14B, P2 corresponds to engine torque, and the total torque P3 combining the engine 2 and the generator motor 11 corresponds the combined torque of the regeneration torque and the engine torque. P1 corresponds to the pump absorption torque, and that in which the deceleration torque is added to the pump absorption torque corresponds to the total torque P3.

As shown in FIG. 14A, when the modulation process is not performed, a regeneration torque corresponding to the deviation of the engine target revolution and the engine actual revolution is generated. If the deviation is large, the regeneration torque by the generator motor 11 becomes greater in correspondence to the large deviation. Thus, the engine 2 decelerates faster than the movement of the governor 4, and the actual revolution becomes smaller than the revolution specified by the governor 4. When the engine 2 is rapidly decelerated, the fuel injection amount increases due to adjustment of the governor 4, and the engine torque increases. Thus, the engine 2 is decelerated with the generator motor 11 generating power while the engine 2 is increasing torque. As a result, the engine 2 raises the torque, the generator motor 11 collects the increasing engine energy, and the engine 2 is decelerated, whereby wasted power generation is performed and the fuel is unnecessarily consumed.

When the modulation process is performed as shown in FIG. 14B, the modulation process is performed on the engine target revolution, the deviation between the engine target revolution and the engine actual revolution becomes small, and a small regeneration torque accordingly is generated at the generator motor 11. The movement of the governor 4 then follows the deceleration of the engine 2, and the revolution specified by the governor 4 matches the actual revolution. The torque of the engine 2 thus becomes negative, and the engine 2 decelerates while the speed energy of the engine 2 is collected by the generator motor 11. The engine 2 is thereby efficiently decelerated without causing wasted energy consumption.

In the generator motor torque calculating unit 68, the target torque Tgencom corresponding to the voltage BATTvolt is calculated based on the current voltage BATTvolt of the electrical storage device 12 detected in the voltage sensor 15.

In the storage device, a functional relation 68*a* having hysteresis in which the target torque Tgencom decreases according to rise 68*b* in the voltage BATTvolt of the electrical storage device 12 and the target torque Tgencom increases according to lowering 68*c* in the voltage BATTvolt of the electrical storage device 12 is stored in a data table format. The functional relation 68*a* is set to maintain the voltage value of the electrical storage device 12 within a desired range by adjusting the power generation amount of the generator motor 11.

In the generator motor torque calculating unit 68, the target torque Tcom corresponding to the current voltage BATTvolt of the electrical storage device 12 is output according to the functional relation 68*a*.

When determined that the content of the assist flag is T in the assist flag determining unit 95, the generator motor command switching unit 87 is switched to the modulation process unit 97 side, the target generator motor revolution Ngencom output from the modulation process unit 97 is output to the inverter 13 as a generator motor command value GENcom, the generator motor 11 is revolution-controlled, and the generator motor 11 performs the electrical motor operation or the power generating operation.

When determined that the content of the assist flag is F in the assist flag determining unit 95, the generator motor command switching unit 87 is switched to the generator motor torque calculating unit 68 side, the generator motor target torque Tgencom output from the generator motor torque calculating unit 68 is output to the inverter 13 as a generator motor command value GENcom, the generator motor 11 is torque-controlled, and the generator motor 11 performs the power generating operation.

In the pump absorption torque command value switching unit 88, the content of the pump target absorption torque T to be applied to the control current calculating unit 67 is switched to the first pump target absorption torque Tpcom1 or the second pump target absorption torque Tpcom2 depending on whether the determination result of the assist flag determining unit 95 is T or not (F).

The first pump target absorption torque Tpcom1 is calculated in the first pump target absorption torque calculating unit 66 (same configuration as pump absorption torque calculating unit shown in FIG. 4).

Figure 9A:
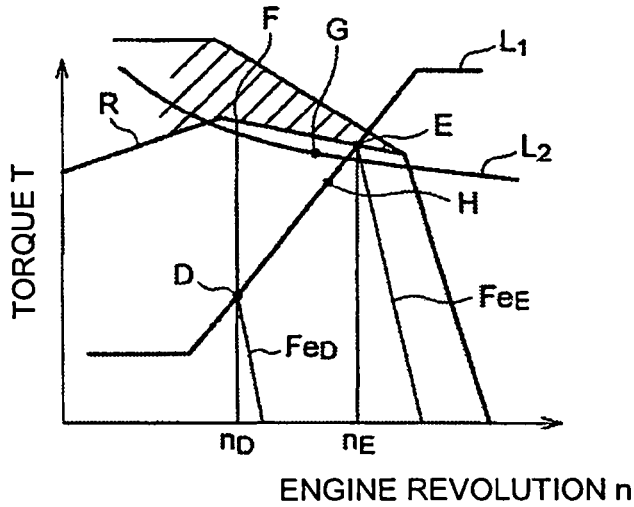
FIG. 9A is a torque curve diagram used to describe the second example.

That is, the first pump target absorption torque Tpcom1 is provided as a torque value on the first target torque curve L1 in the torque curve diagram of FIG. 9A. As described in FIG. 10, the first target torque curve L1 is set as a target torque curve in which the target absorption torque Tpcom1 of the hydraulic pump 3 becomes smaller as the engine target revolution n becomes lower.

The second pump target absorption torque Tpcom2 is calculated in the second pump target absorption torque calculating unit 85.

That is, the second pump target absorption torque Tpcom2 is provided as a torque value on the second target torque curve L2 in which the pump target absorption torque becomes greater in the low rotation region with respect to the first target torque curve L1 in the torque curve diagram of FIG. 9A.

In the first pump target absorption torque calculating unit 66, the first target absorption torque Tpcom1 of the hydraulic pump 3 corresponding to the engine target revolution ncom is calculated.

In the storage device, a functional relation 66*a* in which the first target absorption torque Tpcom1 of the hydraulic pump 3 increases with increase in the engine target revolution ncom is stored in a data table format. The function 66*a* is a curve corresponding to the first target torque curve L1 on the torque curve diagram shown in FIG. 9A (FIG. 10).

FIG. 9A shows the torque curve diagram of engine 2, similar to FIG. 10, where the horizontal axis shows the engine revolution n (rpm: rev/min) and the vertical axis shows the torque T (N·m). The function 66*a* corresponds to the target torque curve L1 on the torque curve diagram shown in FIG. 9A.

In the first pump target absorption torque calculating unit 66, the first pump target absorption torque Tpcom1 corresponding to the current engine target revolution ncom is calculated according to the functional relation 66*a*.

In the second pump target absorption torque calculating unit 85, the second pump target absorption torque Tpcom2 of the hydraulic pump 3 corresponding to the generator motor revolution GENspd (engine actual revolution) is calculated.

In the storage device, a functional relation 85*a* in which the second target absorption torque Tpcom2 of the hydraulic pump 3 changes according to the generator motor revolution GENspd (engine actual revolution) is stored in a data table format. The function 85*a* is a curve corresponding to the second target torque curve L2 on the torque curve diagram shown in FIG. 9A, and has characteristic in that the pump target absorption torque becomes larger in the low rotation region with respect to the first target torque curve L1. For instance, the second target torque curve L2 is a curve corresponding to the equal horsepower curve, and has characteristic in that the torque lowers according to rise in the engine revolution.

In the second pump target absorption torque calculating unit 85, the second pump target absorption torque Tpcom2 corresponding to the current generator motor revolution GENspd (engine actual revolution) is calculated according to the functional relation 85*a*.

When determined that the content of the assist flag is T in the assist flag determining unit 95, the pump absorption torque command value switching unit 88 switches to the second pump target absorption torque calculating unit 85 side, and the second pump target absorption torque Tpcom2 output from the second pump target absorption torque calculating unit 85 is output to a post-stage filter processing unit 89 as the pump target absorption torque Tpcom.

When determined that the content of the assist flag is F in the assist flag determining unit 95, the pump absorption torque command value switching unit 88 switches to the first pump target absorption torque calculating unit 66 side, and the first pump target absorption torque Tpcom1 output from the first pump target absorption torque calculating unit 66 is output to the post-stage filter processing unit 89 as the pump target absorption torque Tpcom.

The selection of the target absorption torque Tpcom1, Tpcom2 of the hydraulic pump 3, that is, the target torque curve L1, L2 of FIG. 9A is switched in the pump absorption torque command value switching unit 88 in the above manner.

In the filter processing unit 89, when the selection of the target torque curve L1, L2 is switched, a filter process of gradually changing from the pump target absorption torque (second pump target absorption torque Tpcom2) on the target torque curve (e.g., second target torque curve L2) before switching to the target absorption torque (second pump target absorption torque Tpcom1) on the target torque curve (first target torque curve L1) after switching is carried out.

That is, the filter processing unit 89 outputs the target torque value Tpcom subjected to the filter process according to the characteristic 89*a* when the selection of the target torque curve L1, L2 is switched. When the selection of the target torque curve L1, L2 is switched, switching output is not carried out from the pump target absorption torque (second pump target absorption torque Tpcom2) on the target torque curve (second target torque curve L2) before switching to the pump target absorption torque (second pump target absorption torque Tpcom1) on the target torque curve (first target torque curve L1) after switching, but is gradually and smoothly performed over time t from the pump target absorption torque (second pump target absorption torque Tpcom2) on the target torque curve (second target torque curve L2) before switching to the pump target absorption torque (second pump target absorption torque Tpcom1) on the target torque curve (first target torque curve L1) after switching.

Describing using FIG. 9A, the torque gradually changes over time from the second pump target absorption torque Tpcom2 at point G on the second target torque L2 to the first pump target absorption torque Tpcom2 at point H on the first target torque curve L1.

The shock on the operator and the vehicle body caused by rapid change in torque is thereby suppressed, and an uncomfortable feeling in operation can be eliminated.

The filtering may be performed in both cases when the determination result of the assist flag determining unit 95 is switched from T to F and when the determination is switched from F to T, or filtering may be performed only when one of the switching is carried out. In particular, when the determination result of the assist flag determining unit 95 is switched from T to F and switch is also made from the second target torque curve L2 to the first target torque curve L1, the torque rapidly lowers if filtering is not performed, thereby providing a significant uncomfortable feeling in operation to the operator. Thus, filtering is desirably performed when the determination result is switched from T to F and switch is made from the second target torque curve L2 to the first target torque curve L1.

The pump target absorption torque Tpcom output from the filter unit 89 is provided to a control current calculating unit 67 having the same configuration as that shown in FIG. 4.

In the control current calculating unit 67, the control current pc-epc corresponding to the pump target absorption torque Tpcom is calculated.

A functional relation 67*a* in which the control current pc-epc increases with increase in the pump target absorption torque Tpcom is stored in the storage device in a data table format.

In the control current calculating unit 67, the control current pc-epc corresponding to the current pump target absorption torque Tpcom is calculated according to the functional relation 67*a*.

The control current pc-epc is output from the controller 6 to the pump control valve 5, thereby controlling the pump control valve 5 through the servo piston. The pump control valve 5 PC-controls the tilt angle of the swash plate 3*a* of the hydraulic pump 3 so that the product of the discharge pressure PRp (kg/cm2) of the hydraulic pump 3 and the capacity q (cc/rev) of the hydraulic pump 3 does not exceed the pump absorption torque Tpcom corresponding to the control current pc-epc.

The effects of the second example will be described.

According to the second example, the first target torque curve L1 in which the target absorption torque of the hydraulic pump 3 becomes smaller with lowering in the engine target revolution is set, as shown in FIG. 9A. The second target torque curve L2 in which the pump target absorption torque becomes greater in the low rotation region is set with respect to the first target line L1.

The engine revolution is controlled so as to match the engine target revolution. The engine target revolution is set to a low revolution nD when determined that the load of the hydraulic pump 3 is small from the operation amount of each operation lever 41 to 44, and the engine target revolution is set to a high revolution nE when determined that the load of the hydraulic pump 3 is large from the operation of each operation lever 41 to 44.

Determination is then made on whether or not the deviation between the engine target revolution and the actual revolution of the engine 2 is equal to or greater than a predetermined threshold value, that is, whether or not to assist the engine 2 with the generator motor 11.

If the deviation between the engine target revolution and the actual revolution of the engine 2 is not equal to or greater than the predetermined threshold value, the first target torque curve L1 is selected, and the capacity of the hydraulic pump 3 is controlled so that the pump target absorption torque on the first target torque curve L1 corresponding to the engine target revolution is obtained.

Thus, if the engine target revolution is set to low rotation nD, the governor 4 increases/decreases the fuel injection amount to balance the engine 2 and the hydraulic pump absorption torque with an upper limit torque value indicated by point D where the first target torque curve L1 intersects with the regulation line FeD corresponding to the engine target revolution nD. Statically, it matches at point D on the first target torque curve L1.

If the engine target revolution is set to high rotation nE, the governor 4 increases/decreases the fuel injection amount to balance the engine 2 and the hydraulic pump absorption torque with point E intersecting the first target torque curve L1 as an upper limit torque value on the regulation line FeE corresponding to the engine target revolution nE. Statically, it matches at point E on the first target torque curve L1.

Thus, if assist by the generator motor 11 is not performed, the engine 2 is controlled along the target torque curve L1, similar to the comparative example, and thus effects of enhancement in fuel consumption, enhancement in pump efficiency and engine efficiency, reduction of noise, prevention of engine stall, and the like are obtained.

If the deviation between the engine target revolution and the actual revolution of the engine 3 is equal to or greater than a predetermined threshold value, the generator motor 11 is electrical-motor-operated. The engine torque for the torque indicated with a broken line in FIG. 9A is added as a result of electrical motor operation of the generator motor 11.

If equal to or greater than the threshold value, the second target torque curve L2 is selected, and the capacity of the hydraulic pump 3 is controlled so that the pump target absorption torque on the second target torque curve L2 corresponding to the engine revolution is obtained.

The control of the second example will be described in comparison with the first example.

Suppose a case of moving the operation lever 41 etc. from the neutral position to start the excavating work. In this case, the engine revolution needs to be raised to the matching point E of high load from low rotation to high rotation.

Figure 9B:
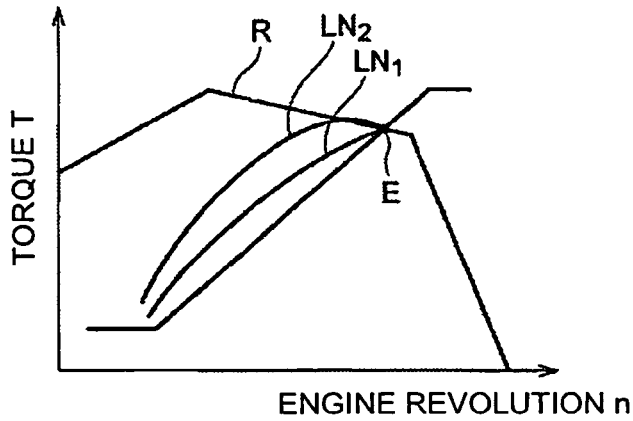
FIG. 9B is a torque curve diagram used to describe the second example.

In the first example, the engine 2 accelerates along the path LN1 of FIG. 9B. At the initial stage in start of the excavating work, the working machine etc. needs to be operated while raising (in time of transient) the engine rotation. In the first example, the responsiveness of the engine 2 is satisfactory, but the absorption torque of the hydraulic pump 3 becomes small at the initial stage in rising of the engine rotation since the generator motor 2 does not give assistance and transition to the second target torque curve L2 does not occur. The start of movement of the working machine becomes slow with respect to the movement of the operation lever, thereby lowering the work efficiency and providing an uncomfortable feeling in operation to the operator.

The engine 2 accelerates along the path LN2 when assist by the generator motor 11 is added with respect to the first example. In this case, the absorption torque of the hydraulic pump 3 becomes large at the initial stage in rising of engine rotation compared to the first example since the generator motor 2 gives assistance. The start of movement of the working machine becomes fast with respect to the movement of the operation lever, thereby suppressing lowering in work efficiency and alleviating the uncomfortable feeling in operation on the operator. Therefore, an implementation of simply adding assistance by the generator motor 11 with respect to the first example is also possible as a variant of the second example.

Figure 9C:
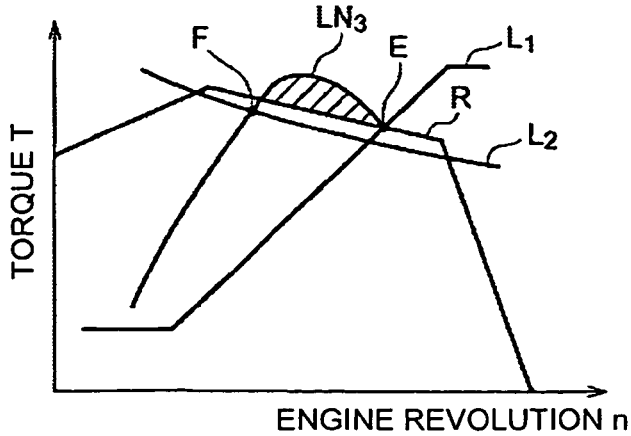
FIG. 9C is a torque curve diagram used to describe the second example.

In the second example, the engine 2 accelerates along the path LN3 of FIG. 9C. According to the second example, point E is reached through point F on the second target torque curve L2 from low rotation. That is, since the hydraulic pump absorption torque reaches point F of high torque immediately after the operation lever 41 etc. is moved, the start of movement becomes fast with respect to the movement of the operation lever. The working machine thus can be moved instantaneously with strong force without delaying from the movement of the operation lever while accelerating the engine 2. The work efficiency thereby enhances, and an uncomfortable feeling in operation is not provided on the operator. When eliminating assistance (eliminate shaded portion shown in FIG. 9C) by the generator motor 11 and transitioning to the second target torque curve L2, overload might apply on the engine 2. In the second example, transition to the second target torque curve L2 is guaranteed on the promise of assistance by the generator motor 11.

Accordingly, the working machine etc. can be operated with satisfactory responsiveness as intended by the operator while enhancing engine efficiency, pump efficiency, and the like according to the second example.

Third Example

In the second example described above, description is made based on the hydraulic rotation system for rotating the upper rotation body of the construction machine 1 by unit of the hydraulic actuator (hydraulic motor), but the second example based on an electrical rotation system of rotating the upper rotation body of the construction machine 1 by unit of an electrical actuator will be described below.

Figure 15:
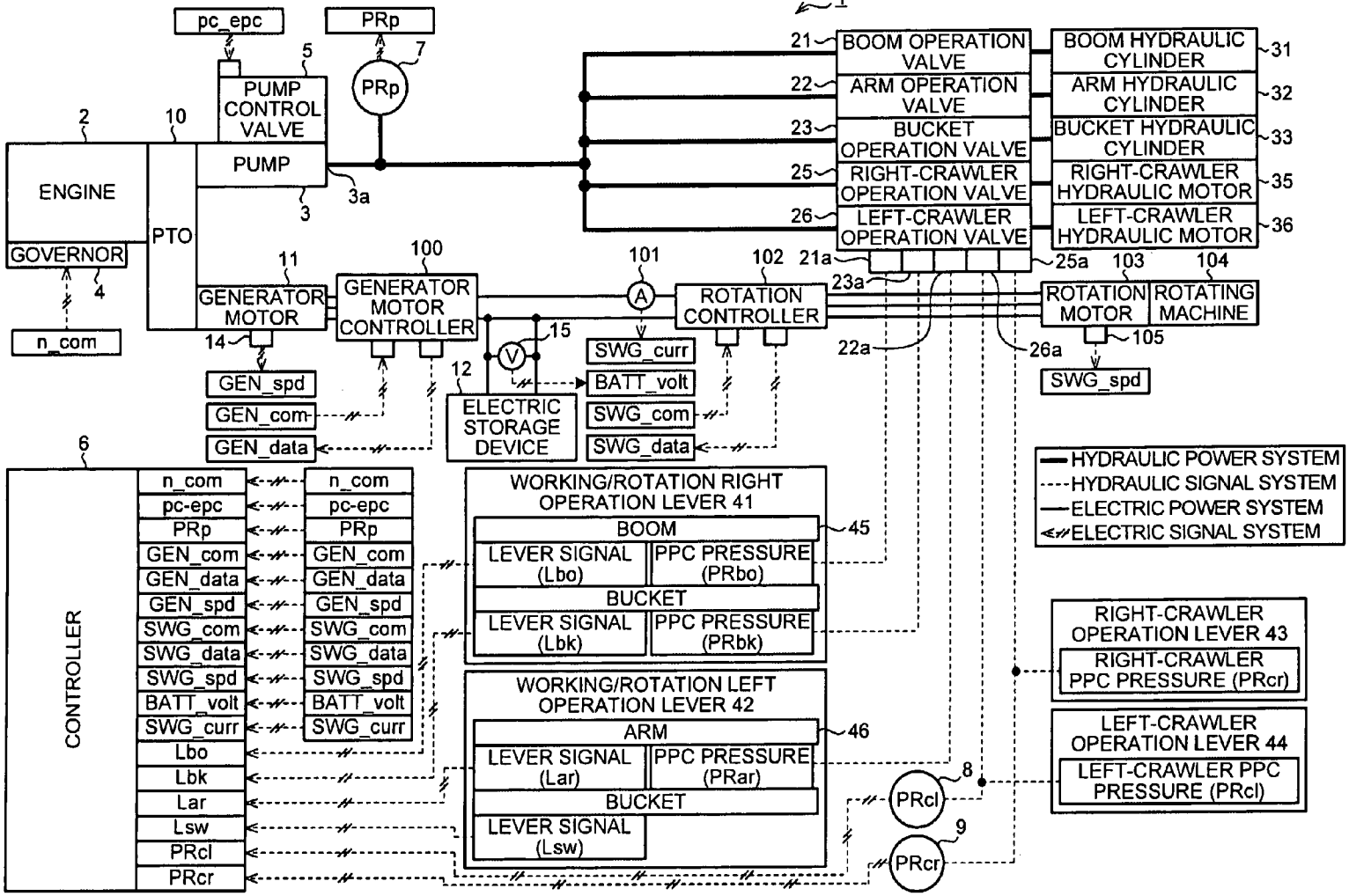
FIG. 15 is a configuration view of the third example and shows a configuration of the construction machine 1 mounted with the electrical rotation system.

FIG. 15 is a configuration view of the third example and shows a configuration of the construction machine 1 mounted with the electrical rotation system.

As shown in FIG. 15, similar to the configuration of FIG. 3, the PTO shaft 10, the generator motor 11, the electrical storage device 12, the inverter 13, the rotation sensor 14, and the voltage sensor 15 are added to the first example of FIG. 1, and the electrical motor operation and the power generating operation are performed by the generator motor 11, but components for rotating the upper rotation body with the electrical actuator (rotation motor 103), that is, a generator motor controller 100, a current sensor 101, a rotation controller 102, a rotation motor 103, and a rotation speed sensor 105 are added.

FIG. 5, FIG. 6, FIG. 16, FIG. 17, FIG. 18, and FIG. 19 are control block diagrams showing the processing content performed in the controller 6.

Figure 7:
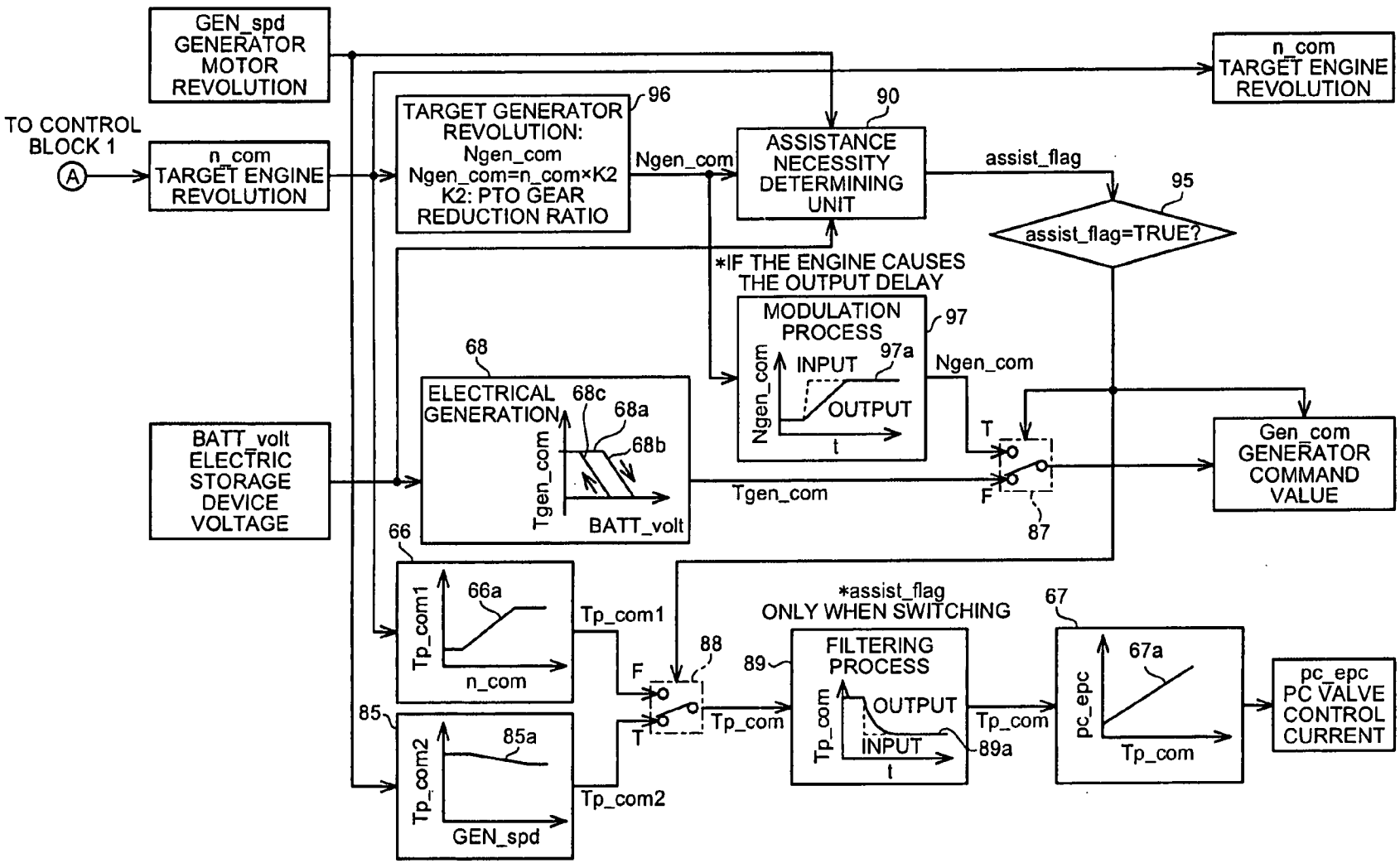
FIG. 7 is a control block diagram of the second example.
Figure 16:
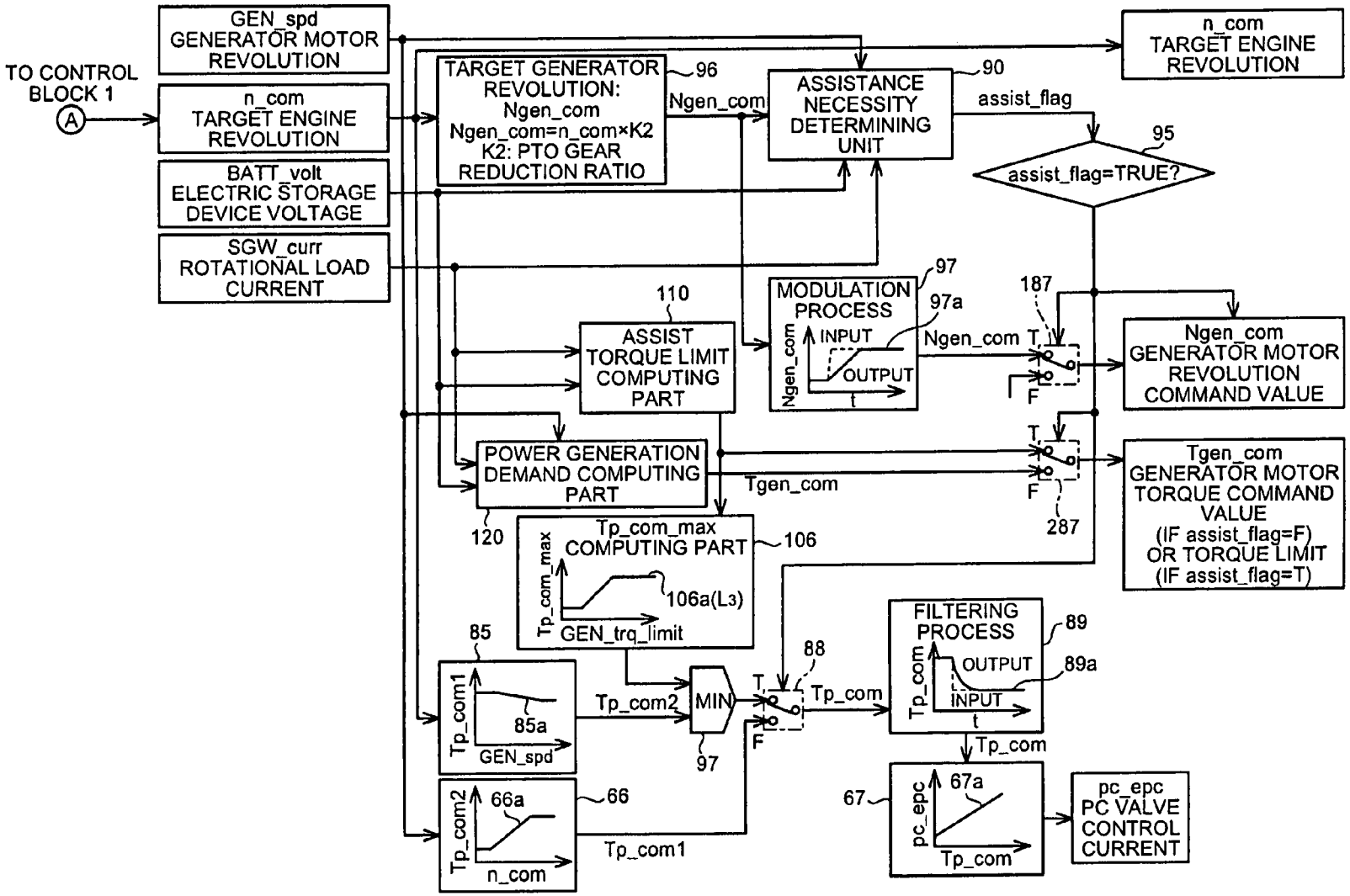
FIG. 16 is a control block diagram showing a processing content performed in the controller 6.

FIG. 16 is a view showing a control block 2 corresponding to FIG. 7 of the second example, where description on the portions overlapping with FIG. 7 is omitted below.

As shown in FIG. 16, in the control block 2 of the third example, an assist torque limit calculating unit 110, a third pump maximum absorption torque calculating unit 106, a minimum value selecting unit 107 are added on the control block of the second example, generator motor command value switching units 187, 287 are arranged in place of the generator motor command value switching unit 87 in the control block 2 of the first example, and a requested power generation amount calculating unit 120 is arranged in place of the generator motor torque calculating unit 68 in the control block 2 of the first example.

Figure 17:
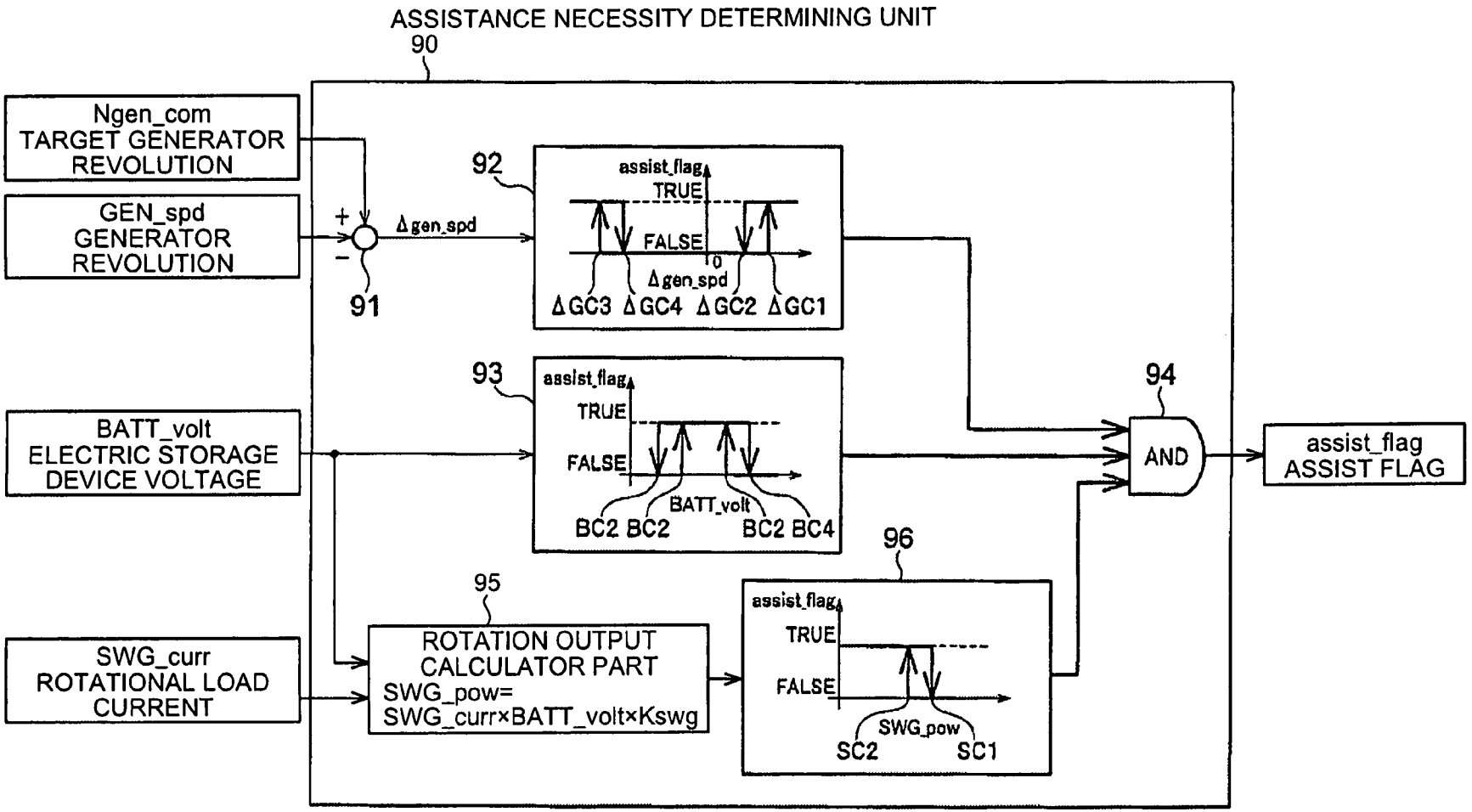
FIG. 17 is a control block diagram showing a processing content performed in the controller 6.

FIG. 17 is a block diagram showing an internal configuration of the assistance necessity determining unit 90 corresponding to FIG. 8 of the second example, where description on portions overlapping with FIG. 8 will be omitted below.

Figure 18:
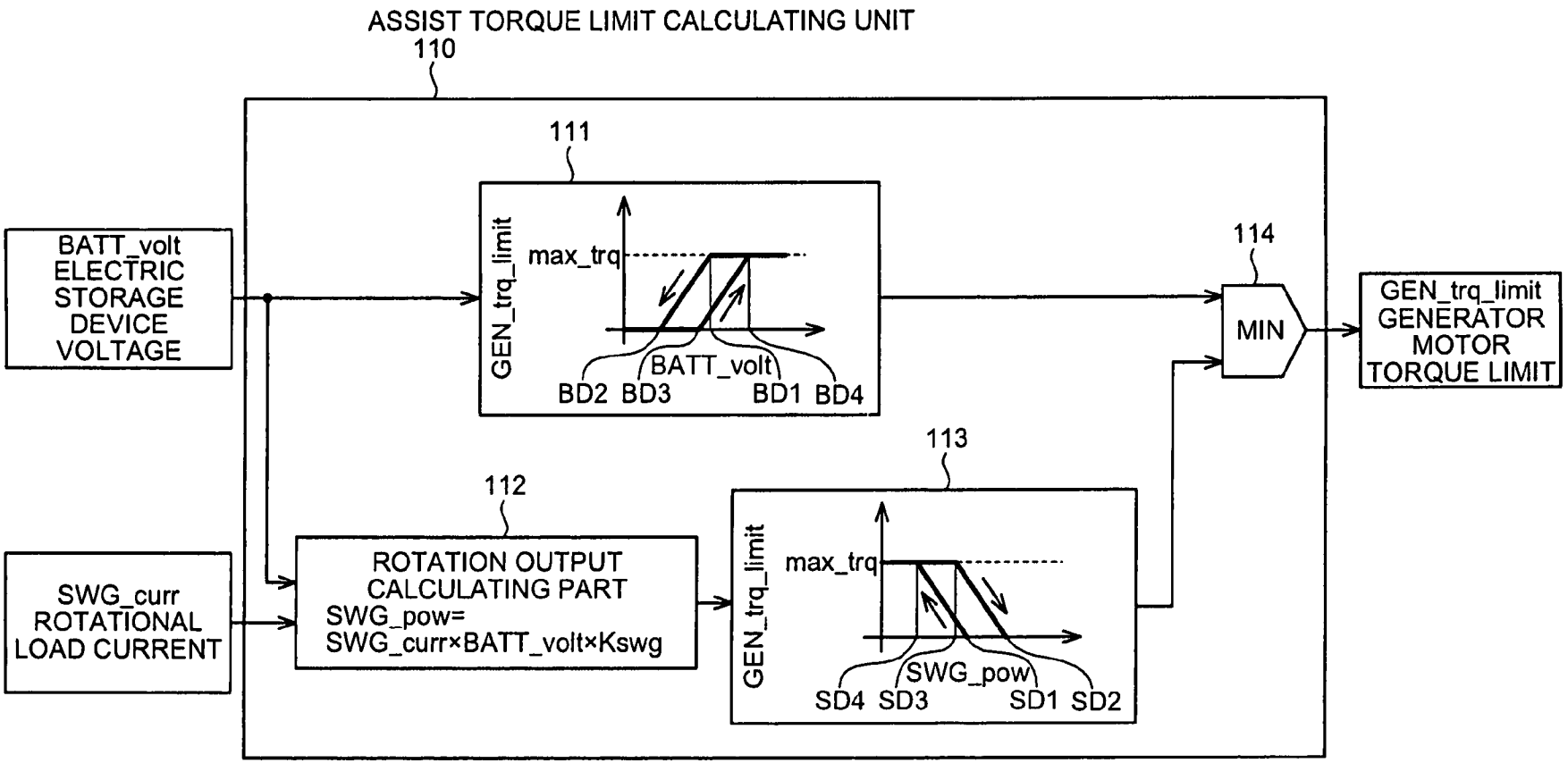
FIG. 18 is a control block diagram showing a processing content performed in the controller 6.

FIG. 18 is a block diagram showing a detailed internal configuration of the assist torque limit calculating unit 110.

Figure 19:
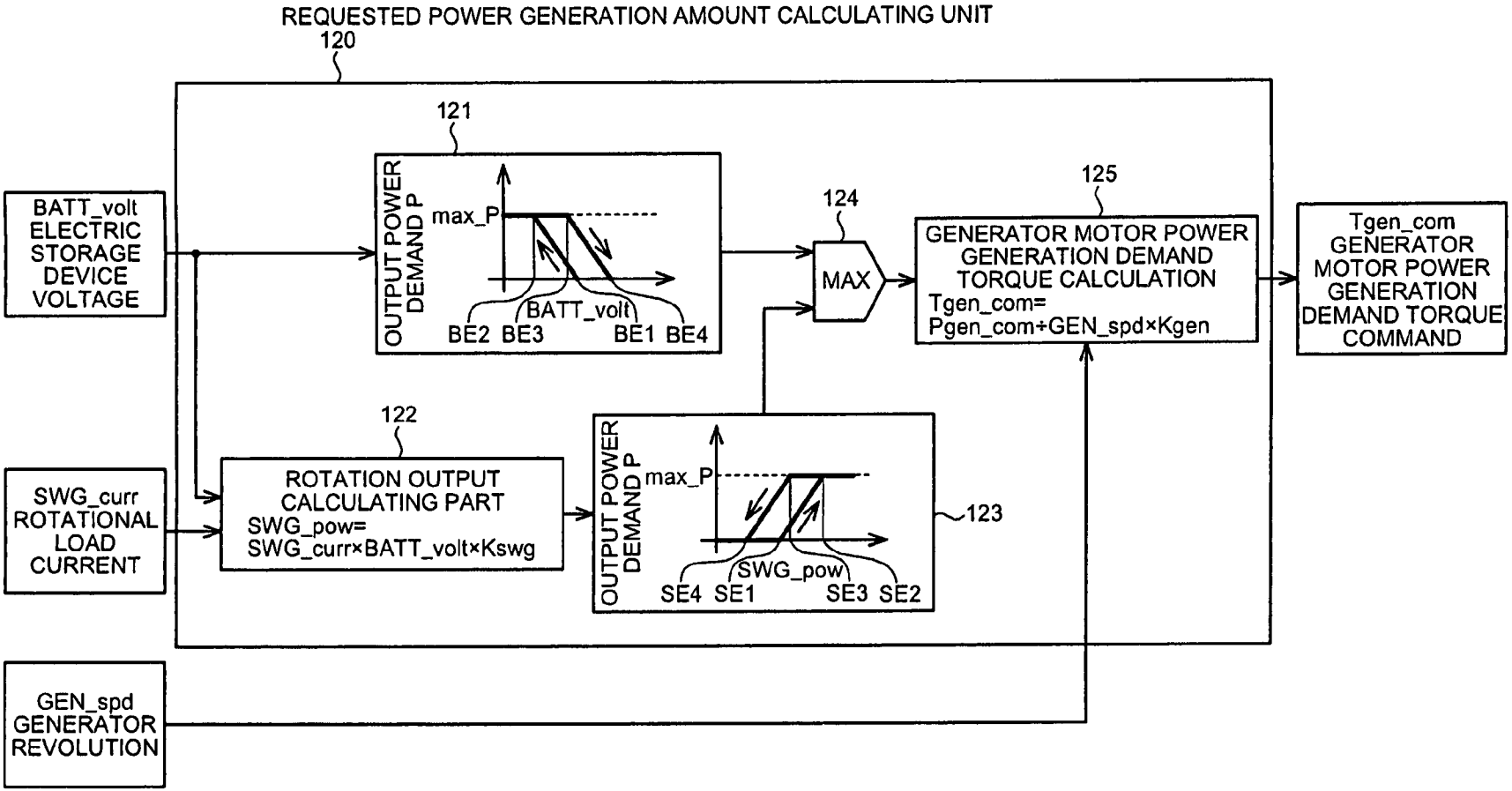
FIG. 19 is a control block diagram showing a processing content performed in the controller 6.

FIG. 19 is a block diagram showing a detailed internal configuration of the requested power generation amount calculating unit 120.

In describing the present example, the engine torque assist operation is defined as below.

The engine assist operation is the operation of adding torque to the engine output shaft by the generator motor 11 so that the engine actual revolution rapidly reaches the target revolution when performing a control such that the revolution of the engine 2 becomes a certain target revolution by adjusting the governor 4 and the fuel injection pump. The phrase "add torque" unit not only adding the axial torque to rapidly increase the revolution when accelerating the engine rotation, but also absorbing the axial torque to rapidly reduce the revolution when decelerating the engine rotation.

That is, the engine torque assist operation is equivalent to electrical-motor-operating of the generator motor 11 and assisting the engine 2, and power-generation-operating of the generator motor 11 and reverse-assisting the engine 2 in the first example.

Regarding the effects of the engine torque assist operation described above in the second example, the responsiveness of engine acceleration improves and the workability enhances in time of acceleration of engine rotation, and the engine revolution rapidly lowers as the engine axial torque is absorbed and noise and vibration in deceleration of the engine revolution improve in time of deceleration of engine rotation. Since the engine axial torque is absorbed when lowering the engine revolution, the rotation kinetic energy of the inertia about the engine output shaft can be collected, thereby improving in terms of energy efficiency.

The phrase "not engine-torque-assist-operated" is a mode of power-generation-operating the generator motor 11 and operating the electrical upper rotation body by supplying energy (power) to the electrical storage device 12 or directly to the rotation motor 103.

The control to perform the engine torque assist operation or not to perform the engine torque assist operation is executed by the generator motor controller 100 or the rotation controller 102 based on a command from the controller 6, as hereinafter described.

As shown in FIG. 15, in the third example, the rotation motor 103 serving as an electrical motor is coupled to the drive shaft of the rotation machine 104, where when the rotation motor 103 is driven, the rotation machine 104 is driven and the upper rotation body is turn-operated through the swing pinion, the swing circle, and the like.

The rotation motor 103 performs the power generating operation and the electrical motor operation. That is, the rotation motor 103 can operate as an electrical motor or a generator. When the rotation motor 103 is operated as the electrical motor, the upper rotation body rotates, where when the upper rotation body stops rotation, the torque of the upper rotation body is absorbed and the rotation motor 103 operates as the generator.

The rotation motor 103 is drive-controlled by the rotation controller 102. The rotation controller 102 is electrically connected to the electrical storage device 12 by way of a DC power supply line, and is electrically connected to the generator motor 100. The generator motor controller 100 is configured to include the function of the inverter 13 of the second example (FIG. 3). The rotation controller 102 and the generator motor controller 100 are controlled according to the command output from the controller 6.

The current supplied to the rotation motor 103, that is the rotation load current SWGcurr indicating the load of the upper rotation body is detected by the current sensor 101. The rotation load current SWGcurr detected by the current sensor 101 is input to the controller 6.

In the third example, when the engine target revolution ncom is selected in the minimum value selecting unit 65 similar to the second example as shown in FIG. 5 and FIG. 6, the process described below is executed in the control block 2 shown in FIG. 16. Each control example will be described below.

First Control Example

In the first control example, the requested power generation amount Tgencom of the generator motor 11 is calculated according to the storage state of the electrical storage device 12 in the requested power generation amount calculating unit 120.

In the assistance necessity determining unit 90, determination is made on whether to engine-torque-assist-operate (determination result T) or not to engine-torque-assist-operate (determination result F) the generator motor 11.

When determined to engine-torque-assist-operate (determination result T) the generator motor 11 by the assist necessity determining unit 90, the generator motor command value switching unit 187 is switched to the T side, that is, the modulation processing unit 97 side, and the generator motor 11 is engine-torque-assist-operated. In this case, the generator motor speed command value (target generator motor revolution) Ngencom is output from the modulation processing unit 97 to the generator motor controller 100. In response thereto, the generator controller 100 revolution-controls the generator motor 11 to obtain the target generator motor revolution Ngencom and electrical-motor-operates or power-generation-operates the generator motor 11 to perform the engine torque assist operation. When determined not to engine-torque-assist-operate (determination result F) the generator motor 11 by the assistance necessity determining unit 90, the generator motor command value switching unit 187 is switched to the F side and the revolution control of the generator motor 11 is turned OFF so that the engine torque assist operation is not performed, and the generator motor command value switching unit 287 is switched to the F side, that is, the requested power generation amount calculating unit 120 side and the generator motor 11 is power-generation-operated so that the power generation amount corresponding to the requested power generation amount Tgencom calculated in the requested power generation amount calculating unit 120 is obtained. In this case, the requested power generation amount Tgencom is output from the requested power generation amount calculating unit 120 to the generator motor controller 100 as the generator motor torque command value (generator motor target torque). In response, the generator motor controller 100 torque-controls the generator motor 11 to obtain the generator motor target torque Tgencom, and power-generation-operates the generator motor 11. In this case, the rotation controller 102 performs a control of operating the electrical upper rotation body by supplying power generated in the generator motor 11 to the electrical storage device 12 or directly to the rotation motor 103.

In the first control example, the generator motor 11 generates power corresponding to the requested power generation amount by performing the engine torque assist operation or without performing the engine torque assist operation depending on the necessity of the engine torque assist operation, and thus the power storage amount of the electrical storage device 12 is always stably maintained at a target state, and the operability of the working machine, in particular, the upper rotation body is maintained at high level.

Second Control Example

In the second control example, the requested power generation amount Tgencom of the generator motor 11 is calculated according to the power storage state of the electrical storage device 12 in the requested power generation amount calculating unit 120.

In the first pump target absorption calculating unit 66, a first maximum torque curve 66*a* indicating the maximum absorption torque that can be absorbed by the hydraulic pump 3 is set according to the engine target revolution.

In the second pump target absorption torque calculating unit 85, a second maximum torque curve 85*a* in which the maximum absorption torque becomes greater in the engine low rotation region is set with respect to the first maximum torque curve 66*a*.

In the assistance necessity determining unit 90, determination is made on whether to engine-torque-assist-operate (determination result T) or not to engine-torque-assist-operate (determination result F) the generator motor 11.

When determined to engine-torque-assist-operate (determination result T) the generator motor 11 by the assistance necessity determining unit 90, the pump absorption torque command value switching unit 88 is switched to the T side, that is, the second pump target absorption torque calculating unit 85 side, the second maximum torque curve 85*a* is selected as the maximum torque curve, and the capacity of the hydraulic pump 3 is controlled so that the pump absorption torque having the pump absorption torque on the second maximum torque curve 85*a* corresponding to the current engine target revolution as the upper limit is obtained. When determined not to engine-torque-assist-operate (determination result F) the generator motor 11 by the assistance necessity determining unit 90, the pump absorption torque command value switching unit 88 is switched to the F side, that is, the first pump target absorption torque calculating unit 66 side, the first maximum torque curve 66*a* is selected as the maximum torque curve, and the capacity of the hydraulic pump 3 is controlled so that the pump absorption torque having the pump absorption torque on the first maximum torque curve 66*a* corresponding to the current engine target revolution as the upper limit is obtained. The control of the pump capacity is performed by outputting the control current pc-epc from the controller 6 to the pump control valve 5 and control the swash plate 3*a* of the hydraulic pump 3 through the servo piston, similar to the first example.

When determined to engine-torque-assist-operate (determination result T) the generator motor 11 by the assistance necessity determining unit 90, the generator motor command value switching unit 187 is switched to the T side, that is, the modulation processing unit 97 side, and the generator motor 11 is engine-torque-assist-operated. In this case, the generator motor speed command value (target generator motor revolution) Ngencom is output from the modulation processing unit 97 to the generator motor controller 100. In response, the generator controller 100 revolution-controls the generator motor 11 so that the target generator motor revolution Ngencom is obtained, and the generator motor 11 is electrical-operated or power-generation-operated and then engine-torque-assist-operated. When determined not to engine-torque-assist-operate (determination result F) the generator motor 11 by the assistance necessity determining unit 90, the generator motor command value switching unit 187 is switched to the F side, the revolution control of the generator motor 11 is turned OFF so as not to be engine-torque-assist-operated, and the generator motor command value switching unit 287 is switched to the F side, that is, the requested power generation amount calculating unit 120 side, and the generator motor 11 is power-generation-operated so as to obtain the power generation amount corresponding to the requested power generation amount Tgencom calculated in the requested power generation amount calculating unit 120. In this case, the requested power generation amount Tgencom is output from the requested power generation amount calculating unit 120 to the generator motor controller 100 as the generator motor torque command value (generator motor target torque). In response, the generator motor controller 100 torque-controls the generator motor 11 so that the generator motor target torque Tgencom is obtained and power-generation-operates the generator motor 11. In this case, the rotation controller 102 performs a control to electrically operate the upper rotation body by supplying the power generated in the generator motor 11 to the electrical storage device 12 or directly to the rotation motor 103.

In the second control example, as in the first control example, the generator motor 11 generates power corresponding to the requested power generation amount by performing the engine torque assist operation or without performing the engine torque assist operation depending on the necessity of the engine torque assist operation, and thus the storage amount of the electrical storage device 12 is always stably maintained at the target state, and the operability of the working machine, in particular, the upper rotation body is always maintained at high level.

Furthermore, in the second control example, the capacity of the hydraulic pump 3 is controlled so that the pump absorption torque having the pump absorption torque on the second maximum torque curve 85*a* in which the maximum absorption torque becomes greater in the engine low rotation region as the upper limit is obtained with respect to the first maximum torque curve 66*a* while performing the engine torque assist operation by the generator motor 11, and thus the absorption torque of the hydraulic pump 3 at the initial stage in raising the engine rotation becomes large. The start of movement of the working machine with respect to the movement of the operation lever thus becomes fast, lowering in work efficiency can be suppressed, and uncomfortable feeling in operation on the operator is alleviated. As described in the second example, an overload might be applied on the engine 2 if controlled according to the second maximum torque curve L2 without performing the engine torque assist operation by the generator motor 11. That is, if the capacity of the hydraulic pump 3 is controlled according to the second maximum torque curve 85*a* without the engine torque assist operation, the torque equal to or greater than the output in the engine single body is absorbed by the hydraulic pump 3, and not only the engine revolution is increased, but the engine revolution lowers due to high load, and in the worst case, engine stall might occur. Therefore, in the second control example 2, a control according to the second maximum torque curve 85*a* is guaranteed on the premise of the engine torque assist operation by the generator motor 11.

Third Control Example

In the first control example and the second control example, determination as shown in FIG. 17 is specifically performed in the assistance necessity determining unit 90. That is, in the first determining part 92, when the absolute value of the deviation Δgenspd of the target generator motor revolution Ngencom and the actual generator motor revolution GENspd is equal to or greater than a predetermined value, that is, when the absolute value of the deviation between the engine target revolution and the actual revolution of the engine 2 is equal to or greater than a predetermined threshold value, determination is made to engine-torque-assist-operate the generator motor 11 and the assist flag is set to T. When the absolute value of the deviation Δgenspd of the target generator motor revolution Ngencom and the actual generator motor revolution GENspd is equal to or smaller than a predetermined value, that is, when the absolute value of the deviation between the engine target revolution and the actual revolution of the engine 2 is smaller than a predetermined threshold value, determination is made not to engine-torque-assist-operate the generator motor 11 and the assist flag is set to F.

When the revolution deviation Δgenspd has a positive sign and is equal to or greater than a certain extent, the generator motor 11 is motor-operated to assist the engine 2. Thus, the engine revolution rapidly rises towards the engine target revolution when the current engine revolution and the target revolution are different. When the revolution deviation Δgenspd has a negative sign and is equal to or greater than a certain extent, the generator motor 11 is power-generation-operated to reverse-assist the engine 2. Thus, power generating operation is performed in time of deceleration of the engine revolution, the engine revolution is rapidly lowered and the energy of the engine 2 is regenerated.

Therefore, in the third control example, the control is stabilized since the threshold value is provided with respect to the deviation and determination is made on whether or not to perform the engine torque assist operation. That is, when the threshold value is not provided with respect to deviation and the engine torque assist operation is immediately performed when deviation is found, the engine torque assist operation is continuously performed at the engine revolution close to the engine target revolution, which leads to energy loss. This is because the source of the energy for engine torque assist operation is originally the energy of the engine 2, and the energy loss always increases by the efficiency of the generator motor 11 when performing the engine torque assist operation. Generally, the efficiency lowers when the generator motor 11 is driven at small torque and power-generated.

Fourth Control Example

In the first control example and the second control example, determination as shown in FIG. 17 is specifically performed in the assistance necessity determining unit 90. That is, in the second determining part 93, determination is made not to engine-torque-assist-operate the generator motor 11 and the assist flag is set to F when the voltage value BATTvolt, that is, the storage amount of the electrical storage device 12 is equal to or smaller than a predetermined threshold value BC1. Thus, over discharge of the electrical storage device 12 is avoided and lowering in lifetime of the electrical storage device 12 can be avoided by not performing the engine torque assist operation when the storage amount of the electrical storage device 12 is low. In particular, the third example is based on the electrical rotation system, and thus the stored energy for rotating the upper rotation body is necessary, where the rotation performance is adversely affected if the storage amount is excessively reduced. The degradation of the rotation performance due to reduction in storage amount is avoided by not performing the engine torque assistance operation when the storage amount of the electrical storage device 12 is low.

Fifth Control Example

In the first control example and the second control example, the determination as shown in FIG. 17 is specifically performed in the assistance necessity determining unit 90. That is, in the rotation output calculating unit 95, the current output SWGpow of the rotation motor 103 is calculated using the rotation load current SWGcurr and the voltage value BATTvolt of the electrical storage device 12 with equation (5).

$$SWGpow=SWGcurr\times BATTvolt\times Kswg \quad (5)$$

where Kswg is a constant number.

In a third determining part 96, when the current output SWGpow of the rotation motor 103 is equal to or greater than a predetermined threshold value SC1, determination is made not to engine-torque-assist-operate the generator motor 11, and the assist flag is set to F. When the current output SWGpow of the rotation motor 103 is equal to or smaller than the threshold value SC2 smaller than the threshold value SC1, determination is made to engine-torque-assist-operate the generator motor 11, and the assist flag is set to T. The hysteresis is provided to between the threshold value SC1 and threshold value SC2 thereby preventing hunting in control.

In the AND circuit 94, when the assist flag obtained in the first determining part 92, the assist flag obtained in the second determining part 93, and the assist flag obtained in third determining part 96 are all set to T, the content of the assist flag is ultimately set to T, and if any of the assist flag is set to F, the content of the assist flag is ultimately set to F.

On the other hand, as shown in FIG. 19, in the requested power generation amount calculating unit 120, the requested power generation amount Tgencom of the generator motor 11 is calculated according to the voltage BATTvolt of the electrical storage device 12, that is, the storage state of the electrical storage device 12, and the rotation load current SWGcurr, that is, the driving state of the rotation motor 103.

In the case of the electrical rotation system, electrical energy becomes necessary to rotate the upper rotation body. The accumulated energy of the electrical storage device 12 is not enough to turn-operate the upper rotation body at high output, and the generator motor 11 needs to be power-generation-operated to supply power to the rotation motor 103. That is, in the requested power generation amount calculating unit 120, not only the storage state (voltage value BATTvolt) of the electrical storage device 12, but also the driving state (rotation load current SWGcurr) of the rotation motor 11 is also taken into consideration.

According to the fifth control example, when the current output SWGpow of the rotation motor 103 is equal to or greater than the predetermined threshold value SC1, determination is made not to engine-torque-assist-operate the generator motor 11, and the engine torque assist operation is prohibited. The requested power generation amount Tgencom of the generator motor 11 is calculated in view of not only the storage state (voltage value BATTvolt) of the electrical storage device 12 but also the driving state (rotation load current SWGcurr) of the rotation motor 103, power generation corresponding to such requested power generation amount Tgencom is performed in the generator motor 11, and the generated power is supplied to the rotation motor 103. The upper rotation body thus can be turn-operated without lowering the rotation performance.

Sixth Control Example

As described above, when the revolution deviation Δgenspd has a positive sign and becomes equal to or greater than a certain extent, the generator motor speed command value (target generator motor revolution) Ngencom is output from the modulation processing unit 97 to the generator motor controller 100, and the generator motor controller 100 revolution-controls the generator motor 11 so that the target generator motor revolution Ngencom is obtained in response thereto and motor-operates the generator motor 11. That is, when the current engine revolution is smaller than the engine target revolution, the generator motor 11 is motor-operated, the axial torque of the engine 2 is added on the torque curve diagram of the engine 2 to raise the engine revolution, and the output torque of the generator motor 11 is controlled so that the revolution same as the engine target revolution is obtained.

When the revolution deviation Δgenspd has a negative sign and becomes equal to or greater than a certain extent, the generator motor speed command value (target generator motor revolution) Ngencom is output from the modulation processing unit 97 to the generator motor controller 100, and the generator motor controller 100 revolution-controls the generator motor 11 so that the target generator motor revolution Ngencom is obtained in response thereto, and power-generation-operates the generator motor 11. That is, when the current engine revolution is greater than the engine target revolution, the generator motor 11 is power-generation-operated, the axial torque of the engine 2 is absorbed on the torque curve diagram of the engine, the engine revolution is lowered and the output torque of the generator motor 11 is controlled so that the revolution same as the engine target revolution is obtained.

Seventh Control Example

As described above, when determined that the voltage value BATTvolt, that is, the storage amount of the electrical storage device 12 is equal to or smaller than the predetermined threshold value BC1 in the assistance necessity determining unit 90, determination is made not to engine-torque-assist-operate the generator motor 11 (determination result F), the generator motor command value switching unit 287 is switched to the F side, that is, the requested power generation amount calculating unit 120 side, and the generator motor 11 is power-generation-operated so that the power generation amount corresponding to the requested power generation amount Tgencom calculated in the requested power generation amount calculating unit 120 is obtained.

If the storage amount of the electrical storage device 12 becomes equal to or smaller than a certain threshold value, the engine torque assist operation is immediately prohibited, and switch is suddenly made from the engine torque assist operation state to the power generating operation state corresponding to the requested power generation amount, in which case sudden load applies to the output shaft of the engine 2. The engine 2 then cannot cope with the sudden load, the output of the torque cannot catch up and the engine revolution suddenly lowers. Sudden lowering in the engine revolution leads to lowering in the output of the working machine and thus is not desirable in terms of work efficiency.

In the seventh control example, the upper limit value (torque limit) of the torque to be output by the generator motor 11 is gradually made to a small value according to decrease in the storage amount (voltage value BATTvolt) of the electrical storage device 12 before switching from the engine torque assist operation state to the power generating operation state corresponding to the requested power generation amount. Specifically, as shown in FIG. 18, in the calculating part 111 of the assist torque limit calculating unit 110, the torque upper limit of the generator motor 11 (generator motor torque limit) GENtrqlimit is obtained and output as a value that gradually decreases with decrease in the voltage value BATTvolt of the electrical storage device 12 from the first predetermined value BD1 to the second predetermined value BD2 smaller than the first predetermined value BD1.

When determined to engine-torque-assist-operate the generator motor 11 (determination result T), and the generator motor command value switching unit 287 is switched to the T side, that is, the assist torque limit calculating unit 110 side, the generator motor torque limit GENtrqlimit is output from the assist torque limit calculating unit 110 to the generator motor controller 100 as the limiting value of the generator motor torque command value (generator motor target torque) Tgencom.

When determined to perform the engine torque assist operation, the generator motor 11 operates at speed control so that the target revolution is obtained. The generator motor torque command value (generator motor target torque) Tgencom of the generator motor 11 is calculated as a result of speed control loop.

The generator motor controller 100 controls the generator motor 11 so that the generator motor torque command value (generator motor target torque) Tgencom calculated from the speed control loop does not exceed the generator motor torque limit GENtrqlimit calculated in the assist torque limit calculating unit 110, and assist-operates the generator motor 11. That is, the torque of the generator motor 11 is controlled in the range of lower than or equal to the torque upper limit value GENtrqlimit. When the voltage value BATTvolt of the electrical storage device 12 becomes equal to or smaller than the predetermined threshold value BC1, and the generator motor command value switching unit 287 is switched to the F side, that is, the requested power generation amount calculating unit 120 side, the generator motor 11 is power-generation-operated to obtain the power generation amount corresponding to the requested power generation amount Tgencom calculated in the requested power generation amount calculating unit 120. In this case, the requested power generation amount Tgencom is output from the requested power generation amount calculating unit 120 to the generator motor controller 100 as the generator motor torque command value (generator motor target torque). In response thereto, the generator motor controller 100 torque-controls the generator motor 11 to obtain the generator motor target torque Tgencom, and power-generation-operates the generator motor 11. Thus, in the seventh control example, the upper limit value (torque limit) GENtrqlimit of the torque to be output by the generator motor 11 is gradually made to a small value according to decrease in the storage amount (voltage value BATTvolt) of the electrical storage device 12 before switching from the engine torque assist operation state to the power generating operation state corresponding to the requested power generation amount, so that the change in power generation torque of the generator motor 11 in switching from the engine torque assist operation state to the power generating operation state corresponding to the requested power generation amount becomes smooth, and lowering in engine revolution in time of switching is avoided.

Eighth Example

In the eighth example, the following control is performed in the calculating part 111 of the assist torque limit calculating unit 110 in the seventh control example. That is, the torque upper limit value (generator motor torque limit) GENtrqlimit of the generator motor 11 is obtained and output as a value that gradually decreases with decrease in the voltage value BATTvolt of the electrical storage device 12 from the first predetermined value BD1 to the second predetermined value BD2 smaller than the first predetermined value BD1, and when increased after once decreased, the torque upper limit value (generator motor torque limit) GENtrqlimit of the generator motor 11 is obtained and output as a value that gradually increases with increase in the voltage value BATTvolt of the electrical storage device 12 from the third predetermined value BD3 to the fourth predetermined value BD4 greater than the third predetermined value BD3.

The control is stably performed by providing hysteresis to the manner of changing the generator motor torque limit GENtrqlimit.

Ninth Control Example

As described above, when determined that the current output SWGpow of the rotation motor 103 is equal to or greater than the predetermined value SC1 in the assistance necessity determining unit 90, determination is made not to engine-torque-assist-operate (determination result F) the generator motor 11, the generator motor command value switching unit 287 is switched to the F side, that is, the requested power generation amount calculating unit 120 side, and the generator motor 11 is power-generation-operated to obtain the power generation amount corresponding to the requested power generation amount Tgencom calculated in the requested power generation amount calculating unit 120.

Similar to the seventh control example, when the current output SWGpow of the rotation motor 103 reaches equal to or greater than the predetermined threshold value SC1, the engine torque assist operation is immediately prohibited, where sudden load is applied to the output shaft of the engine 2 if suddenly switched from the engine torque assist operation state to the power generating operation state corresponding to the requested power generation amount. The engine 2 then cannot cope with the sudden load, the output of the torque cannot catch up and the engine revolution suddenly lowers. Sudden lowering in the engine revolution leads to lowering in the output of the working machine and thus is not desirable in terms of work efficiency.

Similar to the seventh control example, in the ninth control example, the upper limit value (torque limit) of the torque to be output by the generator motor 11 is gradually made to a small value according to increase in the current output SWGpow of the rotation motor 11 before switching from the engine torque assist operation state to the power generating operation state corresponding to the requested power generation amount.

Specifically, as shown in FIG. 18, in the rotation output calculating part 112 of the assist torque limit calculating unit 110, the current output SWGpow of the rotation motor 103 is obtained by equation (5) (SWGpow=SWGcurr×BATTvolt×Kswg), and then in the calculating unit 113, the torque upper limit value (generator motor torque limit) GENtrqlimit of the generator motor 11 is obtained and output as a value that gradually decreases with increase in the current output SWGpow of the rotation motor 103 from the first predetermined value SD1 to the second predetermined value SD2 greater than the first predetermined value SD1.

The smaller value of the torque upper limit value GENtrqlimit obtained in the calculating part 111 and the torque upper limit value GENtrqlimit obtained in the calculating unit 113 is selected in the minimum value selecting unit 114, and output from the assist torque limit calculating unit 110 as the final torque upper limit value (generator motor torque limit GENtrqlimit).

When determined to engine-torque-assist-operate the generator motor 11 (determination result T), and the generator motor command value switching unit 287 is switched to the T side, that is, the assist torque limit calculating unit 110 side, the generator motor torque limit GENtrqlimit is output from the assist torque limit calculating unit 110 to the generator motor controller 100 as the limiting value of the generator motor torque command value (generator motor target torque) Tgencom.

When determined to perform the engine torque assist operation, the generator motor 11 operates at speed control so that the target revolution is obtained. The generator motor torque command value (generator motor target torque) Tgencom of the generator motor 11 is calculated as a result of speed control loop.

The generator motor controller 100 controls the generator motor 11 so that the generator motor torque command value (generator motor target torque) Tgencom calculated from the speed control loop does not exceed the generator motor torque limit GENtrqlimit calculated in the assist torque limit calculating unit 110, and assist-operates the generator motor 11. That is, the torque of the generator motor 11 is controlled in the range of lower than or equal to the torque upper limit value GENtrqlimit.

When the current output SWGpow of the rotation motor 103 becomes equal to or greater than the predetermined threshold value SC1, and the generator motor command value switching unit 287 is switched to the F side, that is, the requested power generation amount calculating unit 120 side, the generator motor 11 is power-generation-operated to obtain the power generation amount corresponding to the requested power generation amount Tgencom calculated in the requested power generation amount calculating unit 120. In this case, the requested power generation amount Tgencom is output from the requested power generation amount calculating unit 120 to the generator motor controller 100 as the generator motor torque command value (generator motor target torque). In response thereto, the generator motor controller 100 torque-controls the generator motor 11 to obtain the generator motor target torque Tgencom, and power-generation-operates the generator motor 11. Thus, in the ninth control example, the upper limit value (torque limit) GENtrqlimit of the torque to be output by the generator motor 11 is gradually made to a small value according to increase in the current output SWGpow of the rotation motor 103 before switching from the engine torque assist operation state to the power generating operation state corresponding to the requested power generation amount, so that the change in power generation torque of the generator motor 11 in switching from the engine torque assist operation state to the power generating operation state corresponding to the requested power generation amount becomes smooth, and lowering in engine revolution in time of switching is avoided.

Tenth Control Example

In the tenth example, the following control is performed in the calculating part 113 of the assist torque limit calculating unit 110 in the ninth control example. That is, the torque upper limit value (generator motor torque limit) GENtrqlimit of the generator motor 11 is obtained and output as a value that gradually decreases with increase in the current output SWGpow of the rotation motor 103 from the first predetermined value SD1 to the second predetermined value SD2 greater than the first predetermined value SD1, and when increased after once decreased, the torque upper limit value (generator motor torque limit) GENtrqlimit of the generator motor 11 is obtained and output as a value that gradually increases with decrease in the current output SWGpow of the rotation motor 103 from the third predetermined value SD3 to the fourth predetermined value SD4 smaller than the third predetermined value SD3.

The control is stably performed by providing hysteresis to the manner of changing the generator motor torque limit GENtrqlimit.

Eleventh Control Example

As described above, when determined that the voltage value BATTvolt of the electrical storage device 12 is equal to or greater than the predetermined value BC1 in the assistance necessity determining unit 90, or when determined that the current output SWGpow of the rotation motor 103 is equal to or greater than the predetermined threshold value SC1, determination is made not to engine-torque-assist-operate (determination result F) the generator motor 11, the generator motor command value switching unit 287 is switched to the F side, that is, the requested power generation amount calculating unit 120 side, and the generator motor 11 is power-generation-operated to obtain the power generation amount corresponding to the requested power generation amount Tgencom calculated in the requested power generation amount calculating unit 120.

When the voltage value BATTvolt of the electrical storage device 12 becomes equal to or smaller than the predetermined value BC1 or the current output SWGpow of the rotation motor 103 reaches equal to or greater than the predetermined threshold value SC1, the engine torque assist operation is immediately prohibited, where sudden load is applied to the output shaft of the engine 2 if suddenly switched from the engine torque assist operation state to the power generating operation state corresponding to the requested power generation amount. The engine 2 then cannot cope with the sudden load, the output of the torque cannot catch up and the engine revolution suddenly lowers. Sudden lowering in the engine revolution leads to lowering in the output of the working machine and thus is not desirable in terms of work efficiency.

In the eleventh control example, in place of the implementation of the seventh control example, the eighth control example, the ninth control example, and the tenth control example, or in addition to the implementation of such control example, a control to change the power generation torque of the generator motor 11 gradually from the torque at the termination of assist to the power generation torque corresponding to the requested power generation amount of the generator motor 11 is performed immediately after the switch from the engine torque assist operation state to the power generating operation state corresponding to the requested power generation amount to avoid sudden lowering in the engine revolution in time of switching.

Specifically, as shown in FIG. 19, in the calculating unit 121 of the requested power generation amount calculating unit 120, the requested power generation output P is obtained and output as a value that gradually increases from zero output to the power generation output Pmax corresponding to the requested power generation amount of the generator motor 11 with decrease in the voltage value BATTvolt of the electrical storage device 12 from the first predetermined value BE1 to the second predetermined value BE2 smaller than the first predetermined value BE1. When decreased after once increased, the requested power generation output P is obtained and output as a value that gradually decreases with increase in the voltage value BATTvolt of the electrical storage device 12 from the third predetermined value BE3 to the fourth predetermined value BE4 greater than the third predetermined value BE3.

The control is stably performed by providing hysteresis to the manner of changing the requested power generating output P.

In the rotation output calculating part 122, the current output SWGpow of the rotation motor 103 is obtained by equation (5) (SWGpow=SWGcurr×BATTvolt×Kswg) using the rotation load current SWGcurr and the voltage value BATTvolt of the electrical storage device 12. In the calculating unit 123, the requested power generation output P is obtained and output as a value that gradually increases from zero output to the power generation output Pmax corresponding to the requested power generation amount of the generator motor 11 with increase in the current output SWGpow of the rotation motor 103 from the first predetermined value SE1 to the second predetermined value SE2 greater than the first predetermined value SE1. When decreased after once increased, the requested power generation output P is obtained and output as a value that gradually decreases with decrease in the current output SWGpow of the rotation motor 103 from the third predetermined value SE3 to the fourth predetermined value SE4 smaller than the third predetermined value SE3.

The control is stably performed by providing hysteresis to the manner of changing the requested power generating output P.

The greater value of the requested power generation output P obtained in the calculating unit 121 and the requested power generation output P obtained in the calculating unit 123 is selected in the maximum value selecting unit 124, and is provided to the generator motor requested power generation torque calculating unit 125 as a final requested power generation output Pgencom. In the generator motor requested power generation torque calculating unit 125, the generator motor requested power generation torque gencom is obtained with equation (6) using the generator motor revolution GENspd and the requested power generation output Pgencom.

$$Tgencom=Pgencom\div GENspd\times Kgen \quad (6)$$

where Kgen is a constant.

The generator motor requested power generation torque Pgencom ultimately obtained by equation (6), that is, the requested power generation torque Tgencom for gradually increasing the power generation torque of the generator motor 11 from zero torque to the power generation torque corresponding to the requested power generation amount of the generator motor is output from the requested power generation amount calculating unit 120.

when the voltage value BATTvolt of the electrical storage device 12 become equal to or smaller than the predetermined threshold value BC1 or the current output SWGpow of the rotation motor 103 becomes equal to or smaller than the predetermined threshold value SC1, the generator motor command value switching unit 287 is switched to the F side, that is, the requested power generation amount calculating unit 120 side.

Immediately after switching, the requested power generation torque for gradually increasing the power generation torque of the generator motor 11 from zero torque to the power generation torque corresponding to the requested power generation amount of the generator 11, that is, the requested power generation amount Tgencom is output to the generator motor controller 100 as the generator motor torque command value (generator motor target torque), as described above. In response thereto, the generator motor controller 100 torque-controls the generator motor 11 to obtain the generator motor target torque Tgencom, and power-generation-operates the generator motor 11.

In the eleventh control example 11, immediately after switching from the engine torque assist operation state to the power generating operation state corresponding to the requested power generation amount, a control to gradually increase the power generation torque of the generator motor 11 from zero torque to the power generation torque corresponding to the requested power generation amount of the generator motor 11 is performed, and thus change in power generation torque of the generator motor 11 in switching from the engine torque assist operation to the power generating operation state corresponding to the requested power generation amount becomes smooth thereby avoiding lowering of the engine revolution in time of switching.

Twelfth Control Example

In the seventh, eighth, ninth, and tenth control examples, the control of gradually making the torque limit value of the generator motor 11 smaller during the engine torque assist operation has been described.

However, when the control of gradually making the torque upper limit value (torque limit value) of the generator motor 11 smaller while the engine torque assist operation is performed, the force assisting the engine 2 gradually becomes smaller, and thus the acceleration of the engine 2 naturally degrades when switching from the engine torque assist operation to the power generating operation state corresponding to the requested power generation amount.

In the twelfth control example, the capacity of the hydraulic pump 3 is controlled to gradually reduce the maximum absorption torque of the hydraulic pump 3 with reduction in the torque upper limit value of the generator motor 11, so that the absorption torque of the hydraulic pump 3 lowers with lowering in the assist force of the engine 2, and the degradation of the engine revolution acceleration with lowering in the assist force of the engine 2 is avoided.

That is, as shown in FIG. 16, the generator motor torque limit GENtrqlimit is output from the assist torque limit calculating unit 110 to the third pump maximum absorption torque calculating unit 106 as the torque upper limit value Tgencom2 of the generator motor 11. The third pump maximum absorption torque calculating unit 106 is stored with a third maximum torque curve L3 in which the maximum absorption torque (third pump maximum absorption torque) Tpcommax of the hydraulic pump 3 gradually decreases with decrease in the generator motor torque limit GEMtrqlimit of the generator motor 11 as a functional relation 106*a* of the generator motor torque limit GENtrqlimit and the third pump maximum absorption torque Tpcommax in a data table format. In the third pump maximum absorption torque calculating unit 106, the third pump maximum absorption torque Tpcommax corresponding to the generator motor torque limit GENtrqlimit of the current generator motor 11 is calculated according to the functional relation 106*a*.

The first pump maximum absorption torque (first pump target absorption torque) Tpcom1 is calculated according to the functional relation 66*a* as a value on the first maximum torque curve (first target torque curve) in the first pump target absorption torque calculating unit 66.

The second pump maximum absorption torque (second pump target absorption torque) Tpcom2 is calculated according to the functional relation 85*a* as a value on the second maximum torque curve (second target torque curve) L2 in the second pump target absorption torque calculating unit 85.

In the minimum value selecting unit 107, the smaller pump maximum absorption torque value of the current third pump maximum absorption torque Tpcommax and the current second pump maximum absorption torque Tpcom2 is selected, and is output to the T side terminal of the pump absorption torque command value switching unit 88.

The current first pump maximum absorption torque Tpcom is applied to the F side terminal of the pump absorption torque value switching unit 88.

When determined that the content of the assist flag is T in the assist flag determining unit 95, the pump absorption torque command value switching unit 88 is switched to the minimum value selecting unit 107 side, and the smaller value of the current second pump maximum absorption torque Tpcom2 output from the second pump target absorption torque calculating unit 85 and the current third pump maximum absorption torque Tpcommax output from the third pump maximum absorption torque calculating unit 106 is output to the filter unit 89 of post stage as the pump maximum absorption torque Tpcom.

When determined that the content of the assist flag is F in the assist flag determining unit 95, the pump absorption torque command value switching unit 88 is switched to the first pump target absorption torque calculating 66 side, and the current first pump maximum absorption torque Tpcom1 output from the first pump target absorption torque calculating unit 66 is output to the filter unit 89 of post stage as the pump maximum absorption torque Tpcom. The filtering described above is performed in the filter unit 89, the control current pc-epc is output from the control current calculating unit 67 to the pump control valve 5, and the swash plate 3*a* of the hydraulic pump 3 is adjusted. That is, when performing the power generating operation, the first pump maximum absorption torque Tpcom1 defined from the first maximum torque curve L1 is selected regardless of the magnitude of the third pump maximum absorption torque Tpcommax defined from the third maximum torque curve L3, and the capacity of the hydraulic pump 3 is controlled with the first pump maximum absorption torque Tpcom1 as the upper limit Tpcom of the pump absorption torque. When performing the engine torque assist operation, the smaller of the second pump maximum absorption torque Tpcm2 defined from the second maximum torque curve L2 or the third pump maximum absorption torque Tpcommax defined from the third maximum torque curve L3 is selected, and the capacity of the hydraulic pump 3 is controlled with the smaller pump maximum absorption torque as the upper limit Tpcom of the pump absorption torque.

According to the present control example, the capacity of the hydraulic pump 3 is controlled so that the maximum absorption torque of the hydraulic pump 3 gradually decreases according to decrease in the torque upper limit value of the generator motor 11, and thus the absorption torque of the hydraulic pump 3 lowers with lowering in the assist force of the engine 2 when switching from the engine torque assist operation state to the power generating operation state corresponding to the requested power generation amount, the change in axial torque of the engine 2 becomes smooth, and the degradation in the engine revolution acceleration involved in lowering of the assist force of the engine 2 is avoided.

Thirteenth Control Example

As described above, in switching between the engine torque assist operation and the power generating operation state corresponding to the requested power generation amount, the selection of the maximum absorption torque of the hydraulic pump 3 switches between the second pump maximum absorption torque Tpcom2 or the third pump maximum absorption torque Tpcommax and the first pump maximum absorption torque Tpcom1. Thus, in switching, an uncomfortable feeling in operation may be provided to the operator such as fluctuation in the working machine speed due to change in the pump discharge flow rate by sudden change in the pump absorption torque.

In the present control example, the control to gradually change from the pump maximum absorption torque before switching to the pump maximum absorption torque after switching is performed when the selection of the maximum absorption torque of the hydraulic pump 3 is switched, so that sudden change in the pump discharge flow rate is prevented in switching, and an uncomfortable feeling in operation on the operator such as fluctuation in working machine speed is avoided.

That is, as shown in FIG. 16, when the selection of the maximum torque curve is switched between the second maximum torque curve L2 or the third maximum torque curve L3 and the first maximum torque curve L1, the filter unit 89 gradually changes the maximum torque value Tpcom according to the characteristic 89*a* in which the maximum torque value Tpcom changes with elapse in time t. The characteristic 89*a* has a curve corresponding to a time constant τ. The switch is thus not made directly from the pump maximum absorption torque (third pump maximum absorption torque Tpcommax) on the maximum torque curve (e.g., third target torque curve L3) before switching to the pump maximum absorption torque (first pump maximum absorption torque Tpcom1) on the maximum torque curve (first maximum torque curve L1) after switching, and is gradually and smoothly changed over time t from the pump maximum absorption torque (third pump maximum absorption torque Tpcommax) on the maximum torque curve (e.g., third target torque curve L3) before switching to the pump maximum absorption torque (first pump maximum absorption torque Tpcom1) on the maximum torque curve (first maximum torque curve L1) after switching. The movement on the torque curve diagram is similar to that used in FIG. 9A.

An uncomfortable feeling in operation on the operator such as fluctuation in the working machine speed due to change in the pump discharge flow rate by sudden change in the pump absorption torque in time of switching between the engine torque assist operation state and the power generating operation state corresponding to the requested power generation amount is avoided.

The filtering may be performed in both cases when the determination result of the assist flag determining unit 95 is switched from T to F and when the determination result is switched from F to T, or the filtering may be performed only when either one of the switching is performed.

Fourteenth Control Example

In the thirteenth control example, the time constant τ at the time of changing from the pump maximum absorption torque before switching to the pump maximum absorption torque after switching is desirably set to a large value in a case where the pump maximum absorption torque before switching is greater than the pump maximum absorption torque after switching than a case where the pump maximum absorption torque before switching is smaller than the pump maximum absorption torque after switching.

This is because if the time constant τ is set to a large value uniformly, the movement of the working machine becomes slow when the pump maximum absorption torque is switched from small to large since the time constant in change in the pump maximum absorption torque is large.

INDUSTRIAL APPLICABILITY

Therefore, the control device of the engine, the control device of the engine and the hydraulic pump, as well as the control device of the engine, the hydraulic pump, and the generator motor according to the present invention are effective in a case of driving the hydraulic pump with the engine and controlling the working machine including any construction machine.

The invention claimed is:

1. A control device of an engine comprising:

a hydraulic pump driven by the engine;

hydraulic actuators supplied with pressurized fluid discharged from the hydraulic pump;

an operation unit for operating each hydraulic actuator;

a detection unit for detecting an operation amount of the operation unit;

a target flow rate calculating unit for calculating a target flow rate of the hydraulic pump based on the operation amount of the operation unit;

a first target revolution calculating unit for calculating a first target revolution of the engine according to the target flow rate;

an operation state determining unit for determining a switch of the operation unit from a non-operation state to an operation state;

a second target revolution setting unit for setting the target revolution of the engine to a second target revolution which is higher than a low idle revolution when determined that switch is made to the operation state by the operation state determining unit; and a revolution control unit for controlling the engine revolution to match the higher target revolution of the first target revolution and the second target revolution.

2. The control device of the engine according to claim 1, wherein the operation state determining unit determines that switching is made to the non-operation state when the operation amount of the operation unit is equal to or smaller than a predetermined value, and determines that switching is made to the operation state when the operation amount of the operation unit is greater than the predetermined threshold value.

3. The control device of the engine according to claim 1, wherein the operation state determining unit determines that switching is made to the non-operation state when the target flow rate of the hydraulic pump is equal to or smaller than a predetermined value, and determines that switching is made to the operation state when the target flow rate of the hydraulic pump is greater than the predetermined threshold value.

4. A control device of an engine and a hydraulic pump comprising:

a hydraulic pump driven by the engine;

a plurality of hydraulic actuators supplied with pressurized fluid discharged from the hydraulic pump;

an operation unit for operating each hydraulic actuator;

a detection unit for detecting an operation amount of the operation unit;

a first target revolution setting unit for setting a first target revolution of the engine according to the operation amount obtained by the detection unit;

a determining unit for determining a work pattern of the plurality of hydraulic actuators by using the operation amounts of each operation unit and a load pressure of hydraulic pump;

a horsepower limit value setting unit for setting a horsepower limit value of the hydraulic pump according to each work pattern;

a second target revolution setting unit for setting a second target revolution of the engine according to the horsepower limit value of the hydraulic pump;

a capacity control unit for controlling a capacity of the hydraulic pump to obtain a pump absorption torque corresponding to the smaller target revolution of the first target revolution and the second target revolution; and a revolution control unit for controlling the engine revolution to match the smaller target revolution of the first target revolution and the second target revolution.

5. A control device of an engine and a hydraulic pump comprising:

a hydraulic pump driven by the engine;

a plurality of hydraulic actuators supplied with pressurized fluid discharged from the hydraulic pump;

an operation unit for operating each hydraulic actuator;

a detection unit for detecting an operation amount of the operation unit;

a unit for setting an engine revolution by fuel dial;

a first target revolution setting unit for setting a first target revolution of the engine according to the set value of the fuel dial;

a determining unit for determining a work pattern of the plurality of hydraulic actuators by using the operation amounts of each operation unit and a load pressure of the hydraulic pump;

a horsepower limit value setting unit for setting a horsepower limit value of the hydraulic pump according to each work pattern;

a second target revolution setting unit for setting a second target revolution of the engine according to the horsepower limit value of the hydraulic pump;

a capacity control unit for controlling a capacity of the hydraulic pump to obtain a pump absorption torque corresponding to the smaller target revolution of the first target revolution and the second target revolution; and a revolution control unit for controlling the engine revolution to match the smaller target revolution of the first target revolution and the second target revolution.

6. A control device of an engine, a hydraulic pump, and a generator motor comprising:

a hydraulic pump driven by the engine;

hydraulic actuators supplied with pressurized fluid discharged from the hydraulic pump;

a generator motor connected to an output shaft of the engine;

an electrical storage device for accumulating power generated by the generator motor and supplying power to the generator motor;

a calculating unit for calculating a requested power generation amount of the generator motor according to a storage state of the electrical storage device;

an engine target revolution setting unit for setting a target revolution of the engine;

a maximum torque curve setting unit for setting a maximum torque curve indicating a maximum absorption torque which can be absorbed by the hydraulic pump according to the target revolution of the engine;

a revolution control unit for controlling the engine revolution so that the engine revolution matches a current engine target revolution;

a capacity control unit for controlling a capacity of the hydraulic pump to obtain a pump absorption torque having a pump absorption torque on the maximum torque curve corresponding to the current engine target revolution as an upper limit;

a determining unit for determining whether or not to operate an engine-torque-assist of the generator motor; and a generator motor control unit that operates the engine-torque-assist of the generator motor when determined to be in the engine-torque-assist of the generator motor by the determining unit, and that operates a power-generation of the generator motor according to the requested power generation amount when determined not to be in the engine-torque-assist of the generator motor.

7. The control device of the engine, the hydraulic pump, and the generator motor according to claim 6, wherein the determining unit determines to operate the engine-torque-assist of the generator motor when an absolute value of a deviation between the engine target revolution and an actual revolution of the engine is equal to or greater than a predetermined threshold value, and determines not to operate the engine-torque-assist of the generator motor when the absolute value of the deviation between the engine target revolution and the actual revolution of the engine is smaller than a predetermined threshold value.

8. The control device of the engine, the hydraulic pump, and the generator motor according to claim 7, further comprising a storage amount calculating unit for calculating the storage amount currently stored in the electrical storage device, wherein the determining unit determines not to operate the engine-torque-assist of the generator motor when the storage amount calculated by the storage amount calculating unit is equal to or smaller than a predetermined threshold value.

9. The control device of the engine, the hydraulic pump, and the generator motor according to claim 7, further comprising:

a rotation motor for rotating an upper rotation body of a construction machine;

a rotation operation unit for operating a turn-operation of the upper rotation body;

a control unit for controlling the rotation motor according to the turn-operation of the rotation operation unit;

an output calculating unit for calculating a current output of the rotation motor; and a calculating unit for calculating a requested power generation amount of the generator motor according to the storage state of the electrical storage device and the driving state of the rotation motor, wherein the determining unit determines not to operate the engine-torque-assist of the generator motor when the current output of the rotation motor is equal to or greater than a predetermined threshold value.

10. The control device of the engine, the hydraulic pump, and the generator motor according to claim 9, further comprising:

a torque control unit for controlling the torque of the generator motor in a range of equal to or smaller than a torque upper limit value during engine torque assist operation of the generator motor; and a torque upper limit value setting unit for gradually decreasing the torque upper limit value with increase in the current output of the rotation motor from a first predetermined value to a second predetermined value greater than the first predetermined value.

11. The control device of the engine, the hydraulic pump, and the generator motor according to claim 9, further comprising:

a torque control unit for controlling the torque of the generator motor in a range of equal to or smaller than a torque upper limit value during engine torque assist operation of the generator motor; and a torque upper limit value setting unit for gradually decreasing the torque upper limit value with increase in the current output of the rotation motor from a first predetermined value to a second predetermined value greater than the first predetermined value, and gradually increasing the torque upper limit value with decrease in the current output of the rotation motor from a third predetermined value to a fourth predetermined value smaller than the third predetermined value when increasing the torque upper limit value after once decreased.

12. The control device of the engine, the hydraulic pump, and the generator motor according to claim 6, wherein the generator motor control unit controls an output torque of the generator motor so that the engine revolution becomes the same revolution as the engine target revolution by adding an axial torque of the engine on a torque curve diagram of the engine when the current engine revolution is smaller than the engine target revolution, and controls the output torque of the generator motor so that the engine revolution becomes the same revolution as the engine target revolution by absorbing the axial torque of the engine on the torque curve diagram of the engine when the current engine revolution is greater than the engine target revolution.

13. The control device of the engine, the hydraulic pump, and the generator motor according to claim 6, further comprising:

a torque control unit for controlling the torque of the generator motor in a range of equal to or smaller than a torque upper limit value during engine torque assist operation of the generator motor; and a torque upper limit value setting unit for gradually decreasing the torque upper limit value with decrease in the storage amount of the electrical storage device from a first predetermined value to a second predetermined value smaller than the first predetermined value.

14. The control device of the engine, the hydraulic pump, and the generator motor according to claim 6, further comprising:

a torque control unit for controlling the torque of the generator motor in a range of equal to or smaller than a torque upper limit value during engine torque assist operation of the generator motor; and a torque upper limit value setting unit for gradually decreasing the torque upper limit value with decrease in the storage amount of the electrical storage device from a first predetermined value to a second predetermined value smaller than the first predetermined value, and gradually increasing the torque upper limit value with increase in the storage amount of the electrical storage device from a third predetermined value to a fourth predetermined value greater than the third predetermined value when increasing the torque upper limit value after once decreased.

15. The control device of the engine, the hydraulic pump, and the generator motor according to claim 6, wherein the generator motor control unit performs a control to gradually change the power generation torque of the generator motor from the torque at the termination of assistance to the power generation torque corresponding to the requested power generation amount of the generator motor, immediately after switching the generator motor from the engine torque assist operation to the power generating operation.

16. A control device of an engine, a hydraulic pump, and a generator motor comprising:

a hydraulic pump driven by the engine;

hydraulic actuators supplied with pressurized fluid discharged from the hydraulic pump;

a generator motor connected to an output shaft of the engine;

an electrical storage device for accumulating power generated by the generator motor and supplying power to the generator motor;

a calculating unit for calculating a requested power generation amount of the generator motor according to a storage state of the electrical storage device;

an engine target revolution setting unit for setting a target revolution of the engine;

a first maximum torque curve setting unit for setting a first maximum torque curve indicating a maximum absorption torque which can be absorbed by the hydraulic pump according to the target revolution of the engine;

a second maximum torque curve setting unit for setting a second maximum torque curve in which a maximum absorption torque becomes large in an engine low rotation region with respect to the first maximum torque curve;

a revolution control unit for controlling the engine revolution so that the engine revolution matches a current engine target revolution;

a determining unit for determining whether or not to operate an engine-torque-assist of the generator motor;

a pump capacity controlling unit for selecting the second maximum torque curve as a maximum torque curve and controlling the capacity of the hydraulic pump so as to obtain an upper limit which is a pump absorption torque having the pump absorption torque on the second maximum torque curve corresponding to the current engine target revolution when determined to be in the engine-torque-assist of the generator motor by the determining unit, and selecting the first maximum torque curve as the maximum torque curve and controlling the capacity of the hydraulic pump so as to obtain an upper limit which is a pump absorption torque having the pump absorption torque on the first maximum torque curve corresponding to the current engine target revolution when determined not to be in the engine-torque-assist of the generator motor by the determining unit; and a generator motor control unit that operates the engine-torque-assist of the generator motor when determined to be in the engine-torque-assist of the generator motor by the determining unit, and that operates a power-generation of the generator motor according to the requested power generation amount when determined not to be in the engine-torque-assist of the generator motor.

17. The control device of the engine, the hydraulic pump, and the generator motor according to claim 16, wherein the determining unit determines to operate the engine-torque-assist of the generator motor when an absolute value of a deviation between the engine target revolution and an actual revolution of the engine is equal to or greater than a predetermined threshold value, and determines not to operate the engine-torque-assist of the generator motor when the absolute value of the deviation between the engine target revolution and the actual revolution of the engine is smaller than a predetermined threshold value.

18. The control device of the engine, the hydraulic pump, and the generator motor according to claim 16, wherein the generator motor control unit controls an output torque of the generator motor so that the engine revolution becomes the same revolution as the engine target revolution by adding an axial torque of the engine on a torque curve diagram of the engine when the current engine revolution is smaller than the engine target revolution, and controls the output torque of the generator motor so that the engine revolution becomes the same revolution as the engine target revolution by absorbing the axial torque of the engine on the torque curve diagram of the engine when the current engine revolution is greater than the engine target revolution.

19. The control device of the engine, the hydraulic pump, and the generator motor according to claim 16, further comprising:

a torque control unit for controlling the torque of the generator motor in a range of equal to or smaller than a torque upper limit value during engine torque assist operation of the generator motor; and a torque upper limit value setting unit for gradually decreasing the torque upper limit value with decrease in the storage amount of the electrical storage device from a first predetermined value to a second predetermined value smaller than the first predetermined value.

20. The control device of the engine, the hydraulic pump, and the generator motor according to claim 16, further comprising:

a torque control unit for controlling the torque of the generator motor in a range of equal to or smaller than a torque upper limit value during engine torque assist operation of the generator motor; and a torque upper limit value setting unit for gradually decreasing the torque upper limit value with decrease in the storage amount of the electrical storage device from a first predetermined value to a second predetermined value smaller than the first predetermined value, and gradually increasing the torque upper limit value with increase in the storage amount of the electrical storage device from a third predetermined value to a fourth predetermined value greater than the third predetermined value when increasing the torque upper limit value after once decreased.

21. A control device of an engine, a hydraulic pump, and a generator motor comprising:

a hydraulic pump driven by the engine;

hydraulic actuators supplied with pressurized fluid discharged from the hydraulic pump;

a generator motor connected to an output shaft of the engine;

an electrical storage device for accumulating power generated by the generator motor and supplying power to the generator motor;

a calculating unit for calculating a requested power generation amount of the generator motor according to a storage state of the electrical storage device;

an engine target revolution setting unit for setting a target revolution of the engine;

a first maximum torque curve setting unit for setting a first maximum torque curve indicating a maximum absorption torque which can be absorbed by the hydraulic pump according to the target revolution of the engine;

a second maximum torque curve setting unit for setting a second maximum torque curve in which a maximum absorption torque becomes large in an engine low rotation region with respect to the first maximum torque curve;

a revolution control unit for controlling the engine revolution so that the engine revolution matches a current engine target revolution;

a determining unit for determining whether or not to operate an engine-torque-assist of the generator motor;

a generator motor control unit for operating the engine-torque-assist of the generator motor when determined to be in the engine-torque-assist of the generator motor by the determining unit, and for operating the power-generation of the generator motor according to the requested power generation amount when determined not to be in the engine-torque-assist of the generator motor;

a third pump maximum absorption torque calculating unit for calculating a third maximum torque in which the maximum absorption torque of the hydraulic pump gradually decreases with decrease in a torque upper limit value in time of assist operation of the generator motor from a first predetermined value to a second predetermined value smaller than the first predetermined value; and a pump capacity control unit for controlling a capacity of the hydraulic pump with the smaller of the pump absorption torque on the second maximum torque curve corresponding to the current engine target revolution and the third pump maximum absorption torque calculated by the third pump maximum absorption torque calculating unit as an upper limit of the pump absorption torque when determined to be in the engine-torque-assist of the generator motor by the determining unit, and for controlling the capacity of the hydraulic pump to obtain a pump absorption torque having the pump absorption torque on the first maximum torque curve corresponding to the current engine target revolution as an upper limit when determined not to be in the engine-torque-assist of the generator motor by the determining unit.

22. A control device of an engine, a hydraulic pump, and a generator motor comprising:

a hydraulic pump driven by the engine;

hydraulic actuators supplied with pressurized fluid discharged from the hydraulic pump;

a generator motor connected to an output shaft of the engine;

an electrical storage device for accumulating power generated by the generator motor and supplying power to the generator motor;

a calculating unit for calculating a requested power generation amount of the generator motor according to a storage state of the electrical storage device;

an engine target revolution setting unit for setting a target revolution of the engine;

a first maximum torque curve setting unit for setting a first maximum torque curve indicating a maximum absorption torque which can be absorbed by the hydraulic pump according to the target revolution of the engine;

a second maximum torque curve setting unit for setting a second maximum torque curve in which a maximum absorption torque becomes large in an engine low rotation region with respect to the first maximum torque curve;

a revolution control unit for controlling the engine revolution so that the engine revolution matches a current engine target revolution;

a determining unit for determining whether or not to operate an engine-torque-assist of the generator motor;

a generator motor control unit for operating the engine-torque-assist of the generator motor when determined to be in the engine-torque-assist of the generator motor by the determining unit, and for operating a power-generation of the generator motor according to the requested power generation amount when determined not to operate the engine-torque-assist of the generator motor;

a third pump maximum absorption torque calculating unit for calculating a third maximum torque in which the maximum absorption torque of the hydraulic pump gradually decreases with decrease in a torque upper limit value in time of assist operation of the generator motor from a first predetermined value to a second predetermined value smaller than the first predetermined value; and a pump capacity control unit for controlling a capacity of the hydraulic pump with the smaller of the pump absorption torque on the second maximum torque curve corresponding to the current engine target revolution and the third pump maximum absorption torque calculated by the third pump maximum absorption torque calculating unit as an upper limit of the pump absorption torque when determined to be in the engine-torque-assist of the generator motor by the determining unit, controlling the capacity of the hydraulic pump to obtain a pump absorption torque having the pump absorption torque on the first maximum torque curve corresponding to the current engine target revolution as an upper limit when determined not to be in the engine-torque-assist of the generator motor by the determining unit, and gradually changing from a pump maximum absorption torque before switching to a pump maximum absorption torque after switching when selection of the maximum absorption torque of the hydraulic pump is switched.

23. The control device of the engine, the hydraulic pump, and the generator motor according to claim 22, wherein a time constant of changing from the pump maximum absorption torque before switching to the pump maximum absorption torque after switching is set to a large value in a case where the pump maximum absorption torque before switching is greater than the pump maximum absorption torque after switching than in a case where the pump maximum absorption torque before switching is smaller than the pump maximum absorption torque after switching.

* * * * *